US011433974B2

(12) United States Patent
Basta et al.

(10) Patent No.: US 11,433,974 B2
(45) Date of Patent: Sep. 6, 2022

(54) RETRACTABLE CANOPY FOR BOATS

(71) Applicant: BASTA IP INC., Bellevue, WA (US)

(72) Inventors: Samuel T. Basta, Bellevue, WA (US); Gene Thompson, Bellevue, WA (US)

(73) Assignee: BASTA IP INC., SeaTac, WA (US)

( * ) Notice: Subject to any disclaimer, the term of this patent is extended or adjusted under 35 U.S.C. 154(b) by 0 days.

(21) Appl. No.: 16/926,251

(22) Filed: Jul. 10, 2020

(65) Prior Publication Data

US 2020/0339223 A1 Oct. 29, 2020

Related U.S. Application Data

(63) Continuation of application No. 16/289,136, filed on Feb. 28, 2019, now Pat. No. 10,759,500, which is a continuation of application No. 16/180,405, filed on Nov. 5, 2018, now abandoned, which is a continuation of application No. 16/120,656, filed on Sep. 4, 2018, now abandoned, which is a continuation of application No. 15/941,961, filed on Mar. 30, 2018, now abandoned, which is a continuation of (Continued)

(51) Int. Cl.

| | |
|---|---|
| ***E04H 15/38*** | (2006.01) |
| ***B63B 17/02*** | (2006.01) |
| ***E04H 15/48*** | (2006.01) |
| ***E04H 15/54*** | (2006.01) |
| ***E04H 15/02*** | (2006.01) |
| ***B63C 5/00*** | (2006.01) |
| ***E04H 15/40*** | (2006.01) |

(52) U.S. Cl.

CPC ..... *B63B 17/02* (2013.01); *B63C 5/00* (2013.01); *E04H 15/02* (2013.01); *E04H 15/38* (2013.01); *E04H 15/405* (2013.01); *E04H 15/48* (2013.01); *E04H 15/54* (2013.01)

(58) Field of Classification Search

CPC ..... E04H 15/38; E04H 15/405; B60J 7/085

See application file for complete search history.

(56) References Cited

U.S. PATENT DOCUMENTS 302,506 A 7/1884 Long
3,082,780 A * 3/1963 Macy ..... E04H 15/38 135/130

(Continued)

FOREIGN PATENT DOCUMENTS

GB 1313155 A * 4/1973 ..... E04H 15/46

*Primary Examiner* — Noah Chandler Hawk
(74) *Attorney, Agent, or Firm* — Seed IP Law Group LLP

(57) ABSTRACT

A retractable canopy for a watercraft lift includes an actuator operatively connected to the watercraft lift and a movable boom to rotate the movable boom relative to the watercraft lift; a linkage extends between the fixed boom and the movable boom, at least one first strut is supported by the linkage, at least one second strut is supported by a fixed boom; and at least one third strut is supported by the movable boom. The fixed boom, the movable boom, the at least one second strut, and the at least one third strut support a cover in an extended configuration above a watercraft area. The fixed boom, the movable boom, the at least one first strut, the at least one second strut, and the at least one third strut support the cover in a retracted configuration adjacent to the fixed strut.

18 Claims, 73 Drawing Sheets

Related U.S. Application Data application No. 15/252,140, filed on Aug. 30, 2016, now abandoned.

(60) Provisional application No. 62/288,331, filed on Jan. 28, 2016, provisional application No. 62/281,661, filed on Jan. 21, 2016, provisional application No. 62/217,247, filed on Sep. 11, 2015.

(56) References Cited

U.S. PATENT DOCUMENTS

| | | | | | |
|---|---|---|---|---|---|
| 3,470,659 | A * | 10/1969 | Koning | E04H 6/04 | 52/63 |
| 3,489,452 | A * | 1/1970 | Plante | B60P 3/341 | 296/161 |
| 4,250,906 | A * | 2/1981 | Rivier | B60P 3/341 | 135/150 |
| 4,748,995 | A * | 6/1988 | Viglione | E04H 15/38 | 135/130 |
| 5,121,765 | A * | 6/1992 | MacMorris, Jr. | E04H 15/505 | 135/143 |
| 6,640,868 | B1 * | 11/2003 | Guggisberg | E04H 15/38 | 160/53 |
| 8,911,174 | B2 | 12/2014 | Hey et al. | | |
| 9,527,552 | B2 | 12/2016 | Hey et al. | | |
| 9,556,640 | B2 | 1/2017 | Levin | | |
| 10,293,889 | B2 | 5/2019 | Hey et al. | | |
| 2013/0266377 | A1 * | 10/2013 | Hey | E04H 6/04 | 405/3 |
| 2015/0068572 | A1 | 3/2015 | Hatfield et al. | | |

* cited by examiner

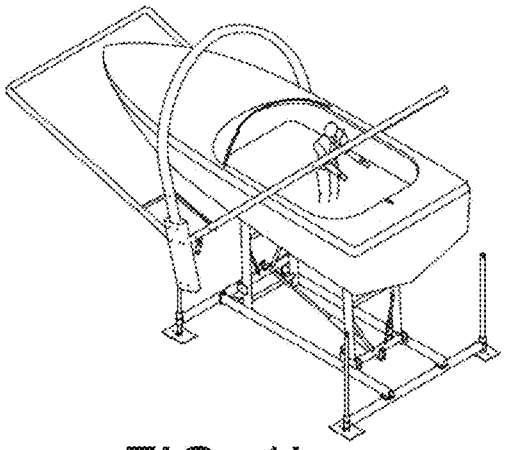
FIG. 1I
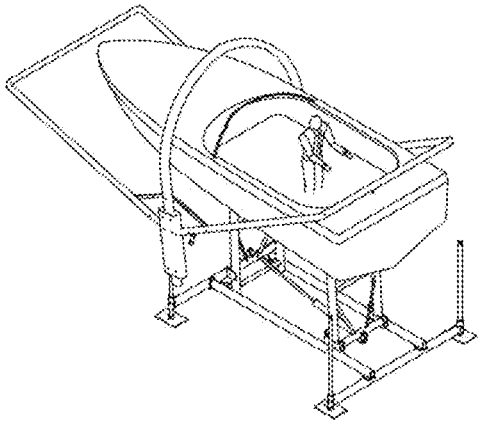
FIG. 1J
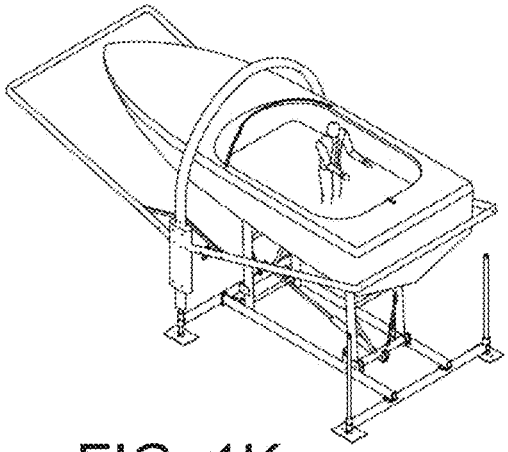
FIG. 1K
FIG. 2A
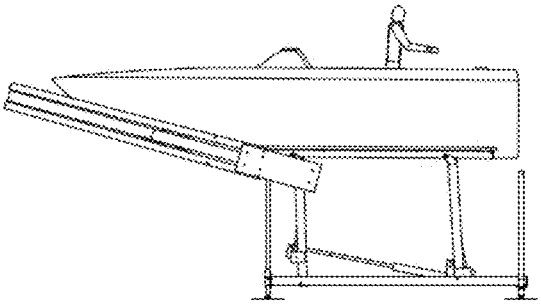

FIG. 2J
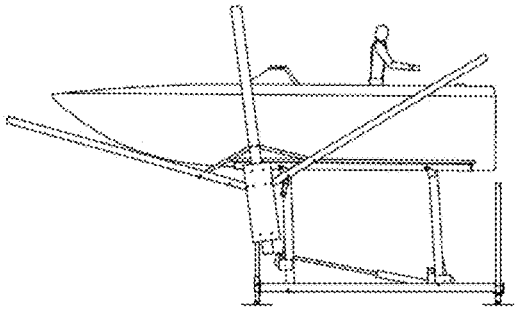
FIG. 2K
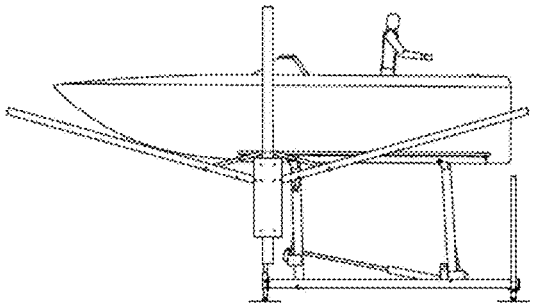
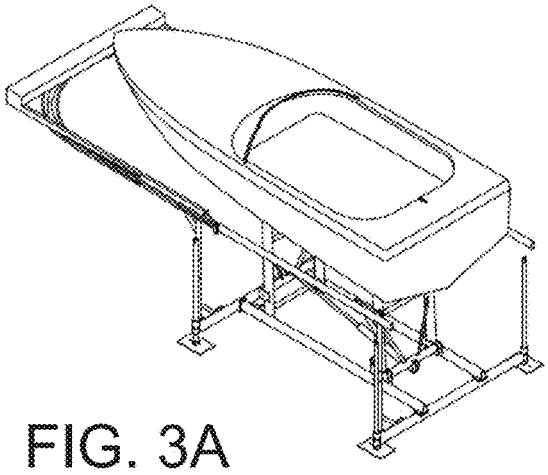
FIG. 3A
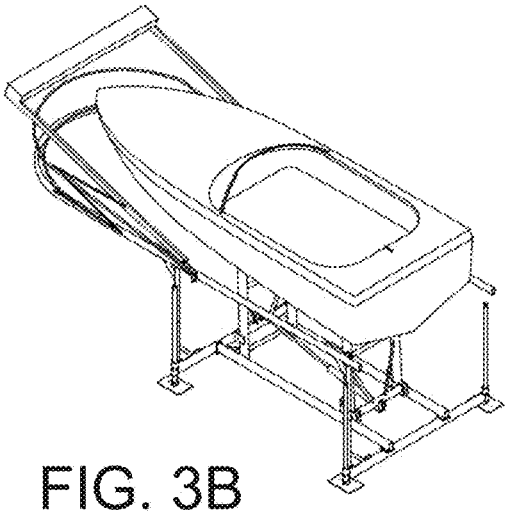
FIG. 3B

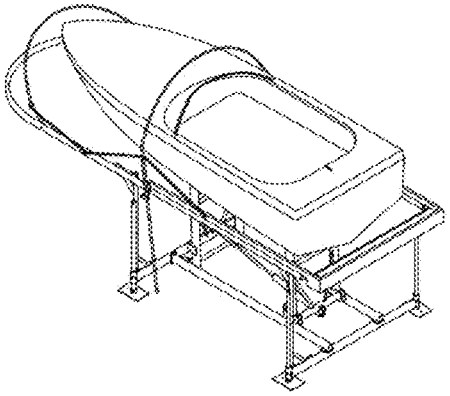
FIG. 3K
FIG. 4A
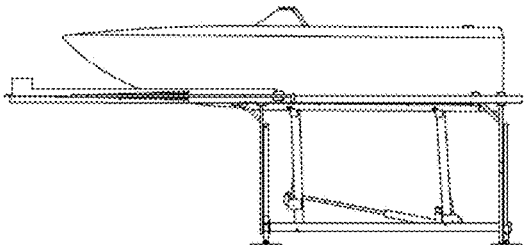
FIG. 4B
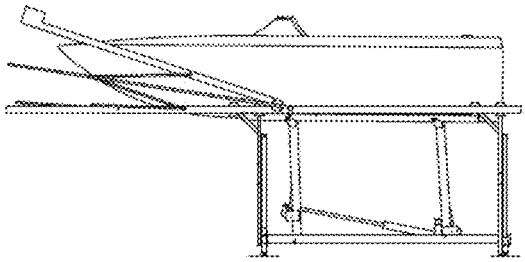
FIG. 4C
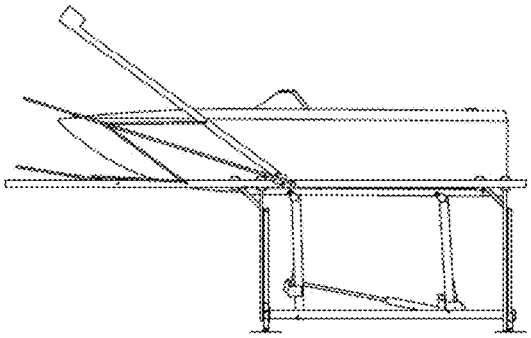

FIG. 6J
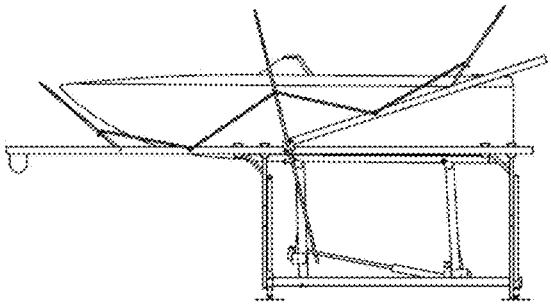
FIG. 6K
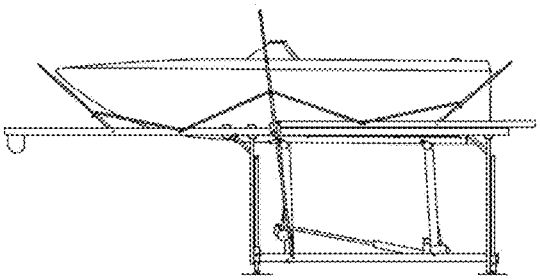
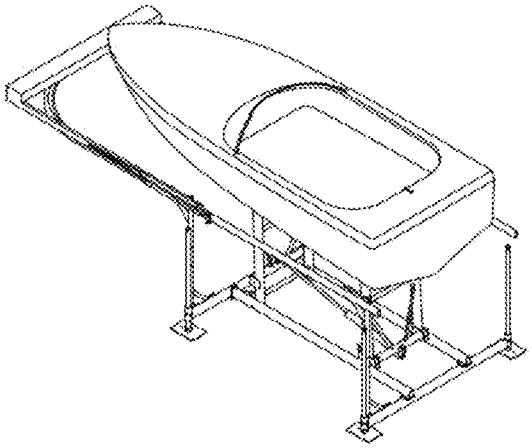
FIG. 7A
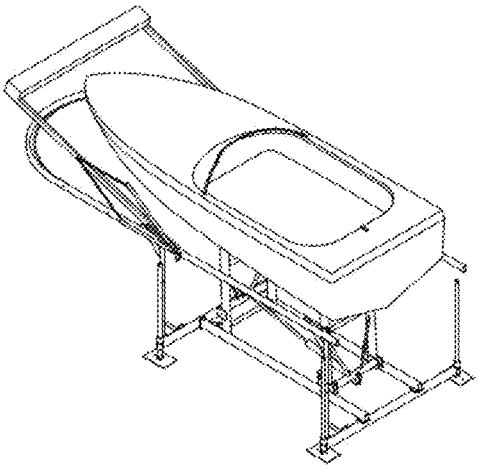
FIG. 7B

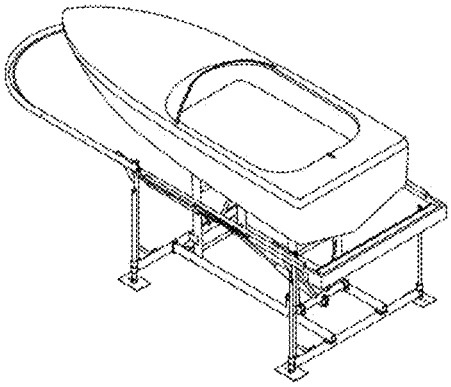
FIG. 7K
FIG. 8A
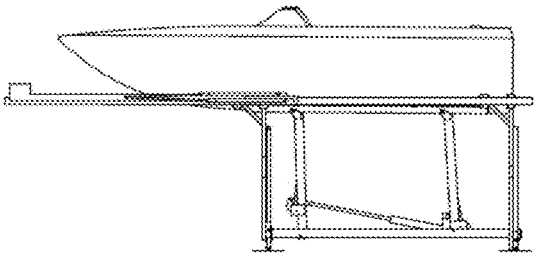
FIG. 8B
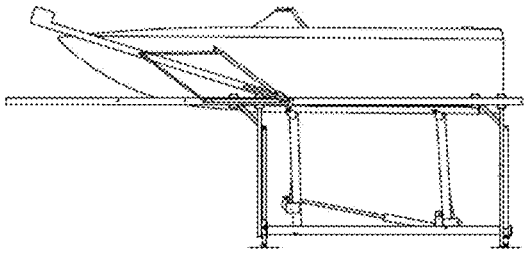
FIG. 8C
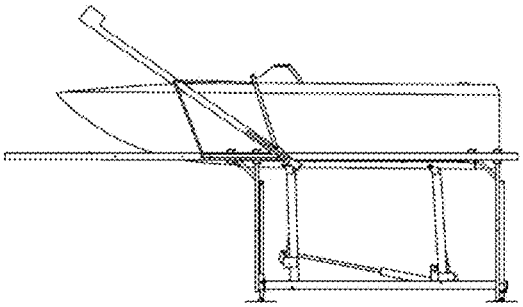

FIG. 14P
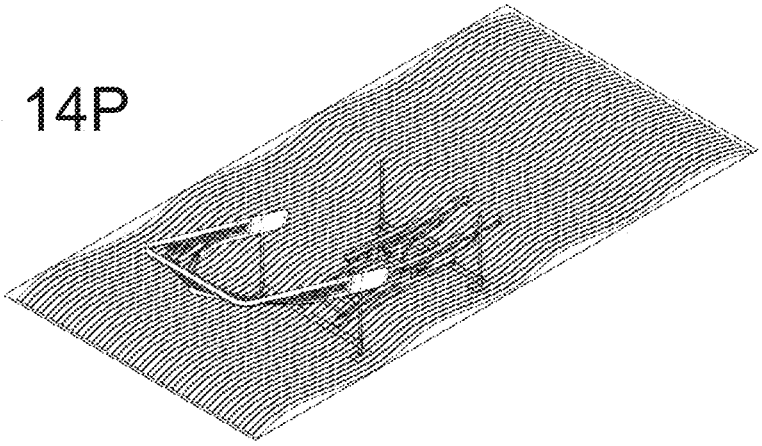
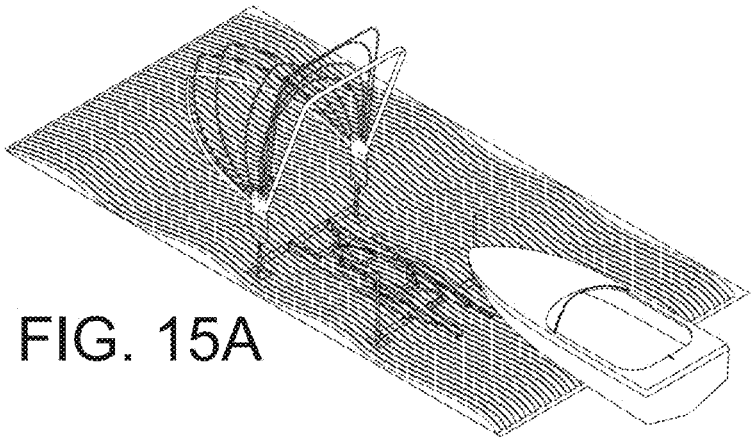
FIG. 15A
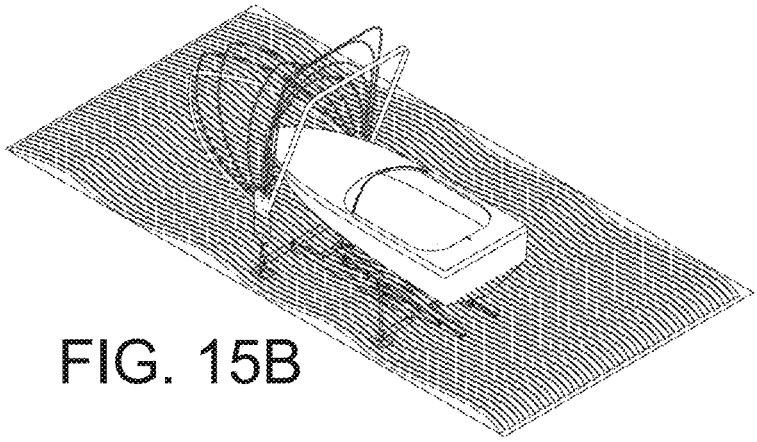
FIG. 15B

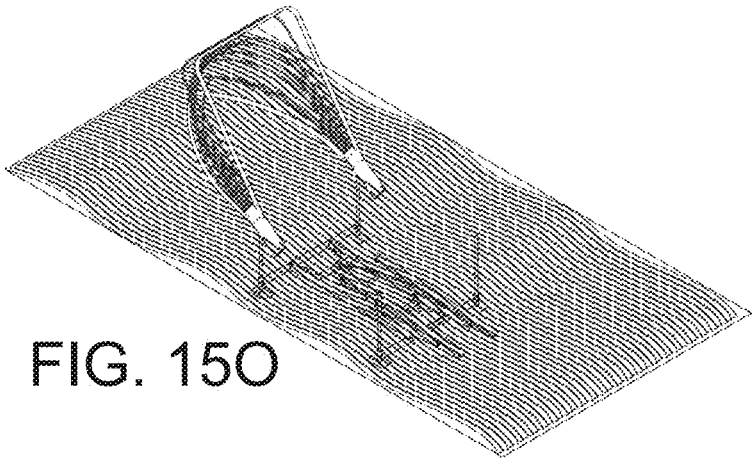
FIG. 15O
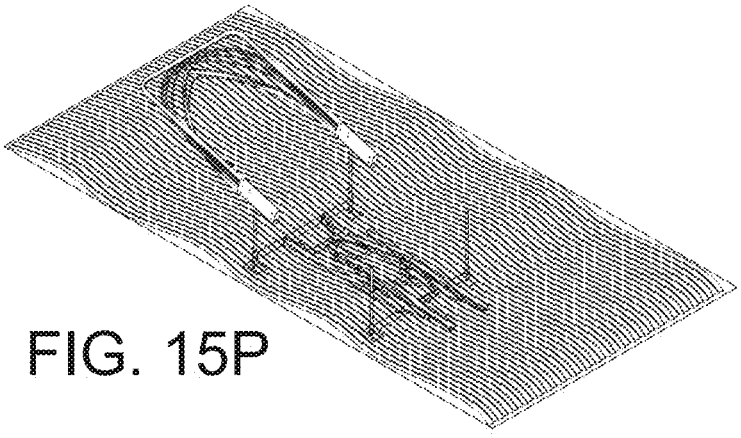
FIG. 15P
FIG. 16A
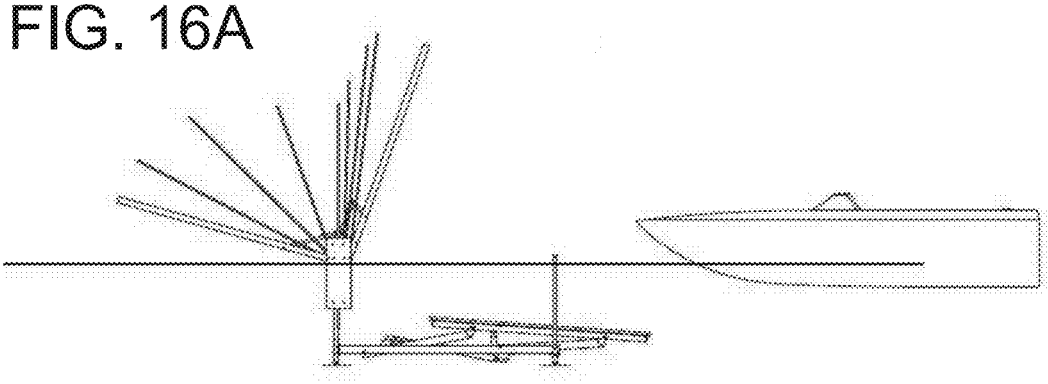

FIG. 18I
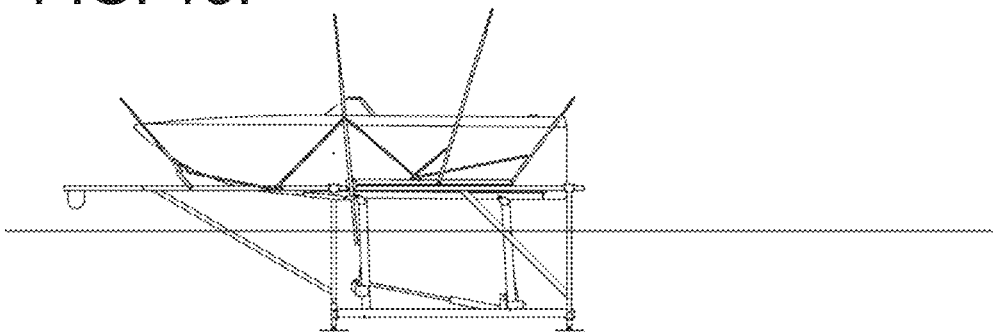
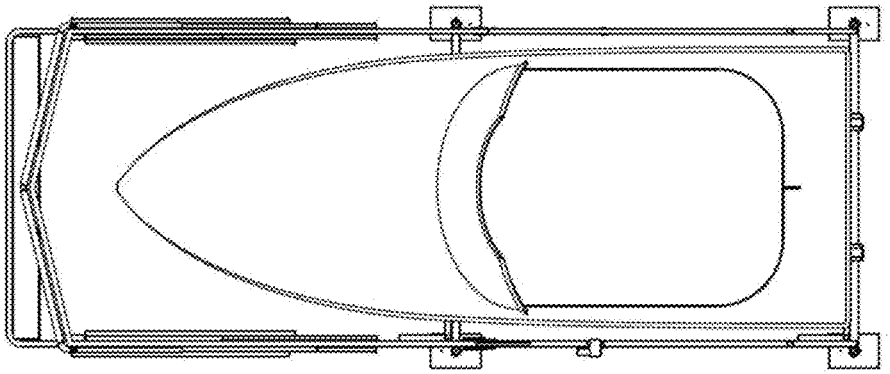
FIG. 19A
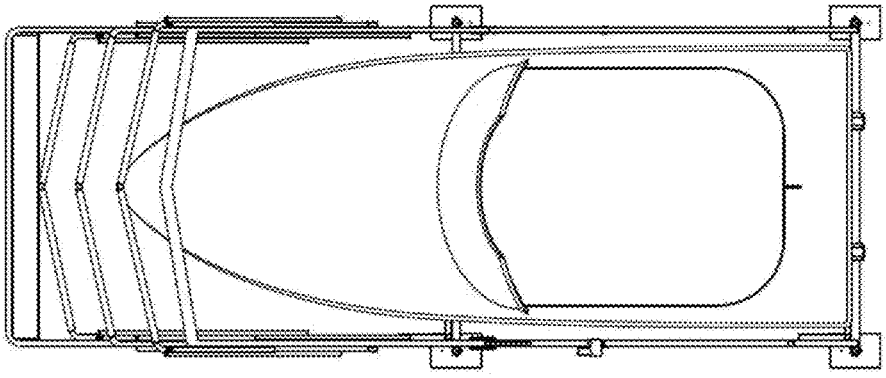
FIG. 19B

FIG. 20A
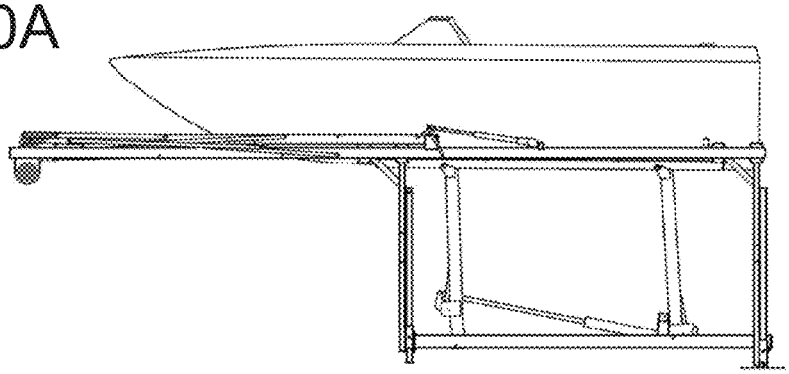
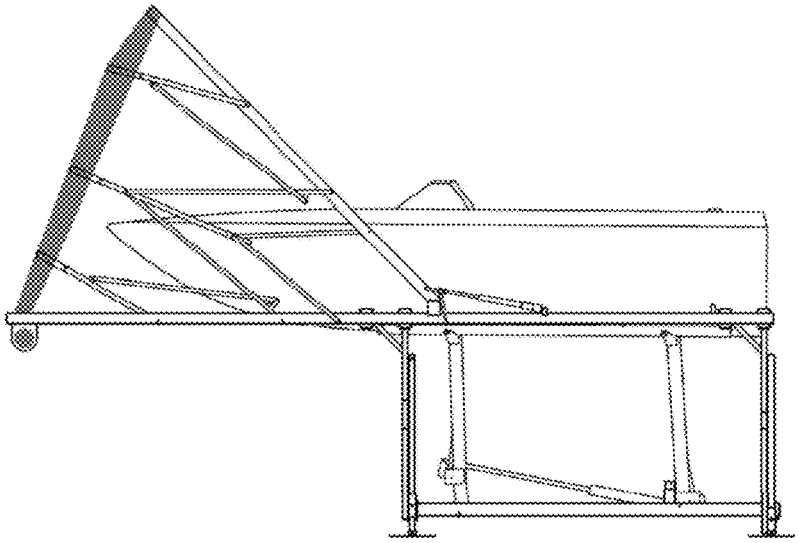
FIG. 20B
FIG. 20C
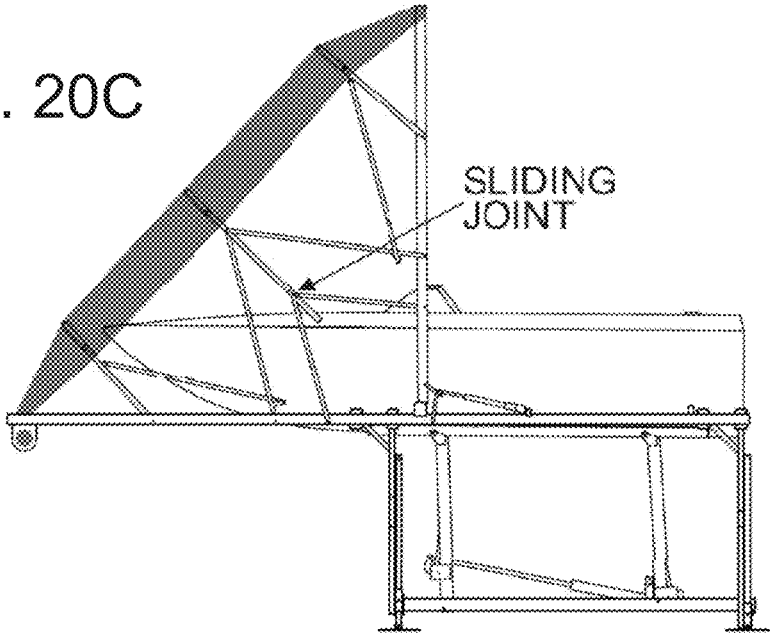

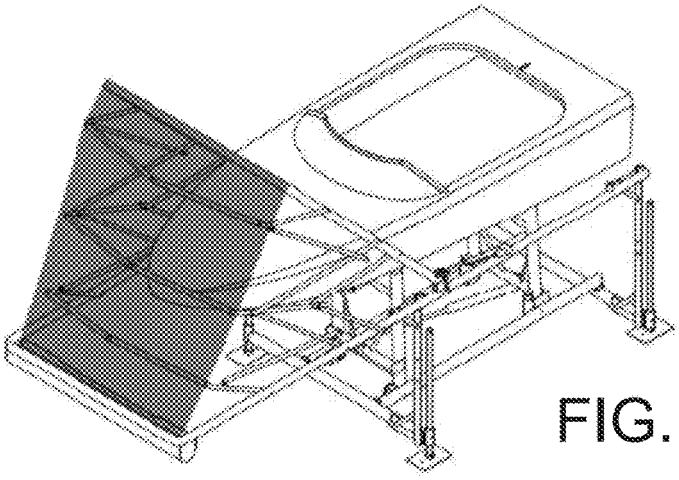
FIG. 21B
FIG. 21C
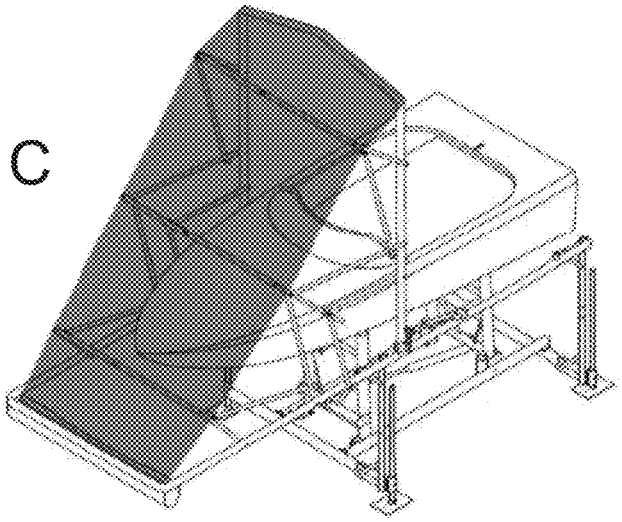
FIG. 21D
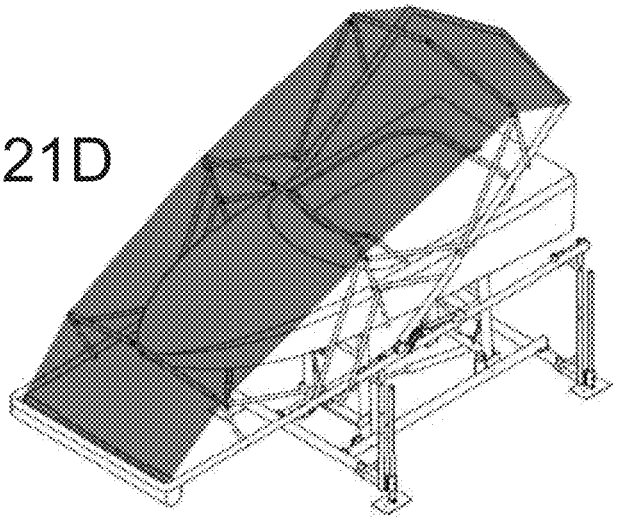

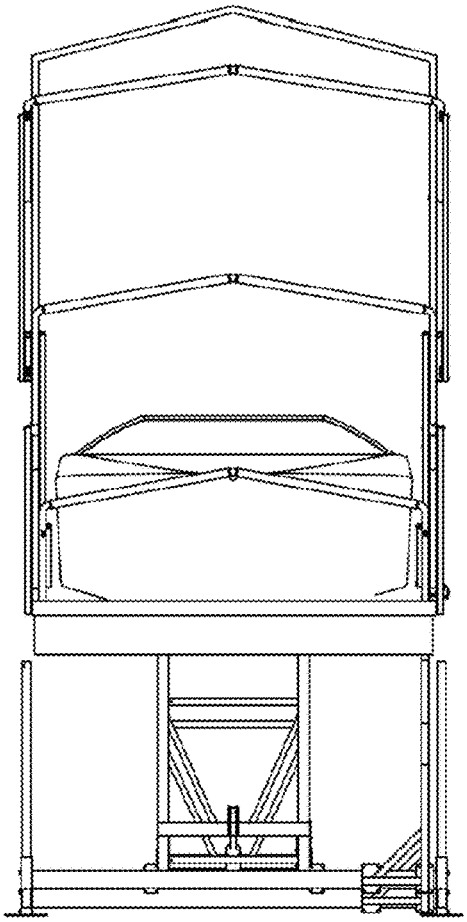
FIG. 22C
FIG. 22D
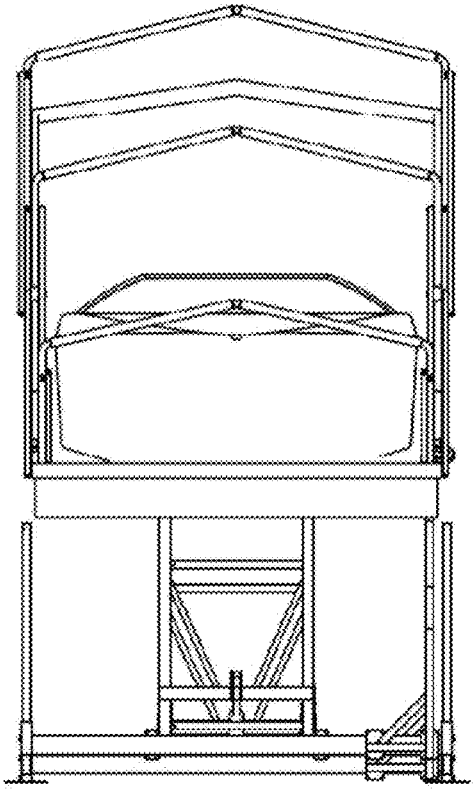
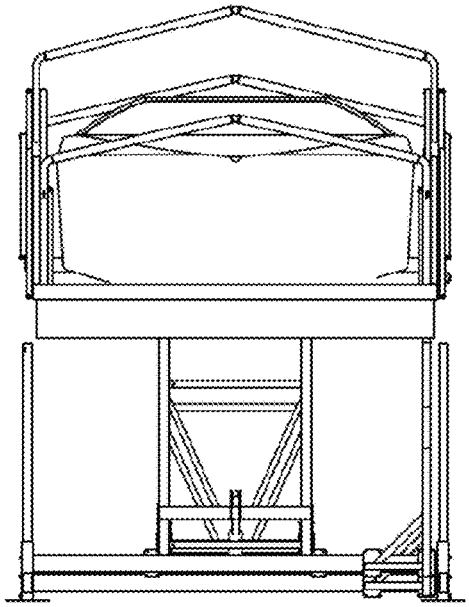
FIG. 22E

RETRACTABLE CANOPY FOR BOATS

CROSS-REFERENCE TO RELATED APPLICATIONS

This application is a continuation of U.S. patent application Ser. No. 16/289,136, filed Feb. 28, 2019.

U.S. patent application Ser. No. 16/289,136 is a continuation of U.S. patent application Ser. No. 16/180,405 filed Nov. 5, 2018.

U.S. patent application Ser. No. 16/180,405 is a continuation of U.S. patent application Ser. No. 16/120,656 filed Sep. 4, 2018.

This application is a continuation of U.S. patent application Ser. No. 16/120,656 filed Sep. 4, 2018.

U.S. patent application Ser. No. 16/120,656 is a continuation of U.S. patent application Ser. No. 15/941,961 filed Mar. 30, 2018.

U.S. patent application Ser. No. 15/941,961 is a continuation of U.S. patent application Ser. No. 15/252,140 filed Aug. 30, 2016.

U.S. patent application Ser. No. 15/252,140 claims benefit of U.S. Provisional Application Ser. No. 62/217,247 filed Sep. 11, 2015.

U.S. patent application Ser. No. 15/252,140 also claims benefit of U.S. Provisional Application Ser. No. 62/281,661 filed Jan. 21, 2016.

U.S. patent application Ser. No. 15/252,140 also claims benefit of U.S. Provisional Application Ser. No. 62/288,331 filed Jan. 28, 2016.

The contents of all related applications are incorporated herein by reference.

BACKGROUND

Technical Field

The present disclosure pertains to deployable coverings for objects and, more particularly, to canopy devices, systems, and methods, that enable selectable degrees of deployment and provide a fully folded configuration useful with vehicles and in connection with boat lifts.

Description of the Related Art

Canopies for objects, such as vehicles, are known. Typical canopies include a frame and a cover to provide a protected space under which to store an object or park a vehicle. The canopy frame typically extends vertically and horizontally to span an area such that when an object is placed under the canopy, the cover provides protection for the object from the sun, rain, or snow, among other environmental conditions. However, fixed or permanent canopies suffer from a number of drawbacks or disadvantages.

For example, the permanent shade created by fixed canopies is frowned upon in many jurisdictions because of the negative impact to surrounding ecosystems. Further, permanent canopies are not aesthetically pleasing and are typically viewed negatively by homeowners or neighbors. These problems are exacerbated when fixed canopies block waterfront views, or other scenic landscape views. Moreover, designing canopy covers and frames to handle snow and wind loads requires use of expensive and bulky parts, which increases cost for the consumer. Because fixed canopies are suspended above an area, most fixed canopies also do not provide adequate protection against environmental conditions impinging on the object or vehicle underneath the canopy from different angles, such as from the side. Such canopies are also not adjustable, meaning that the area covered by the canopy is fixed based on the size and arrangement of the frame, which limits use applications.

Some of the above issues are alleviated with removable canopy covers, but such canopy covers are typically formed from heavy material and are burdensome or cumbersome for the owner to manipulate on and off of the frame. Other solutions include covers that extend laterally toward the support surface to provide protection to the sides of an object under the canopy, but such solutions do not address the environmental or aesthetic concerns mentioned above and are also not adjustable. As such, current canopies suffer from a number of disadvantages, as do available proposed solutions.

BRIEF SUMMARY

A first implementation of a retractable canopy for a watercraft lift may be summarized as including: a fixed boom extending from the watercraft lift; a movable boom supported for rotational movement by the watercraft lift; an actuator operatively connected to the watercraft lift and the movable boom to rotate the movable boom between first and second positions relative to the watercraft lift, wherein the movable boom is spaced from the fixed boom when in the first position and is adjacent to the fixed boom when in the second position; at least one first linkage extending between the fixed boom and the movable boom; at least one second linkage extending between the fixed boom and the movable boom; at least one first strut rotatably supported by the at least one first linkage and slidably supported by the at least one second linkage; at least one second strut supported by the fixed boom; at least one third strut supported by the movable boom; and a cover secured at a first end to the fixed boom and at a second end to the movable boom; whereby when the movable boom is in the first position, the fixed boom, the movable boom, the at least one first strut, the at least one second strut, and the at least one third strut support the cover in an extended configuration above a watercraft area; and when the movable boom is in the second position, the fixed boom, the movable boom, the at least one first strut, the at least one second strut, and the at least one third strut support the cover in a retracted configuration adjacent to the fixed strut.

BRIEF DESCRIPTION OF THE SEVERAL VIEWS OF THE DRAWINGS

FIGS. 1A-1K are perspective views depicting a first implementation of a support structure for a retractable canopy;

FIGS. 2A-2K are side elevation views of the first implementation of the support structure of FIGS. 1A-1K;

FIGS. 3A-3K are perspective views depicting a second implementation of a support structure for a retractable canopy;

FIGS. 4A-4K are side elevation views of the second implementation of the support structure of FIGS. 3A-3K;

FIGS. 6A-6K are side elevation views of the third implementation of the support structure of FIGS. 5A-5K;

FIGS. 7A-7K are perspective views depicting a fourth implementation of a support structure for a retractable canopy;

FIGS. 8A-8K are side elevation views of the fourth implementation of the support structure of FIGS. 7A-7K;

FIGS. 18A-18I are side elevation views of the eighth implementation of the support structure for the retractable canopy of FIGS. 17A-17I;

FIGS. 19A-19E are top plan views depicting a ninth implementation of a support structure for a retractable canopy;

FIGS. 20A-20E are side elevation views of the ninth implementation of the support structure of FIGS. 19A-19E;

FIGS. 21A-21E are perspective views of the ninth implementation of the support structure of FIGS. 19A-19E;

FIGS. 22A-22E are front end elevation views of the ninth implementation of the support structure of FIGS. 19A-19E;

DETAILED DESCRIPTION

Figure 1A:
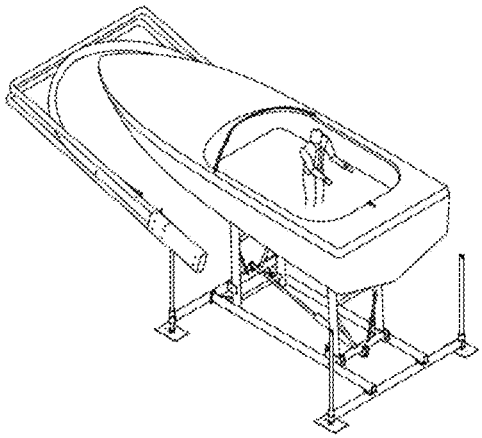
Figure 1B:
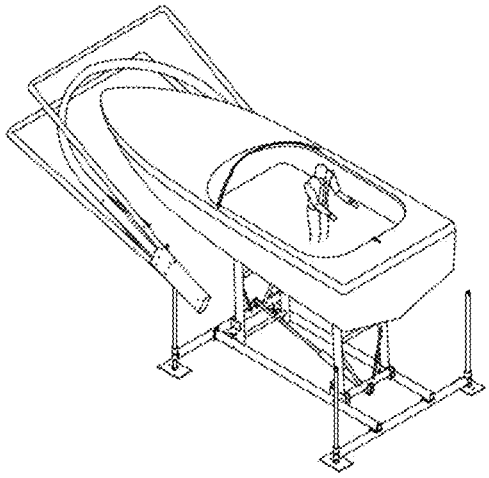
Figure 1C:
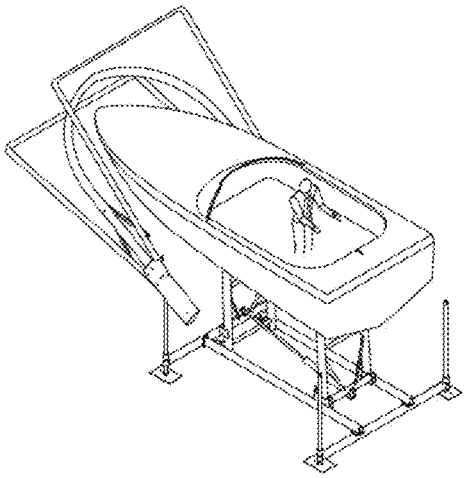
Figure 1D:
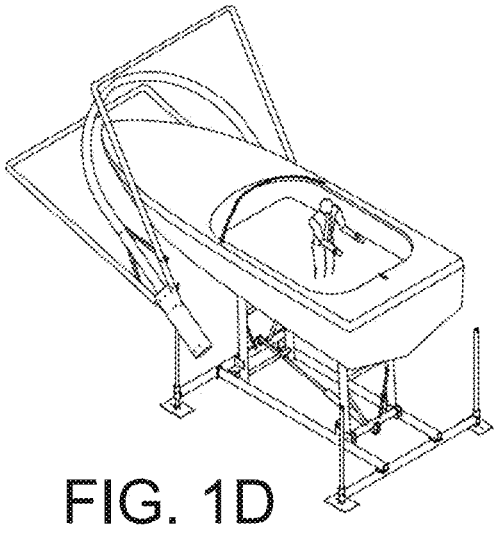
Figure 1E:
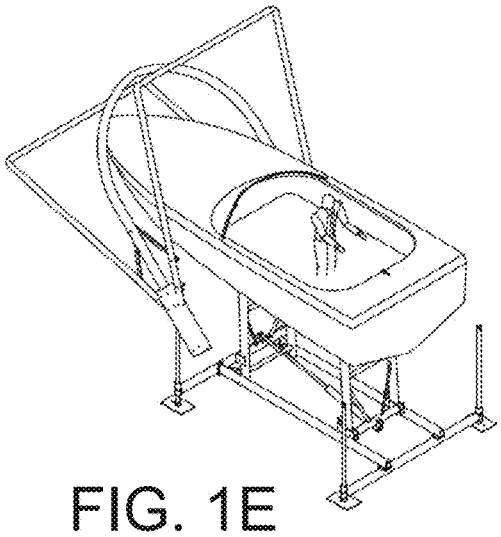
Figure 1F:
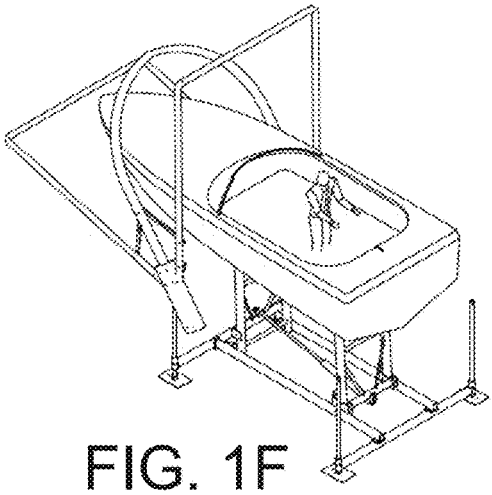
Figure 1G:
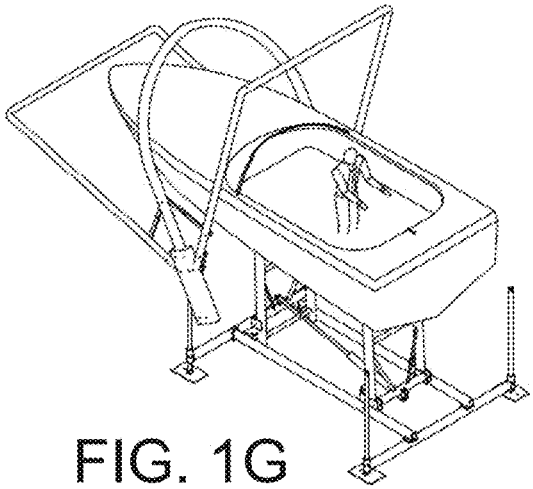
Figure 1H:
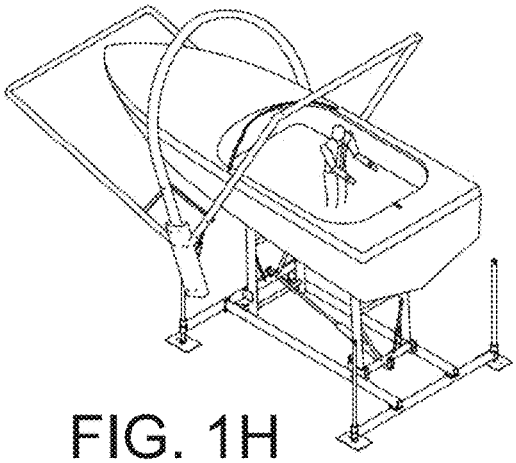
Figure 2B:
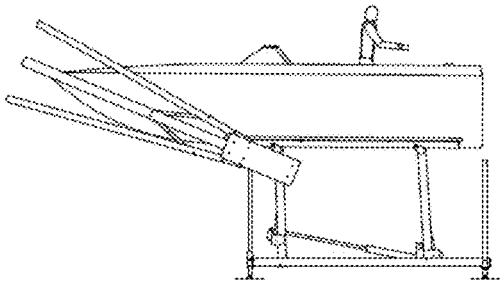
Figure 2C:
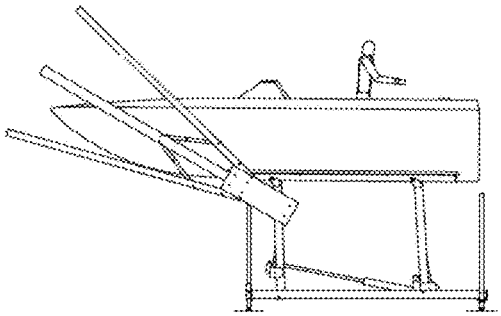
Figure 2D:
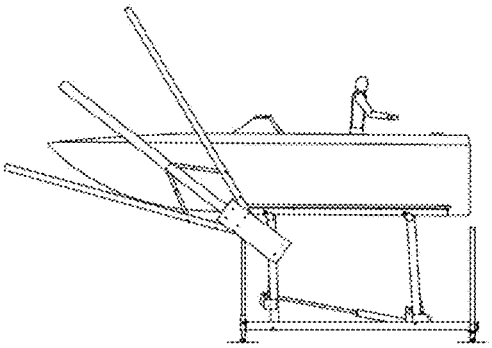
Figure 2E:
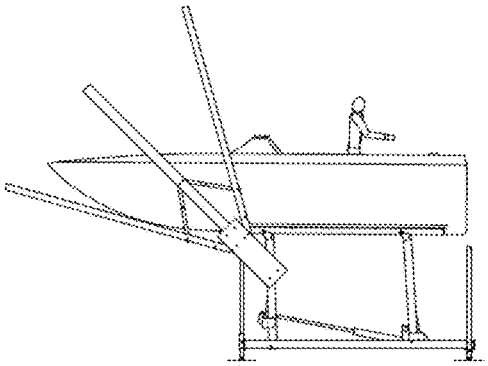
Figure 2F:
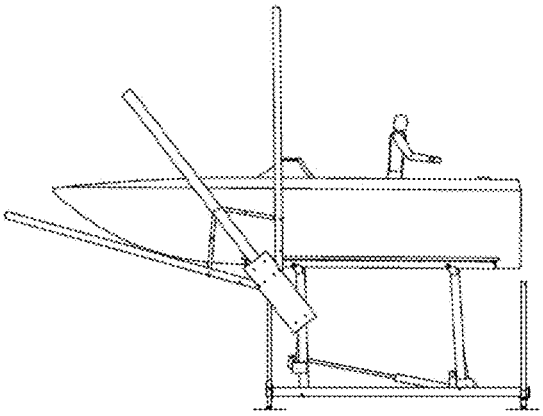
Figure 2G:
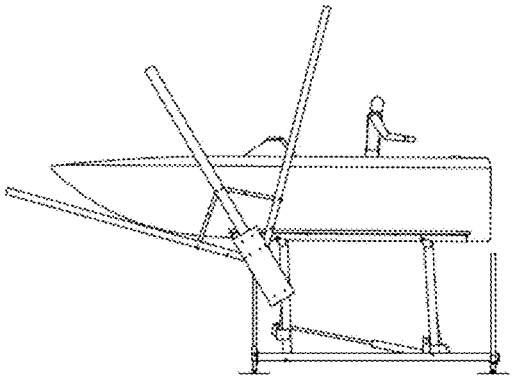
Figure 2H:
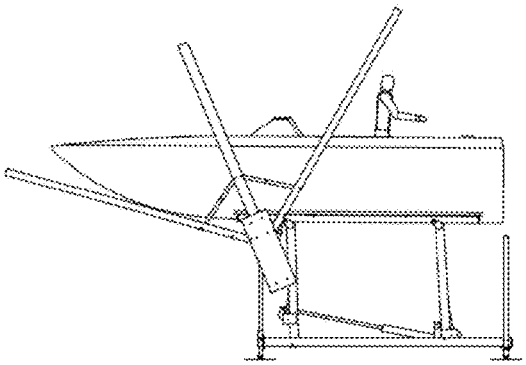
Figure 2I:
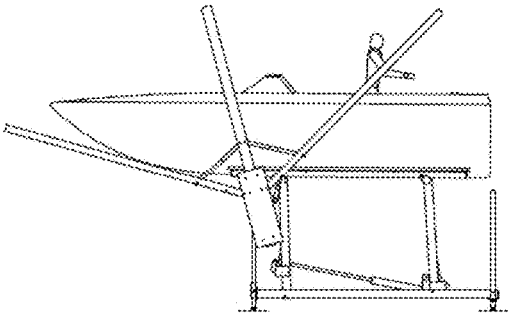
Figure 3C:
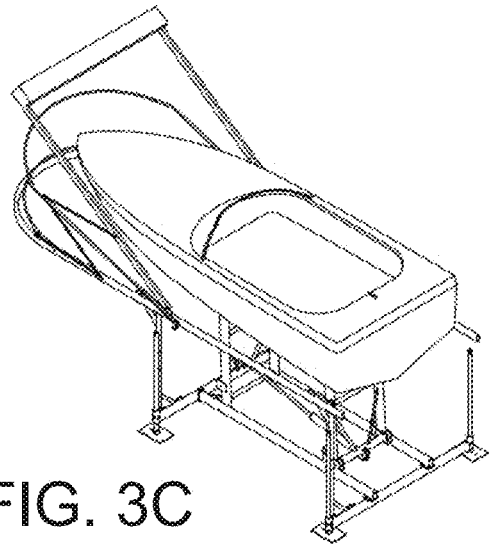
Figure 3D:
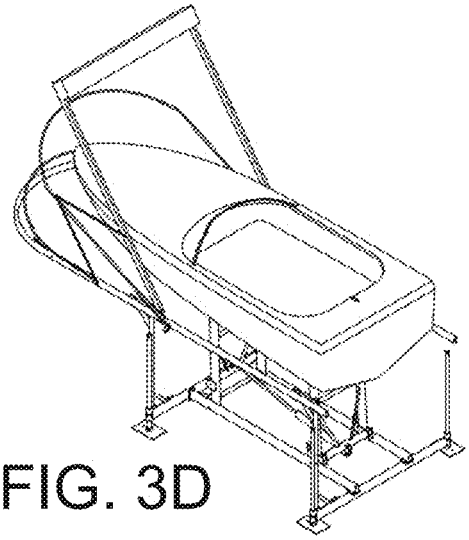
Figure 3E:
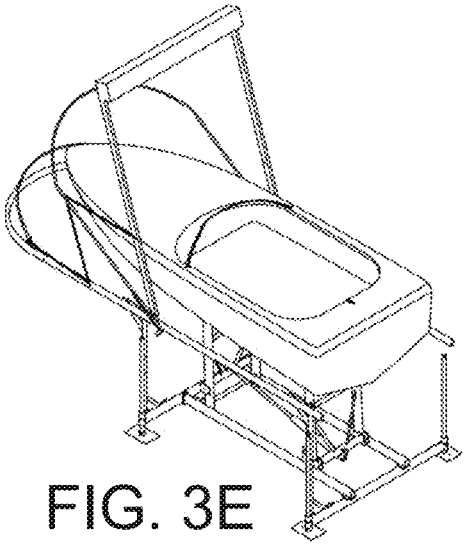
Figure 3F:
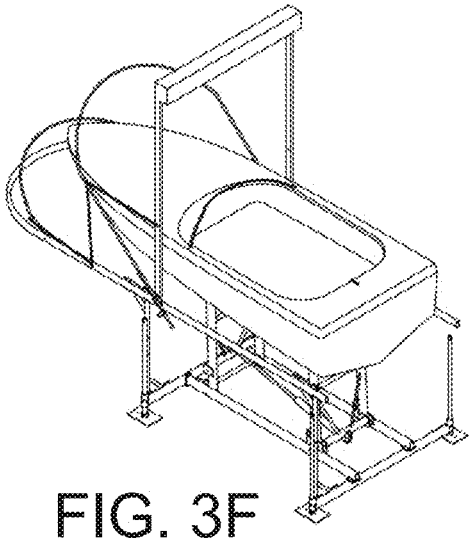
Figure 3G:
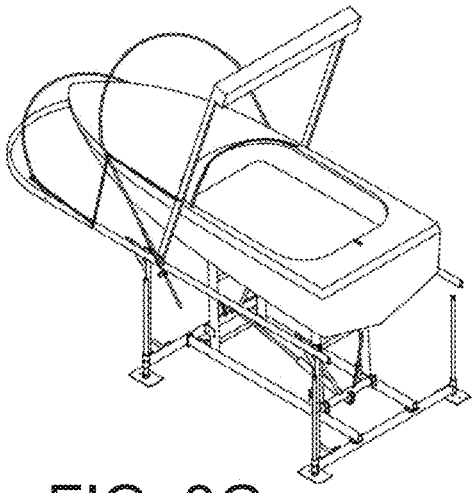
Figure 3H:
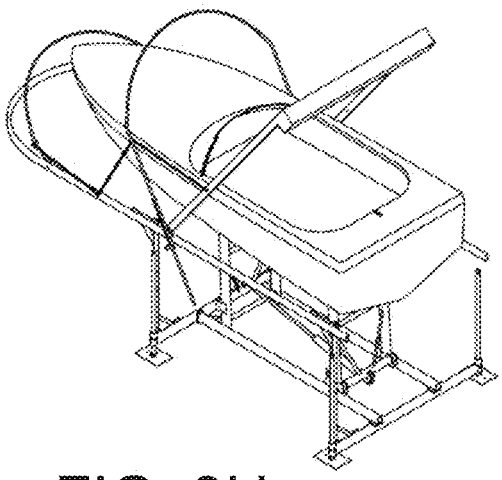
Figure 3I:
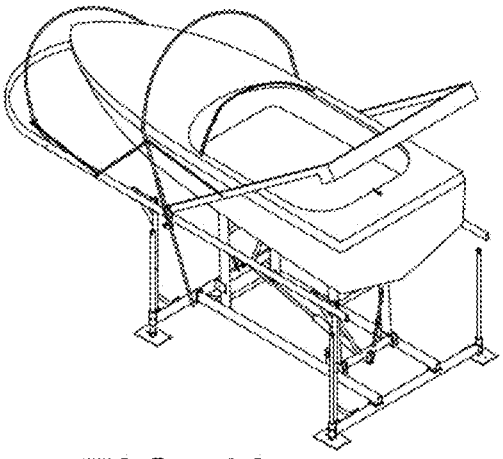
Figure 3J:
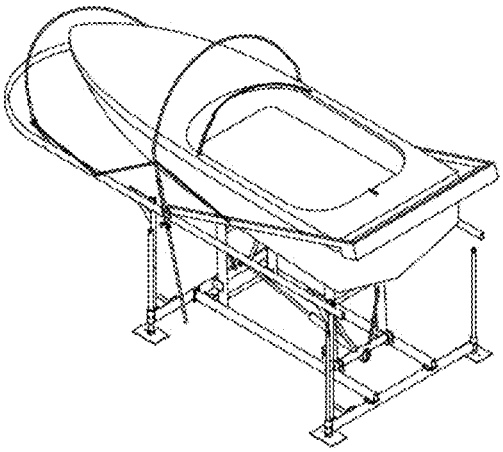
Figure 4D:
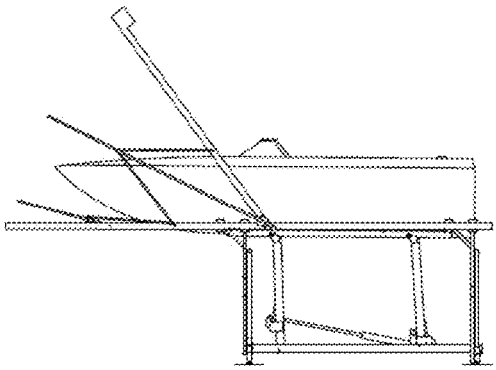
Figure 4E:
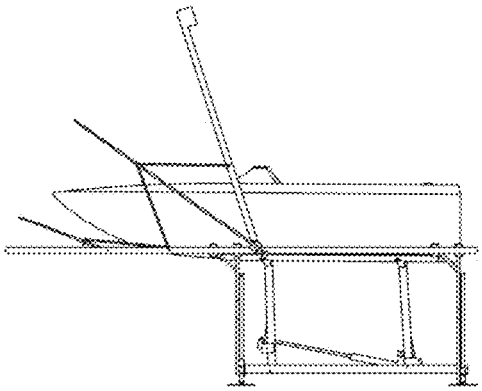
Figure 4F:
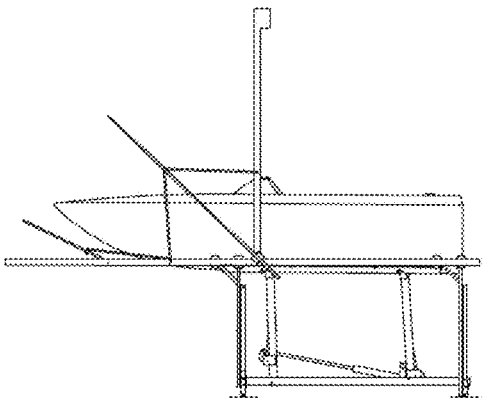
Figure 4G:
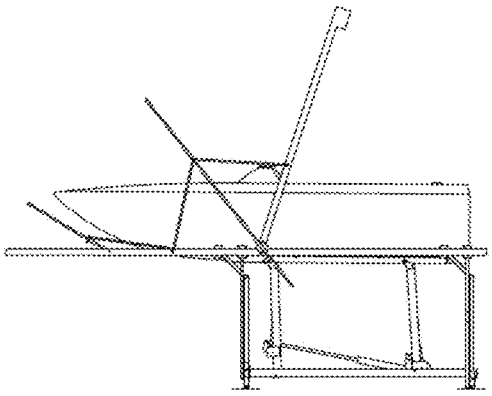
Figure 4H:
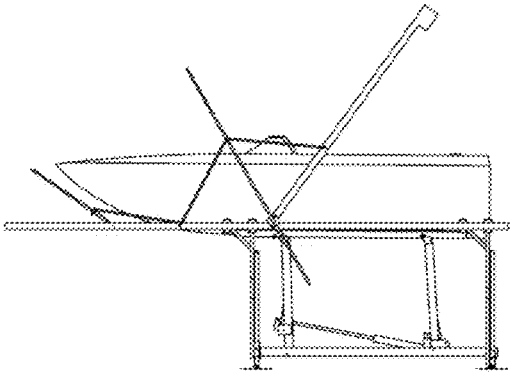
Figure 4I:
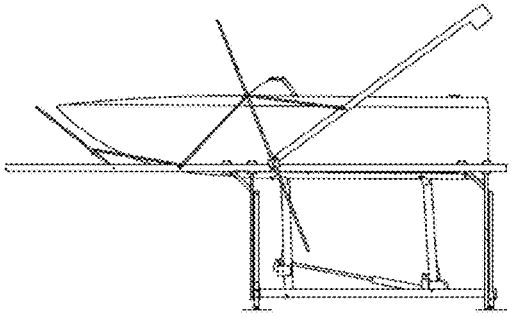
Figure 4J:
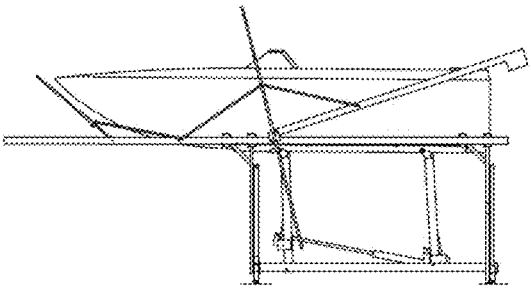
Figure 4K:
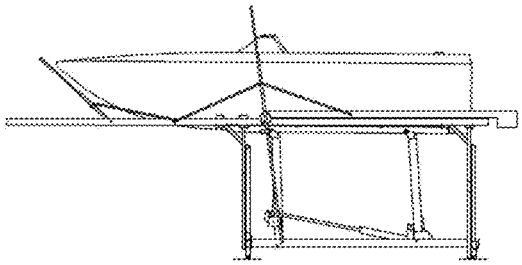
Figure 5A:
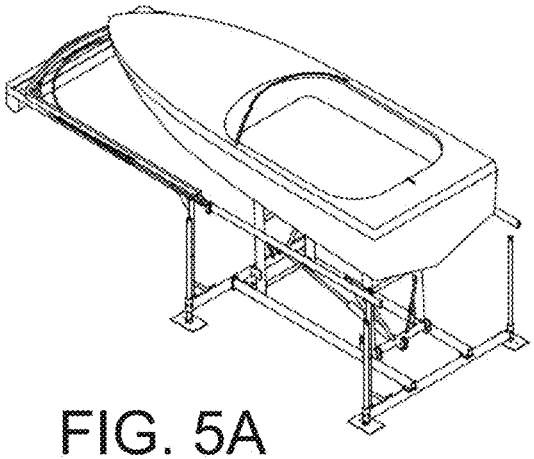
FIGS. 5A-5K are perspective views depicting a third implementation of a support structure for a retractable canopy.
Figure 5B:
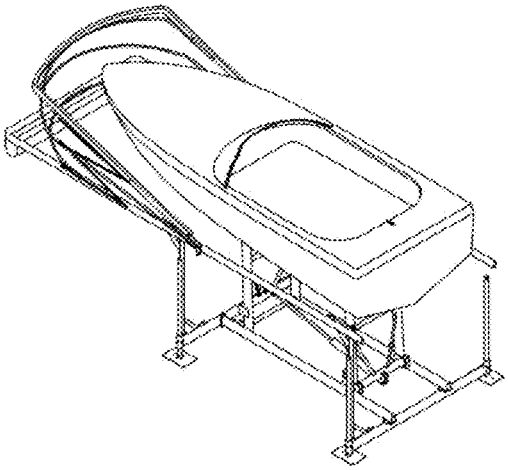
Figure 5C:
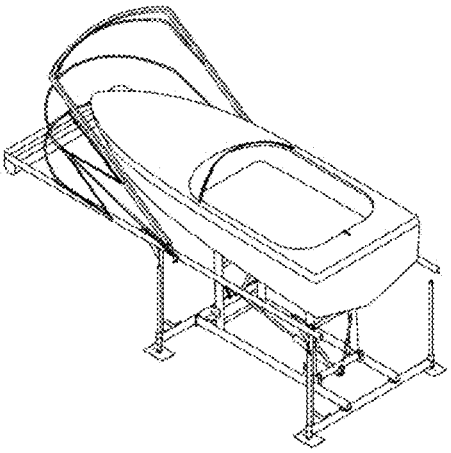
Figure 5D:
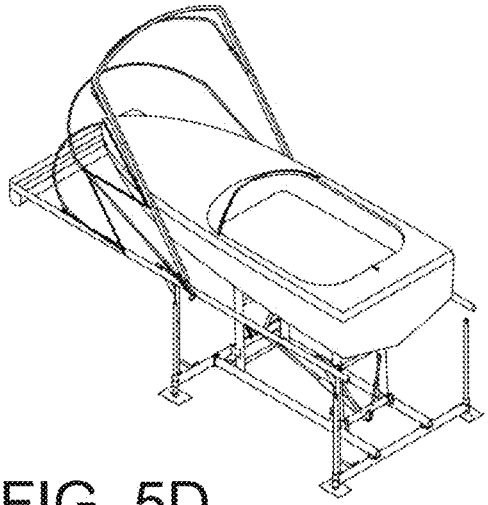
Figure 5E:
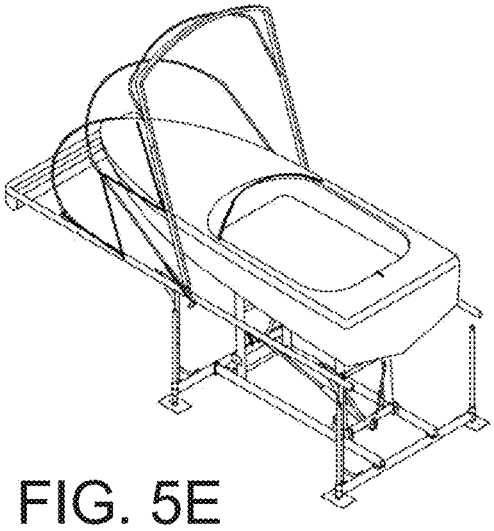
Figure 5F:
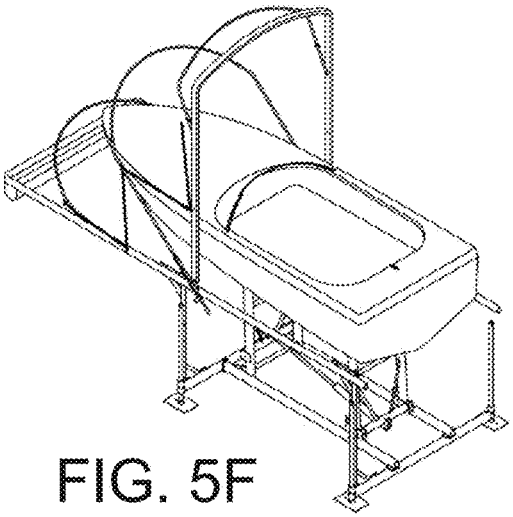
Figure 5G:
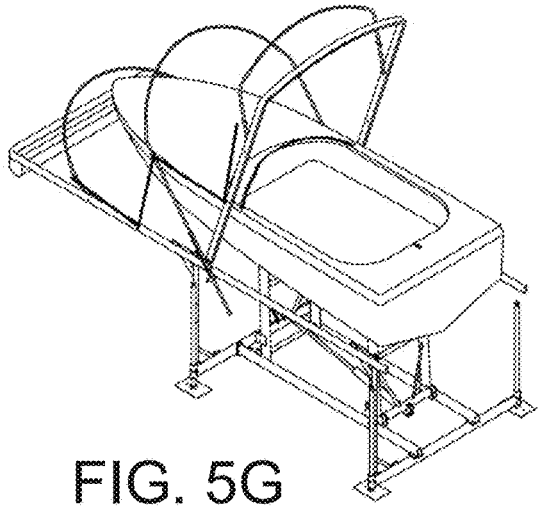
Figure 5H:
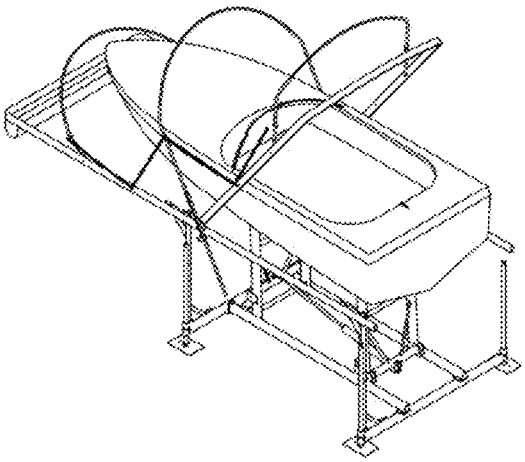
Figure 5I:
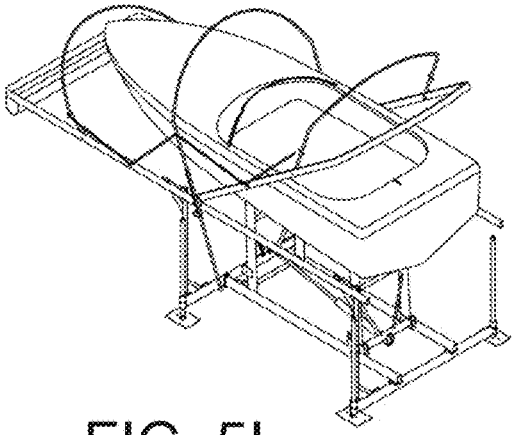
Figure 5J:
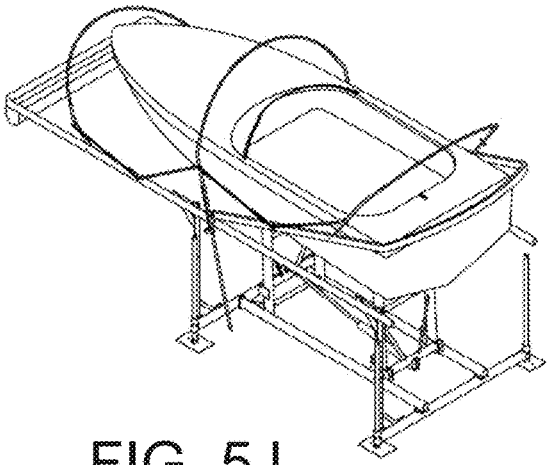
Figure 5K:
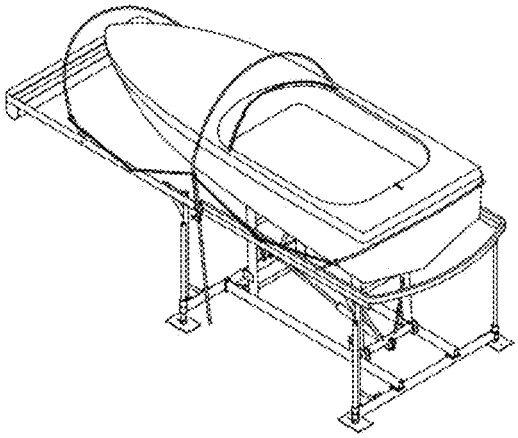
Figure 6A:
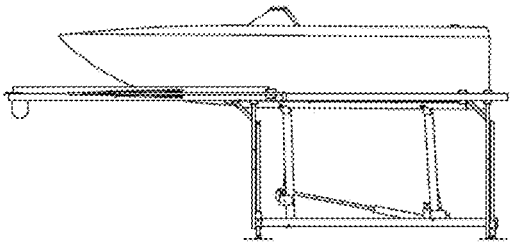
Figure 6B:
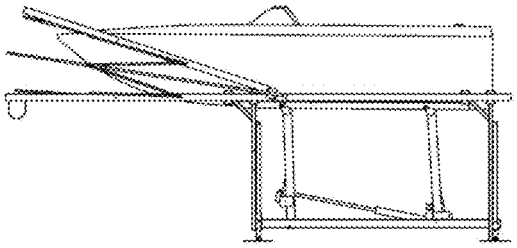
Figure 6C:
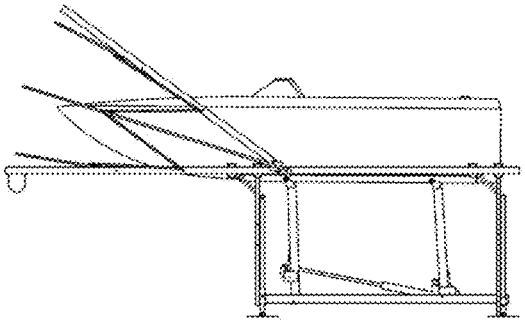
Figure 6D:
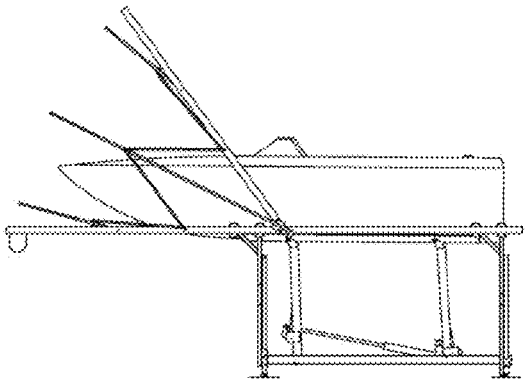
Figure 6E:
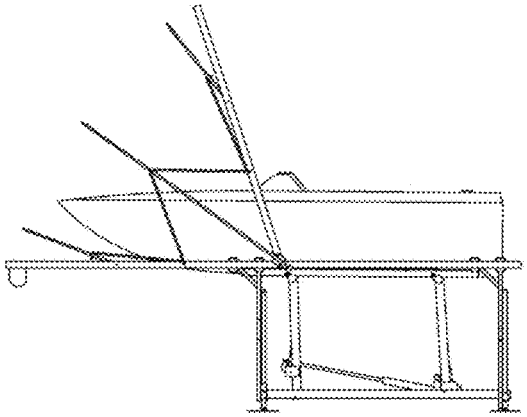
Figure 6F:
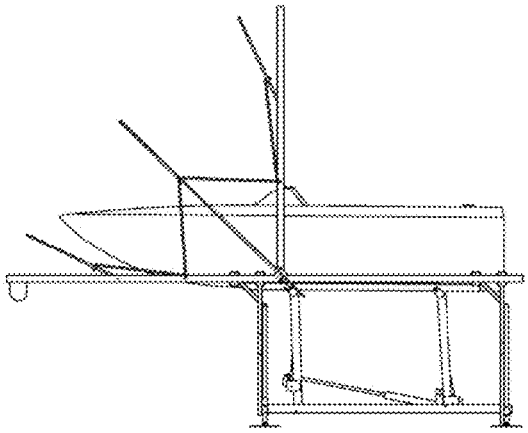
Figure 6G:
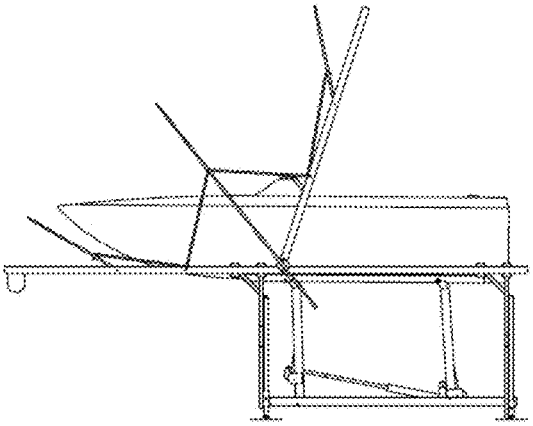
Figure 6H:
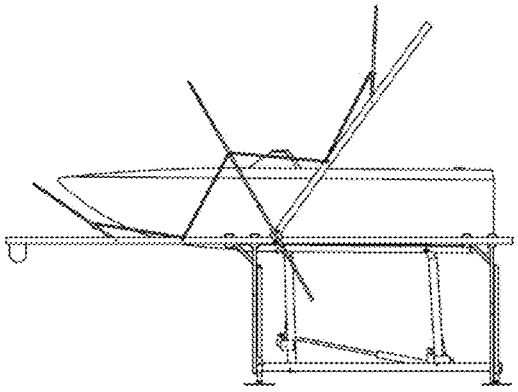
Figure 6I:
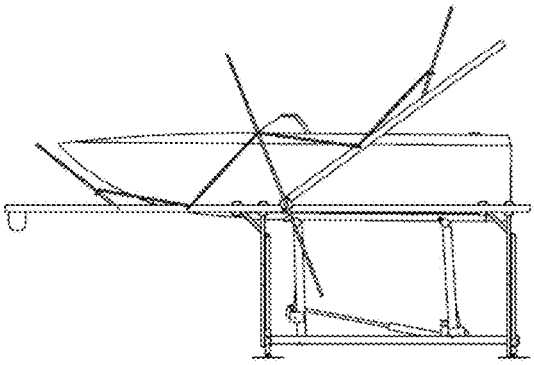
Figure 7C:
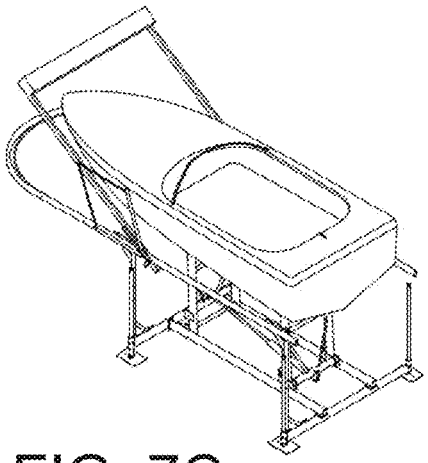
Figure 7D:
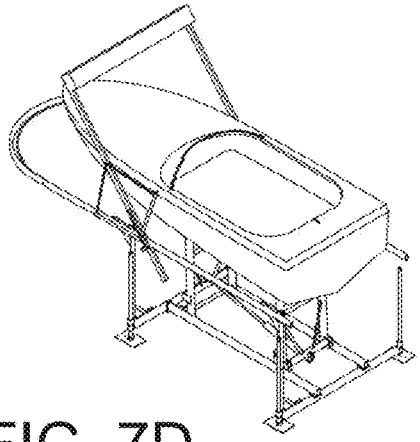
Figure 7E:
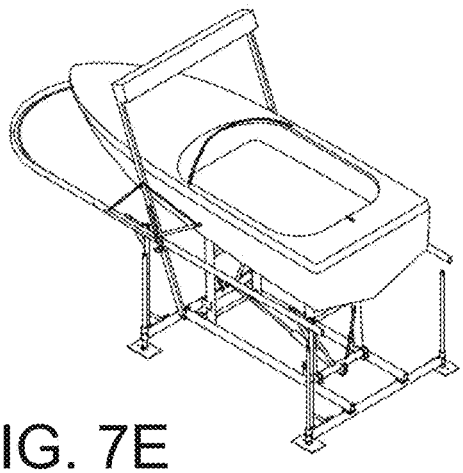
Figure 7F:
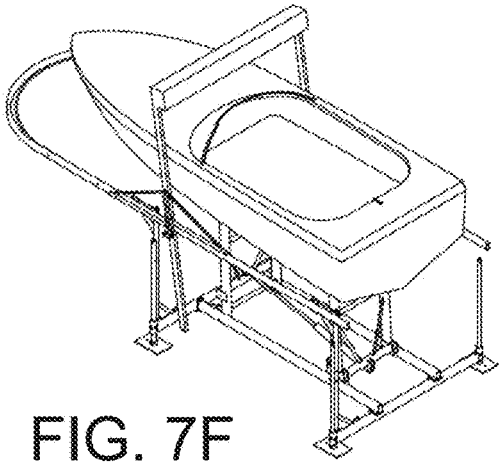
Figure 7G:
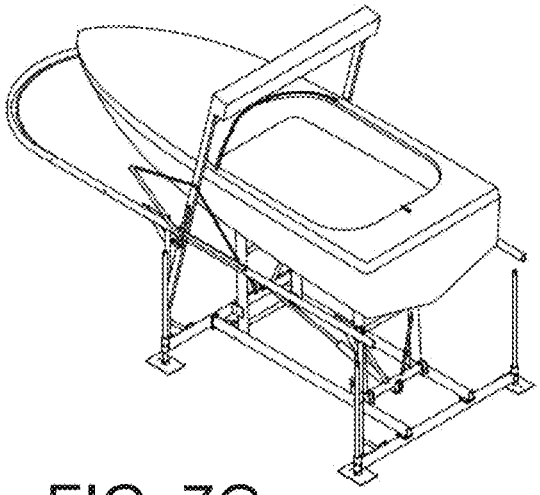
Figure 7H:
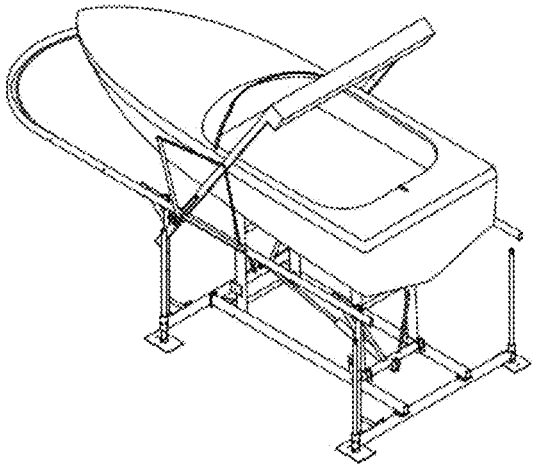
Figure 7I:
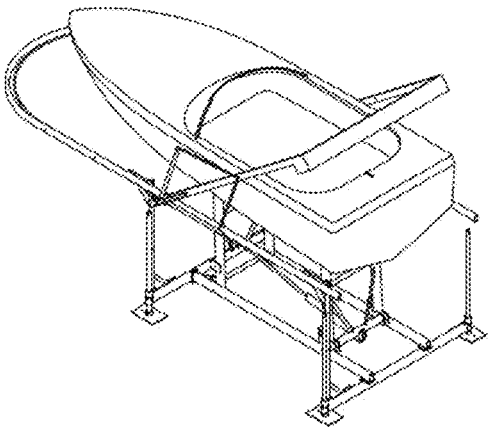
Figure 7J:
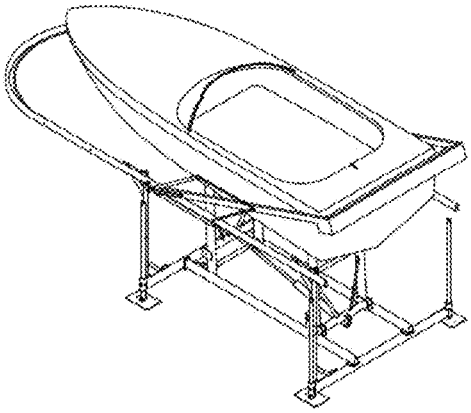
Figure 8D:
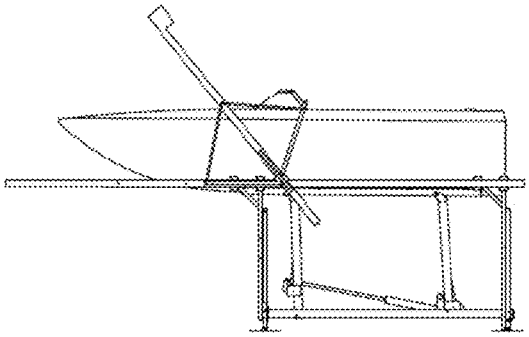
Figure 8E:
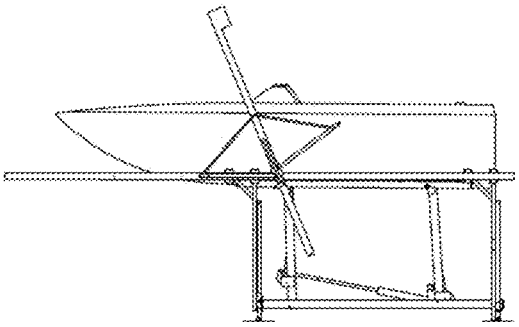
Figure 8F:
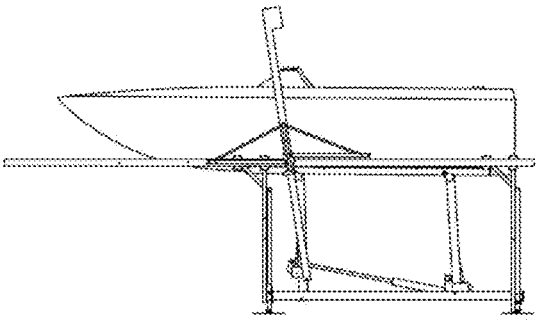
Figure 8G:
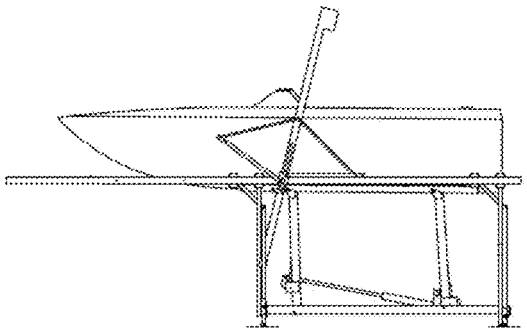
Figure 8H:
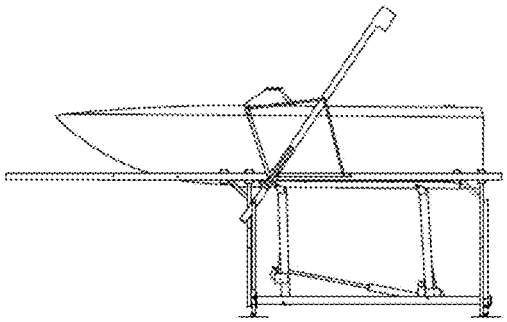
Figure 8I:
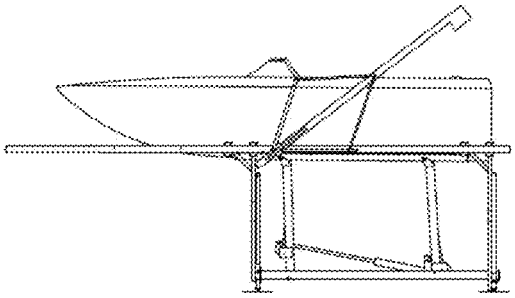
Figure 8J:
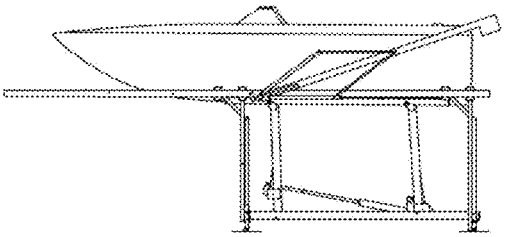
Figure 8K:
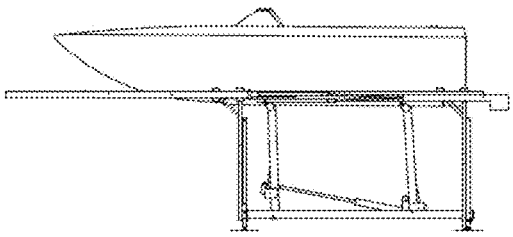
Figure 9:
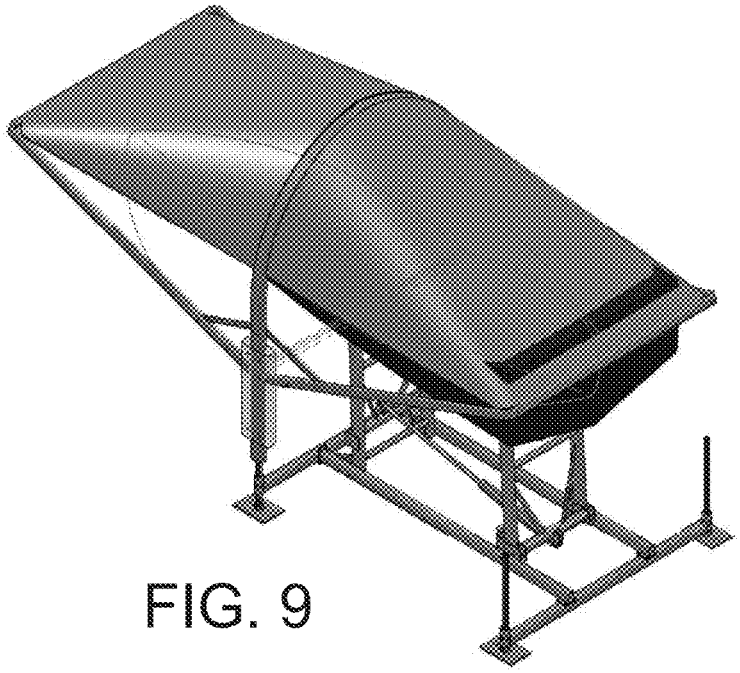
FIG. 9 is a perspective view of a fifth implementation of a support structure for a retractable canopy.
Figure 10A:
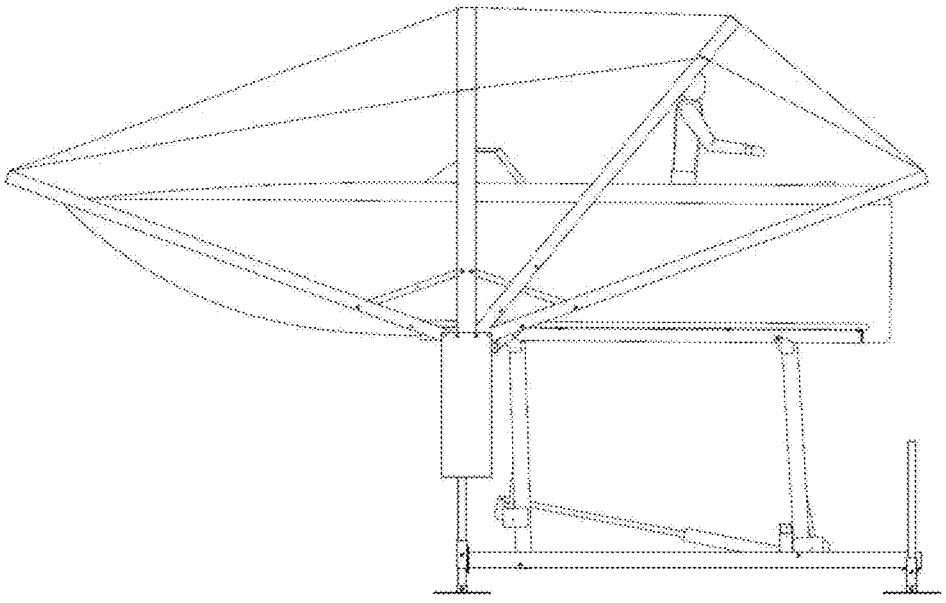
FIGS. 10A-10H are side elevation views of the fifth implementation of the support structure of FIG. 9.
Figure 10B:
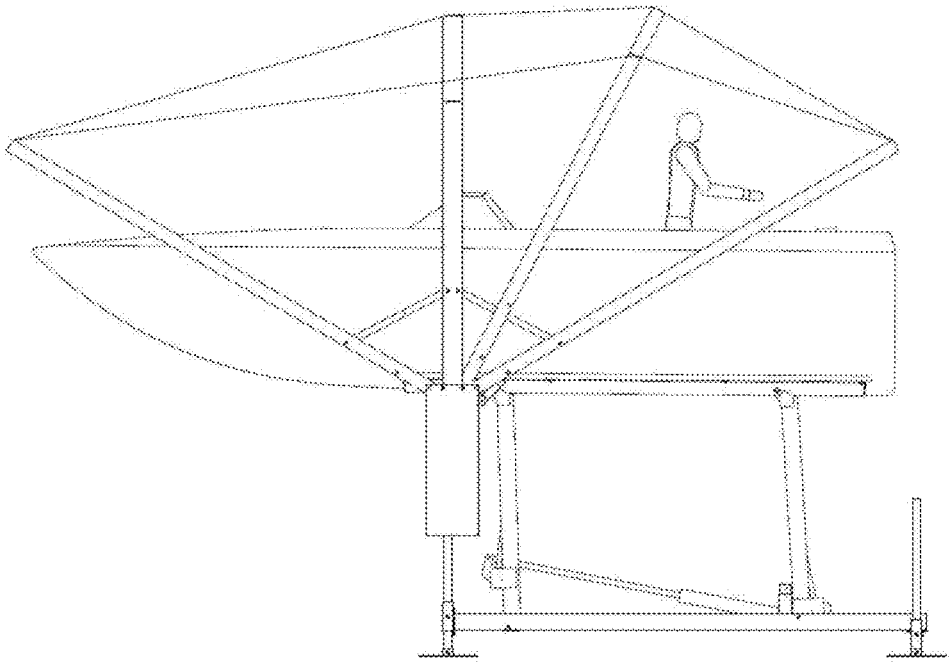
Figure 10C:
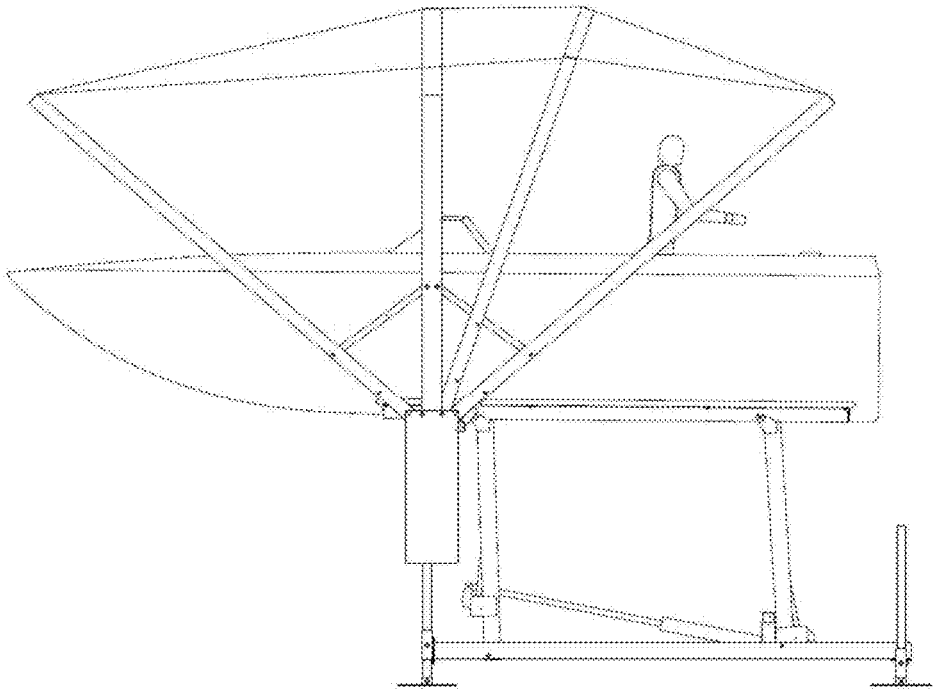
Figure 10D:
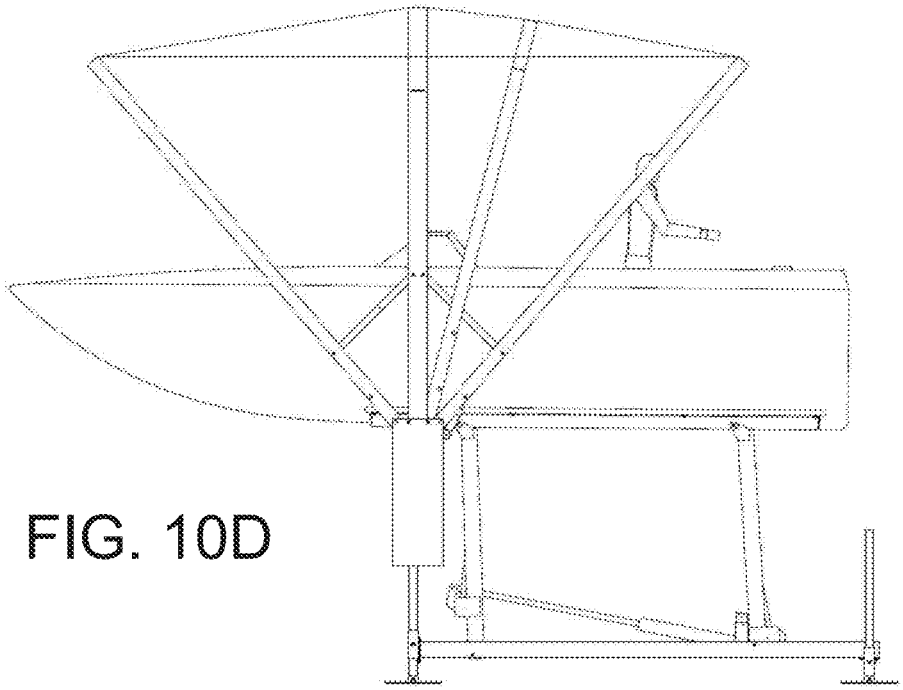
Figure 10E:
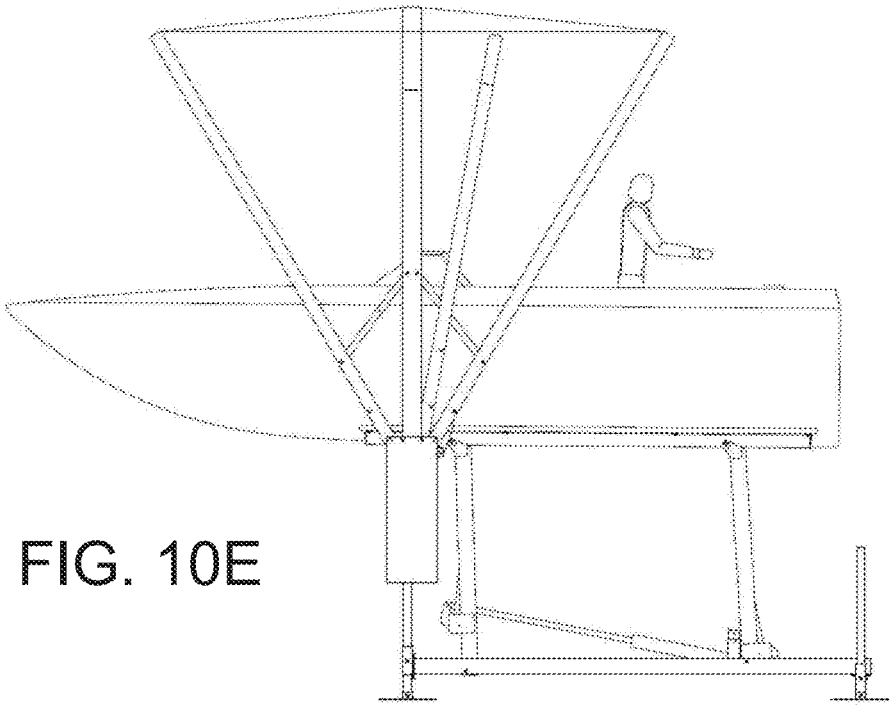
Figure 10F:
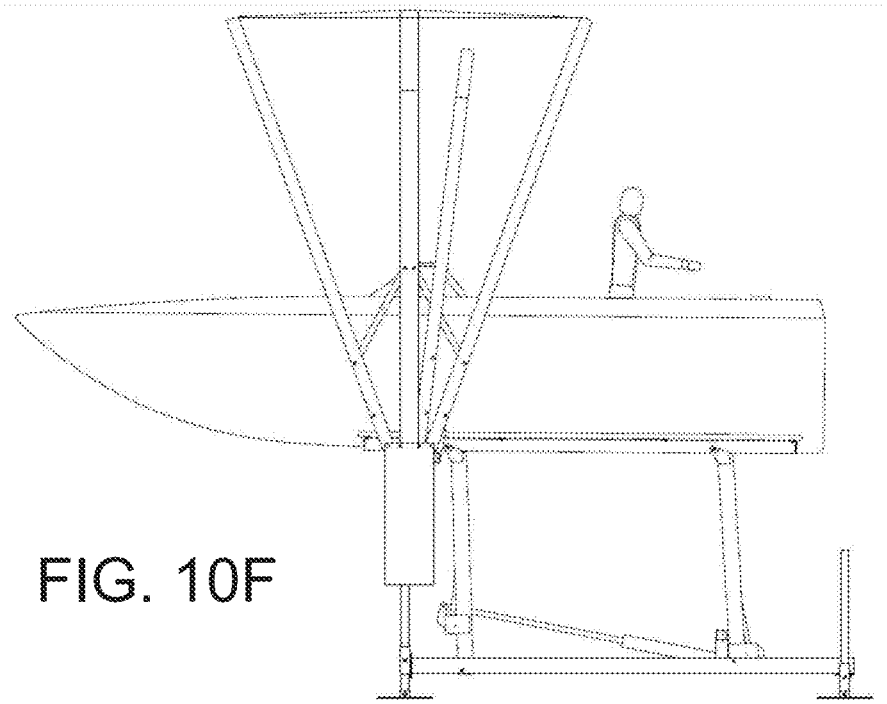
Figure 10G:
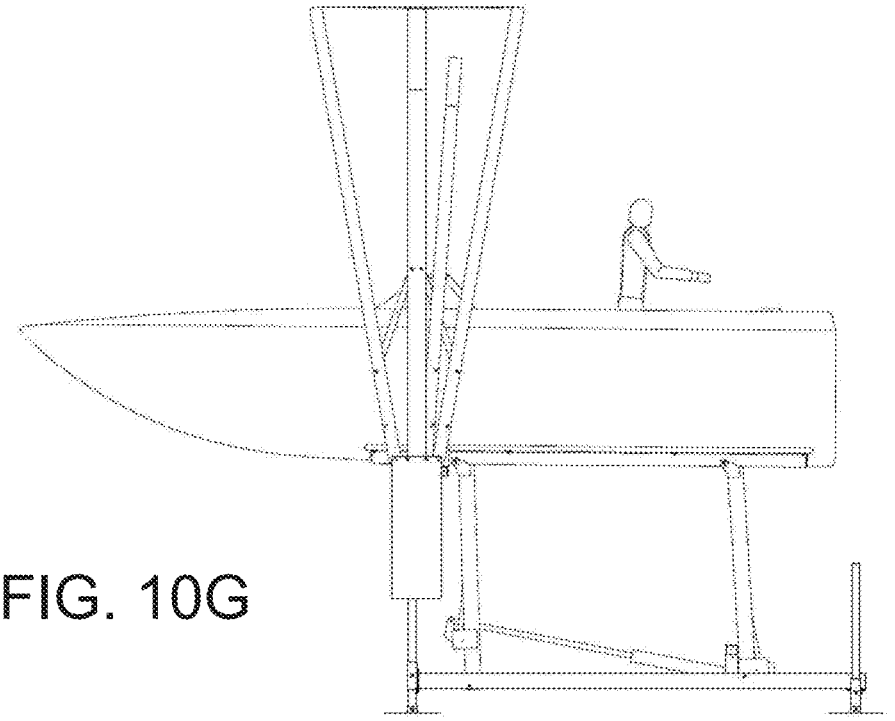
Figure 10H:
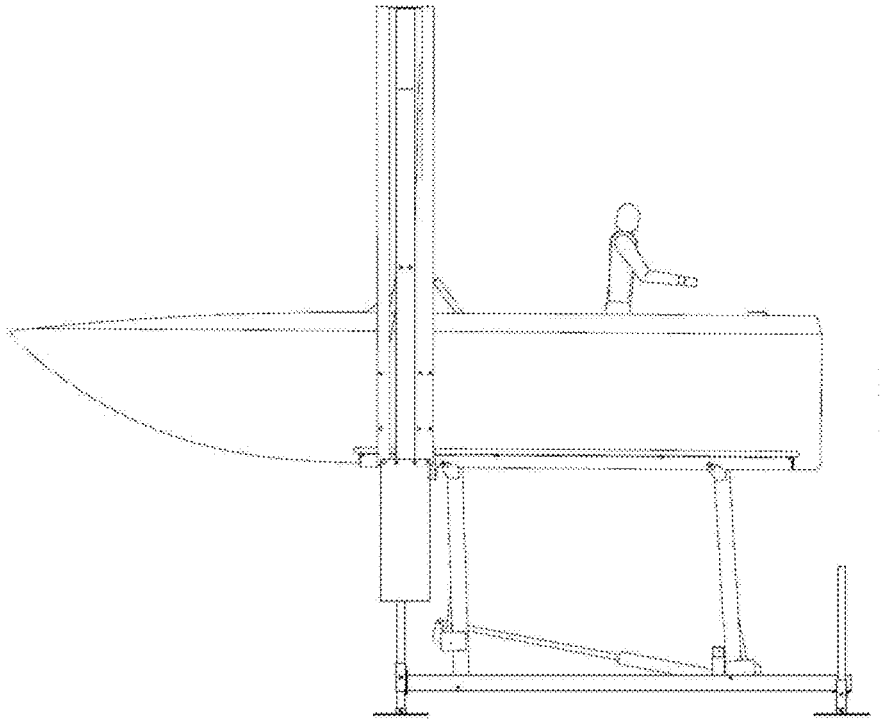
Figure 11A:
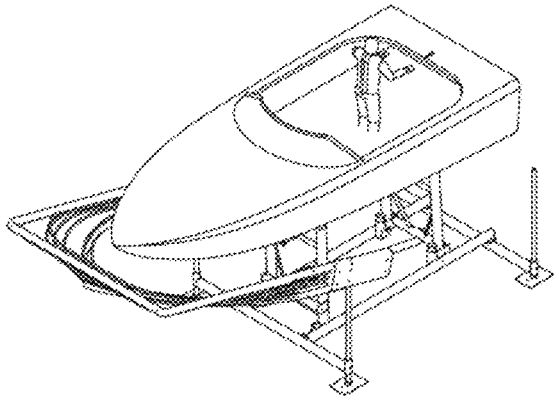
FIGS. 11A-11K are front perspective views of a sixth implementation of a support structure for a retractable canopy.
Figure 11B:
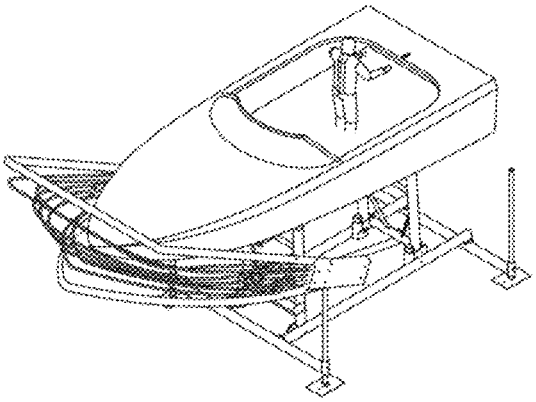
Figure 11C:
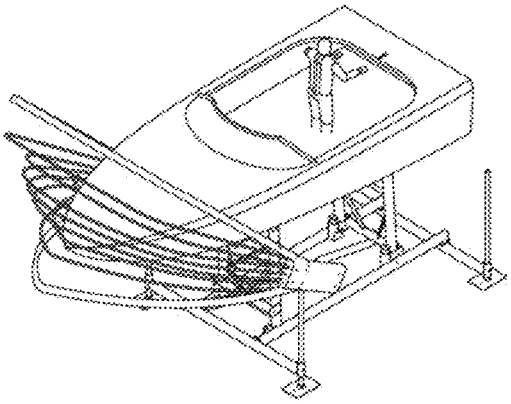
Figure 11D:
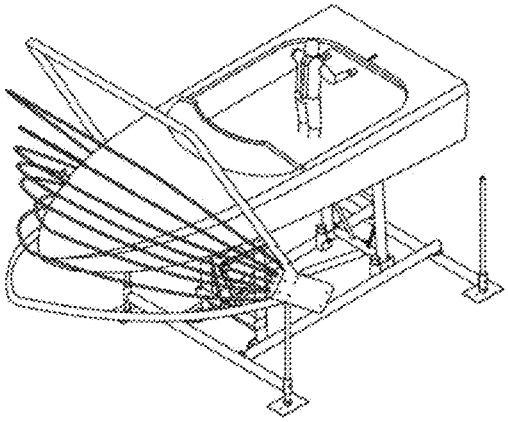
Figure 11E:
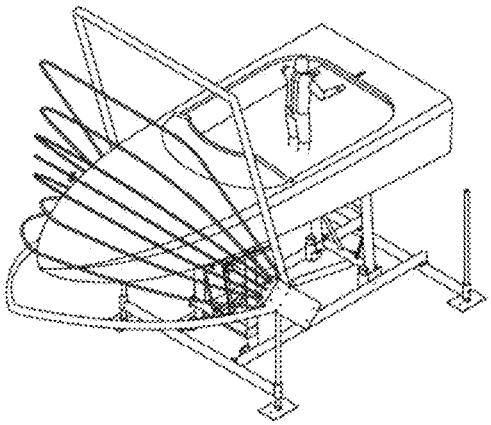
Figure 11F:
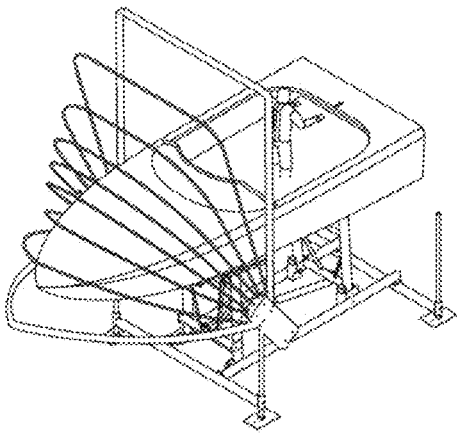
Figure 11G:
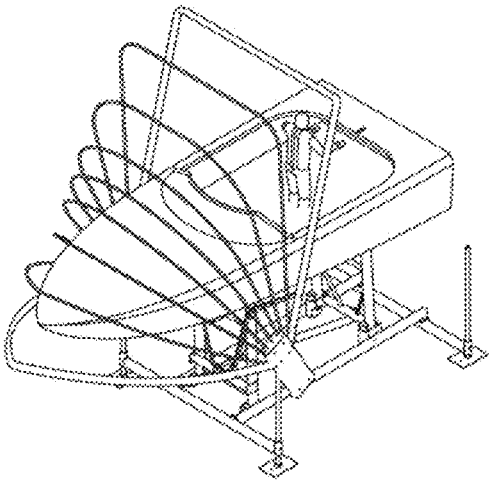
Figure 11H:
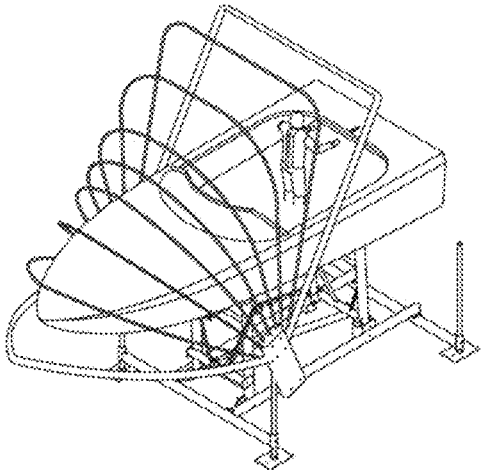
Figure 11I:
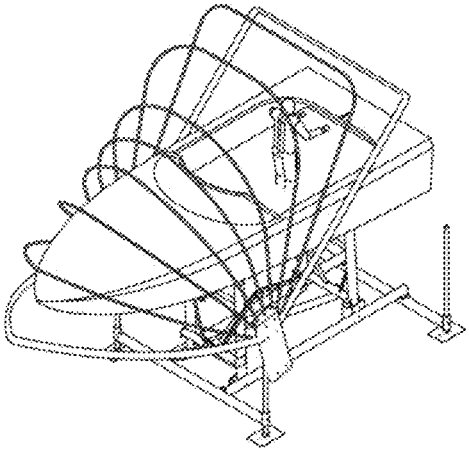
Figure 11J:
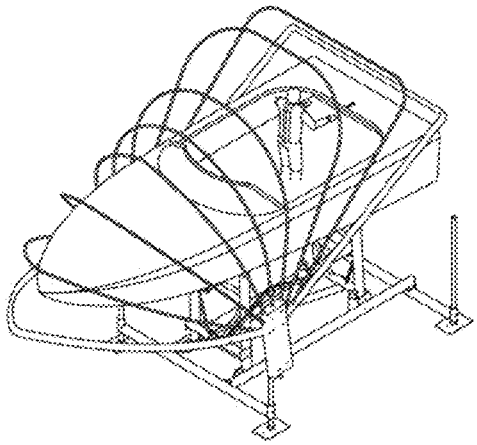
Figure 11K:
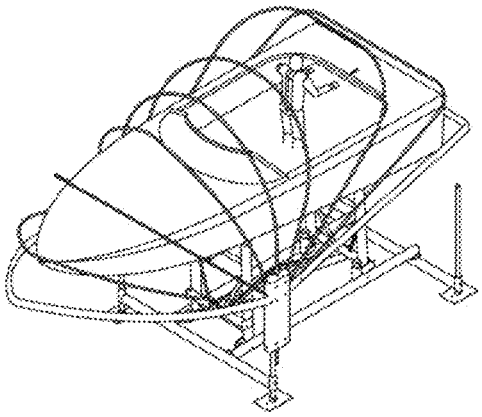
Figure 12A:
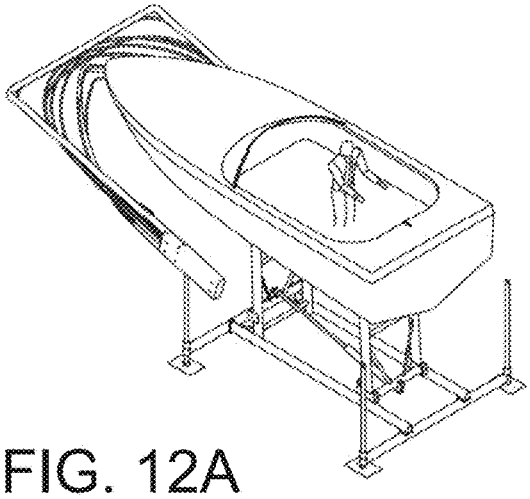
FIGS. 12A-12K are rear perspective views of the sixth implementation of the support structure of FIGS. 11A-11K.
Figure 12B:
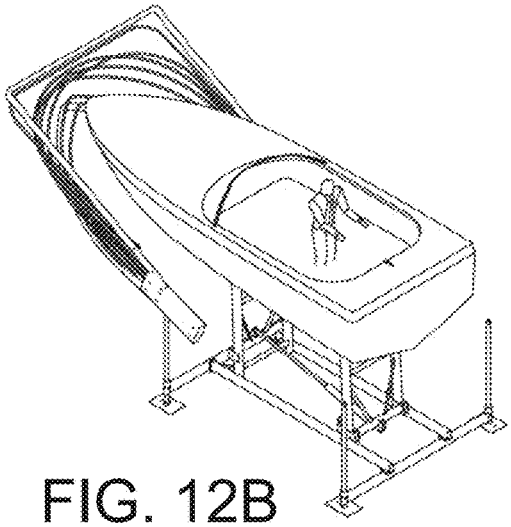
Figure 12C:
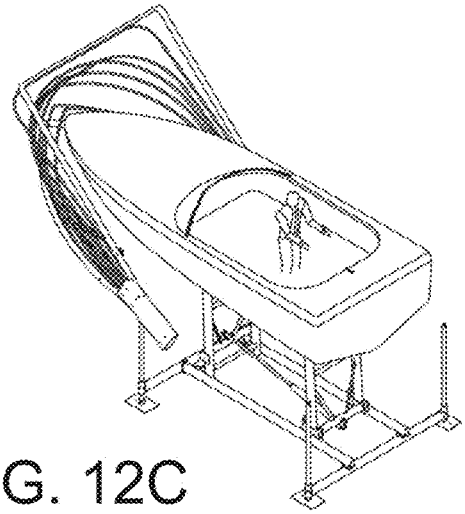
Figure 12D:
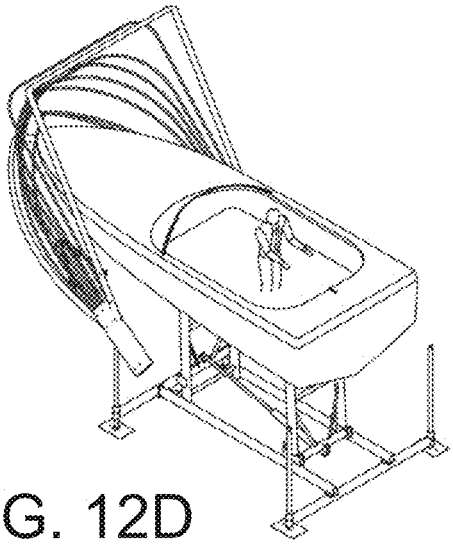
Figure 12E:
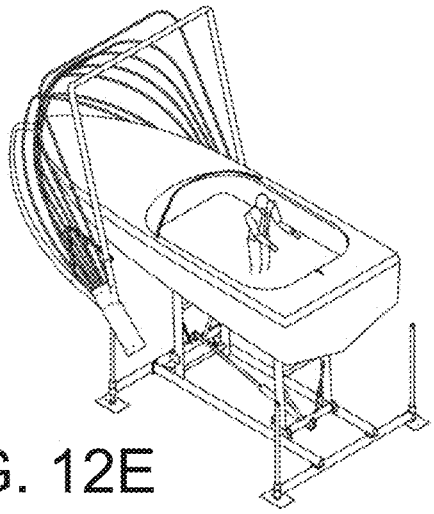
Figure 12F:
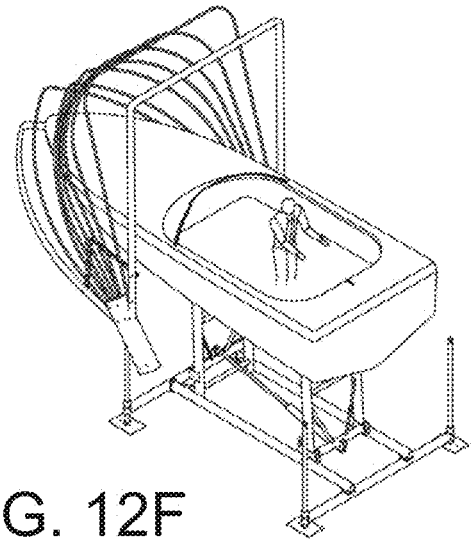
Figure 12G:
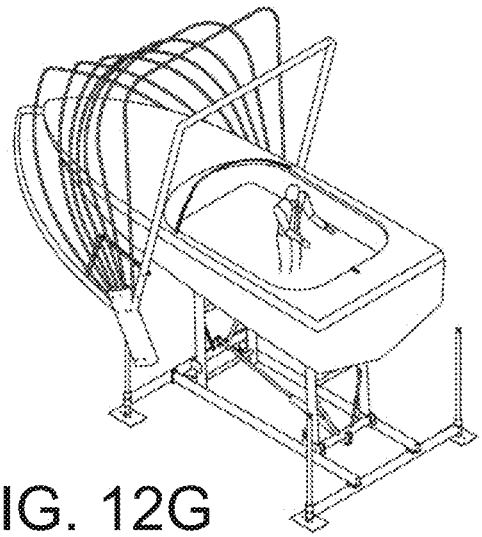
Figure 12H:
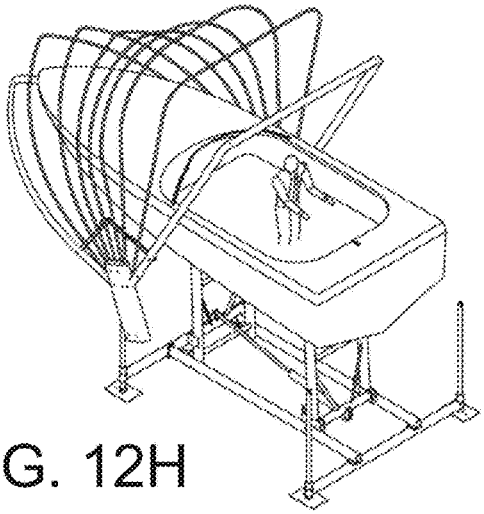
Figure 12I:
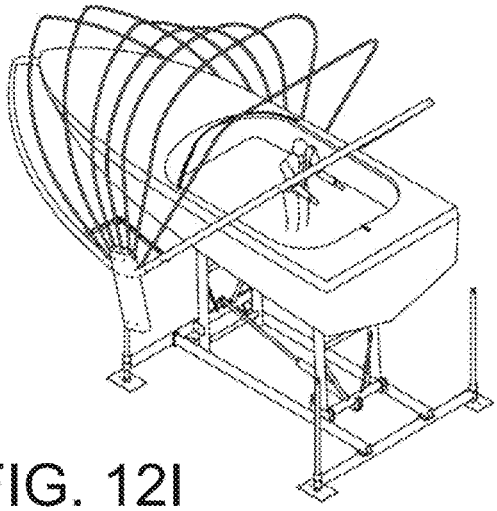
Figure 12J:
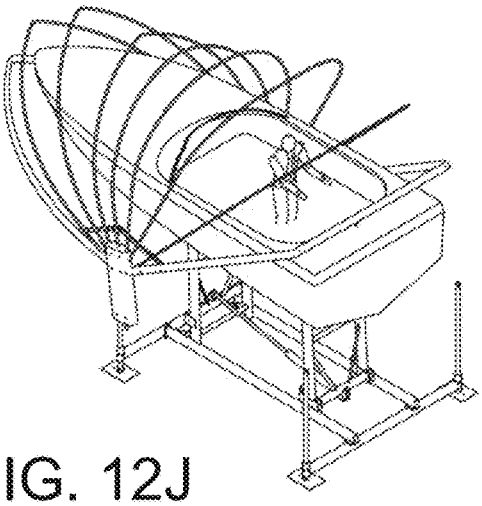
Figure 12K:
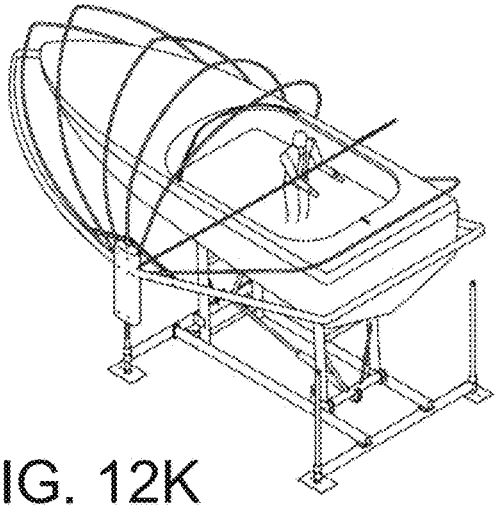
Figure 13A:
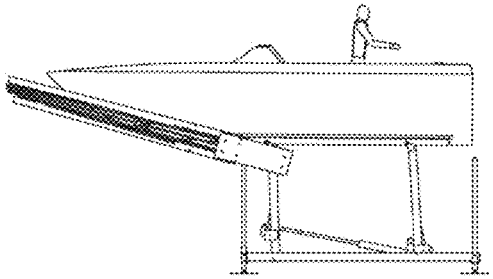
FIGS. 13A-13K are side elevation views of the sixth implementation of the support structure of FIGS. 11A-11K.
Figure 13B:
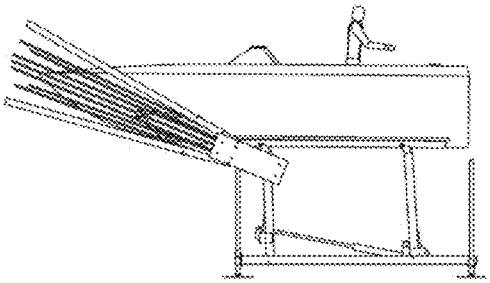
Figure 13C:
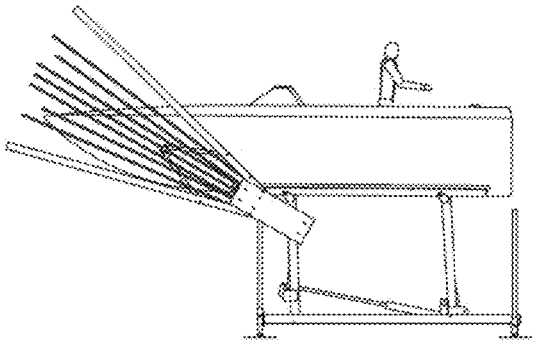
Figure 13D:
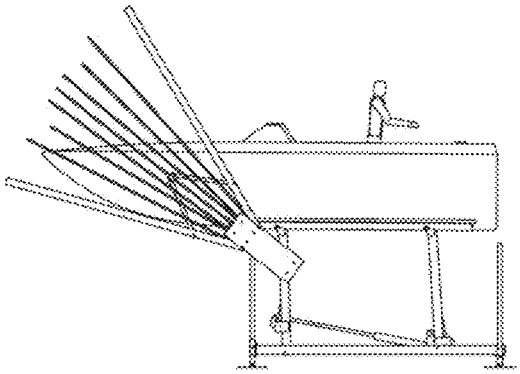
Figure 13E:
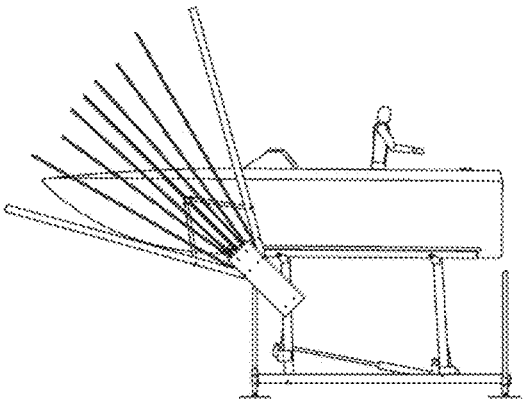
Figure 13F:
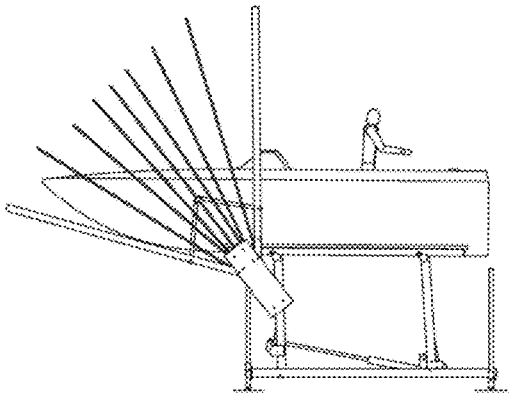
Figure 13G:
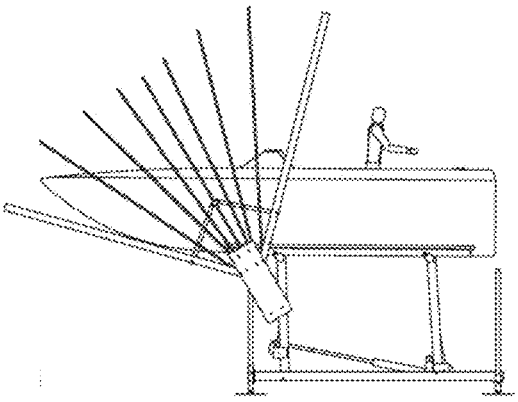
Figure 13H:
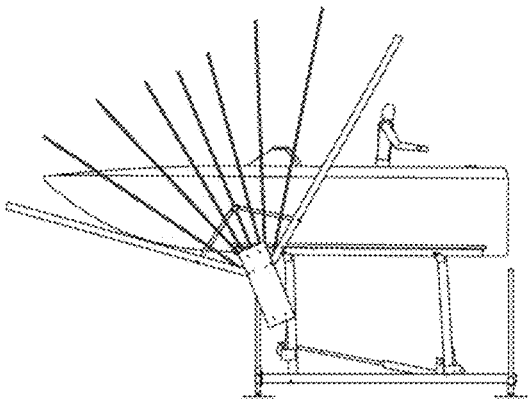
Figure 13I:
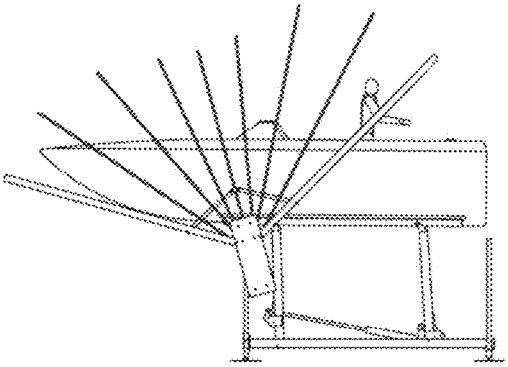
Figure 13J:
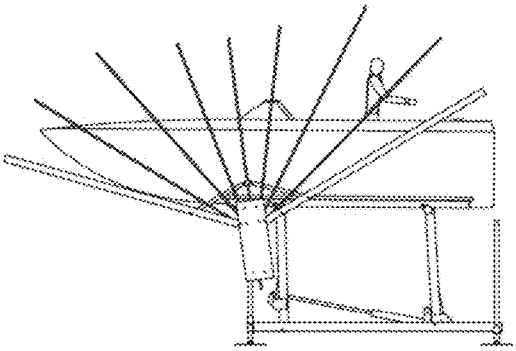
Figure 13K:
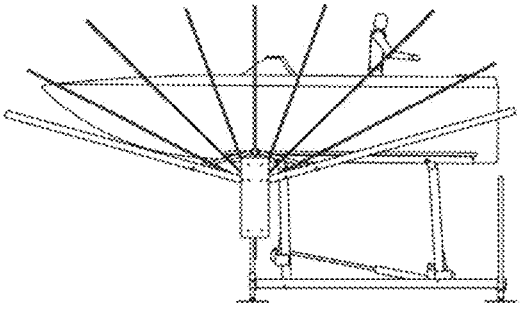
Figure 14A:
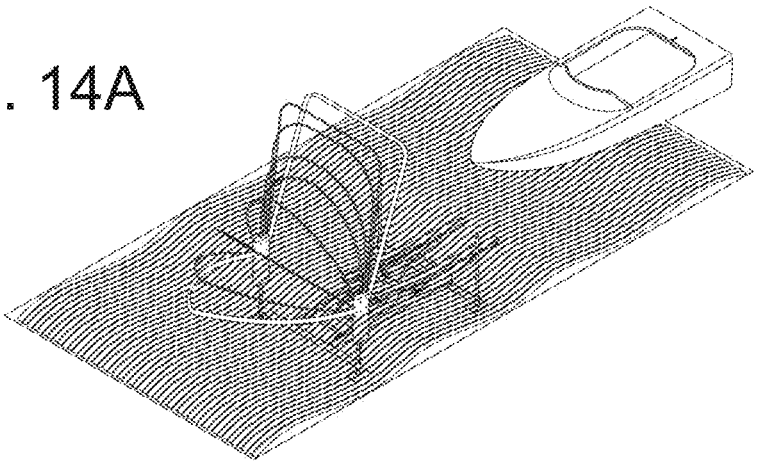
FIGS. 14A-14P are front perspective views of a seventh implementation of a support structure for a retractable canopy.
Figure 14B:
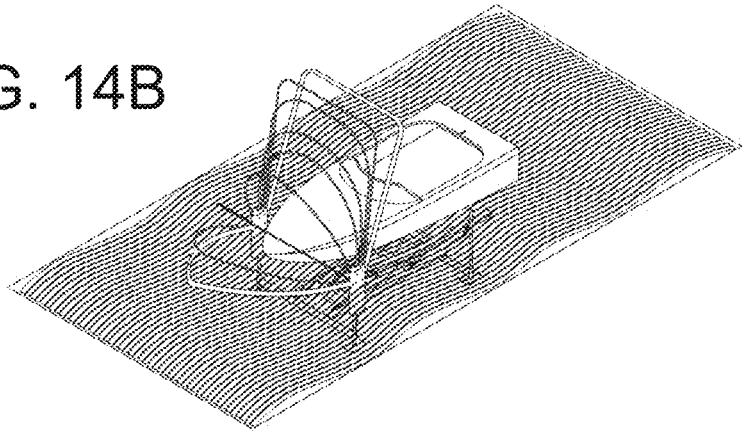
Figure 14C:
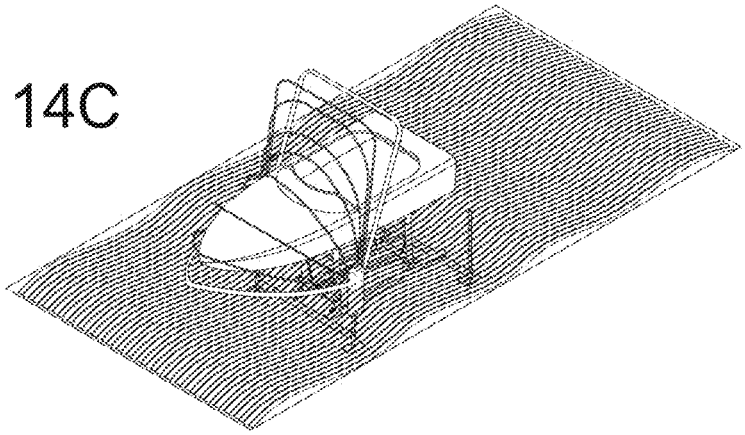
Figure 14D:
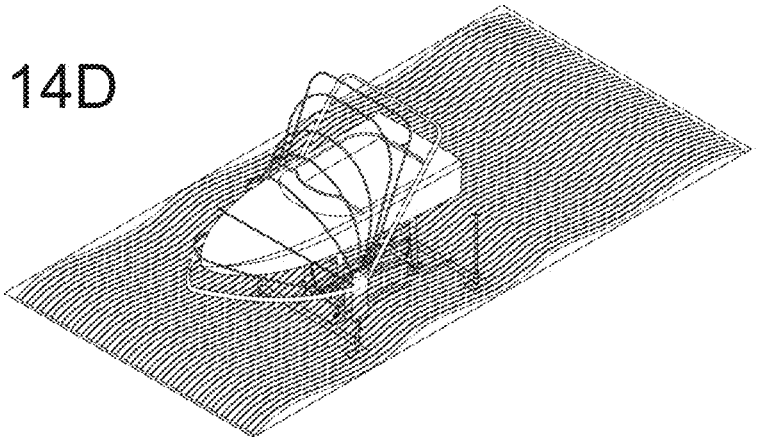
Figure 14E:
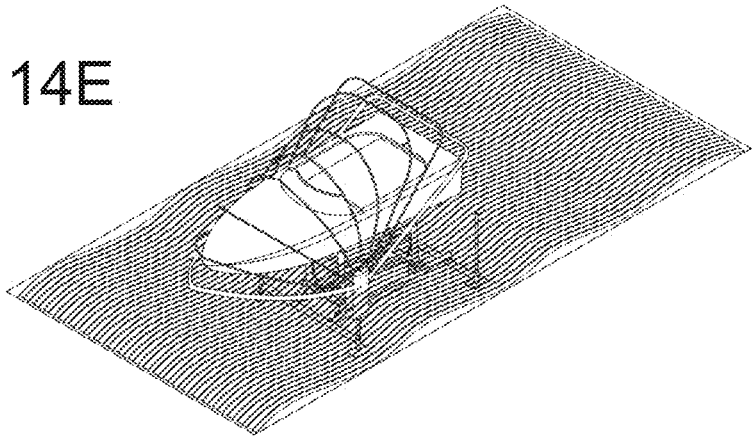
Figure 14F:
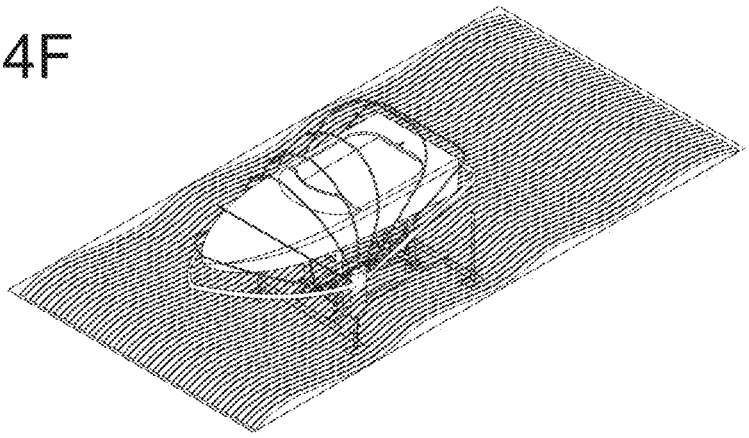
Figure 14G:
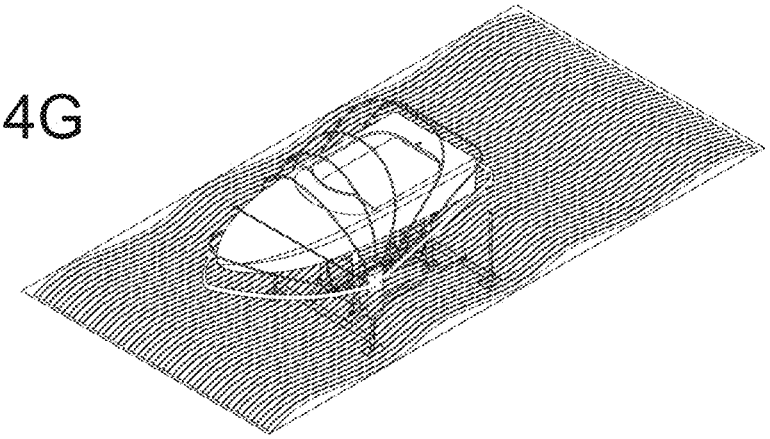
Figure 14H:
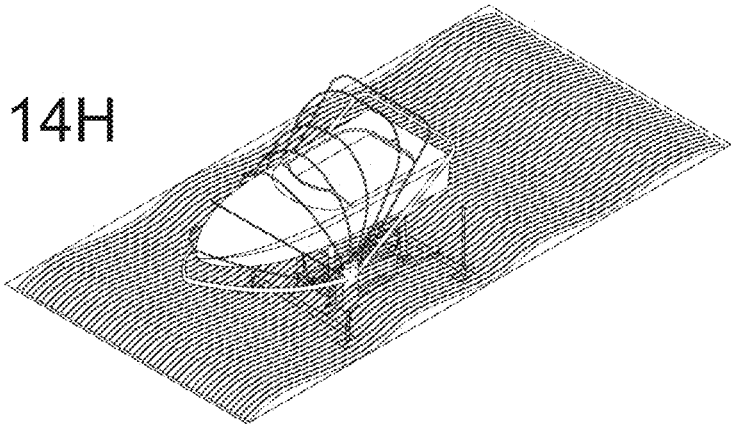
Figure 14I:
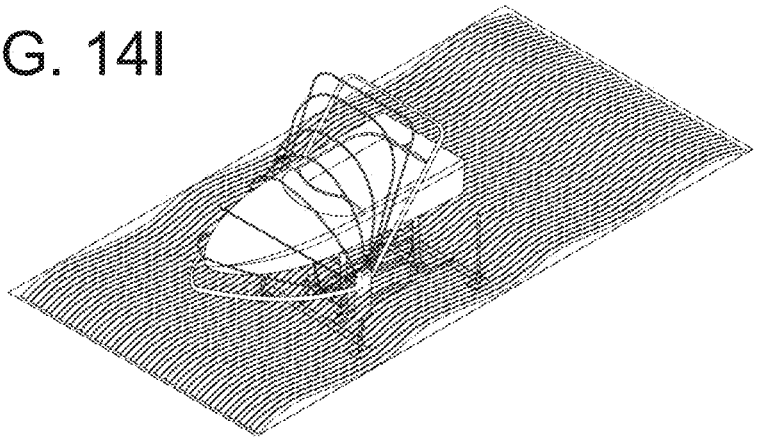
Figure 14J:
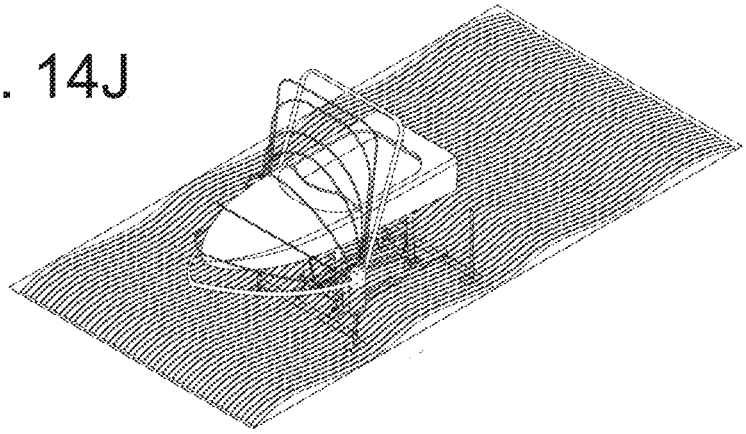
Figure 14K:
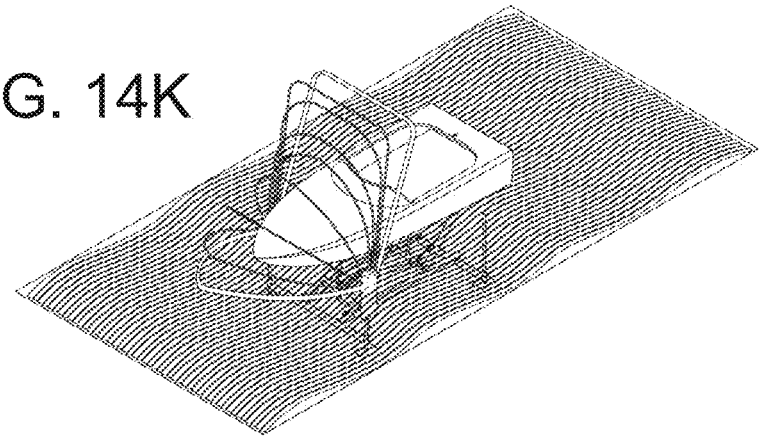
Figure 14L:
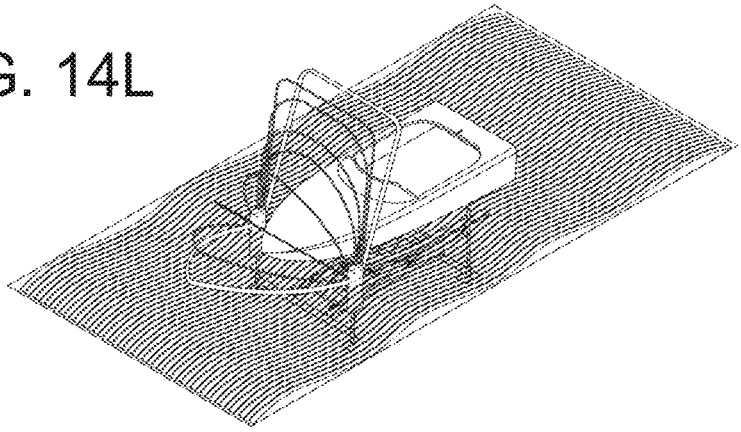
Figure 14M:
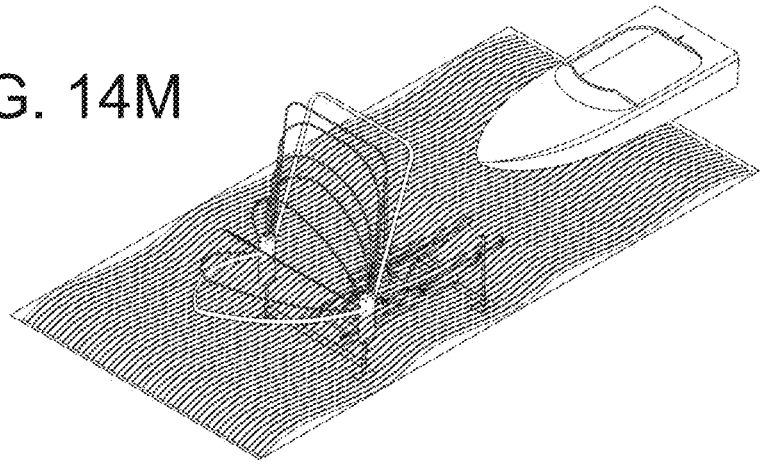
Figure 14N:
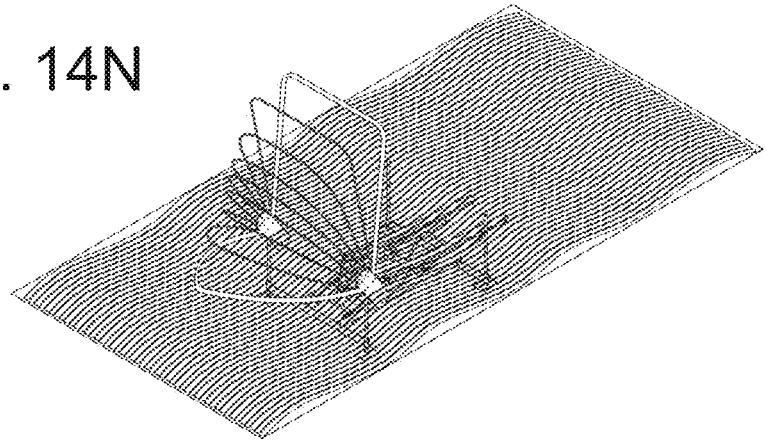
Figure 14O:
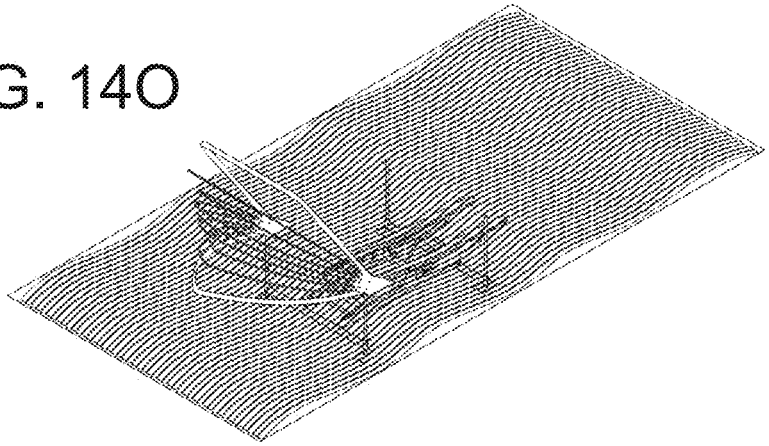
Figure 15C:
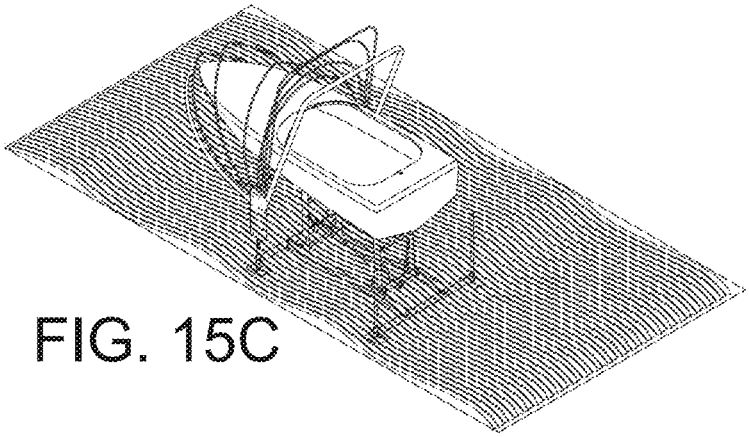
FIGS. 15A-15P are rear perspective views of the seventh implementation of the support structure of FIGS. 14A-14P.
Figure 15D:
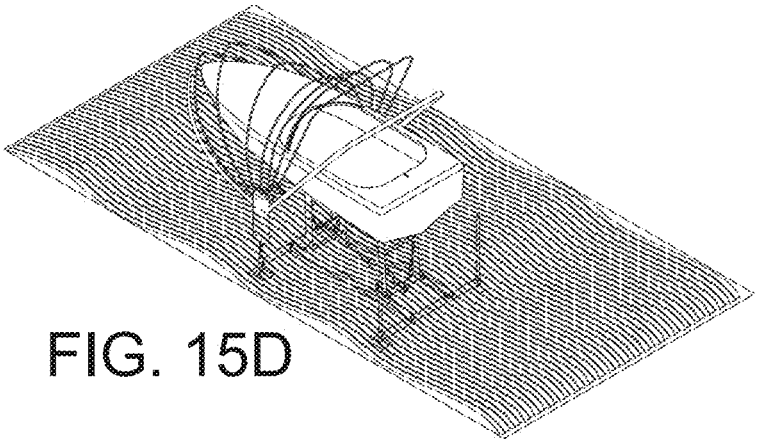
Figure 15E:
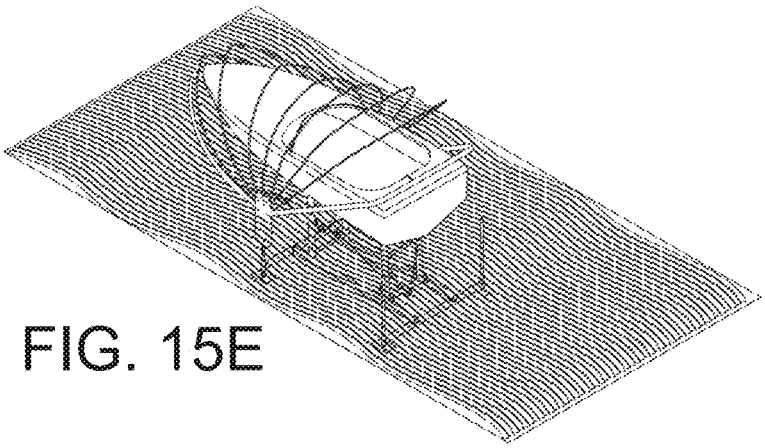
Figure 15F:
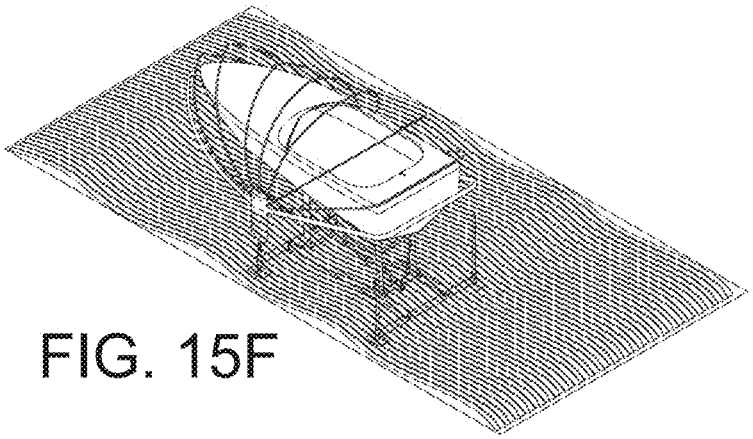
Figure 15G:
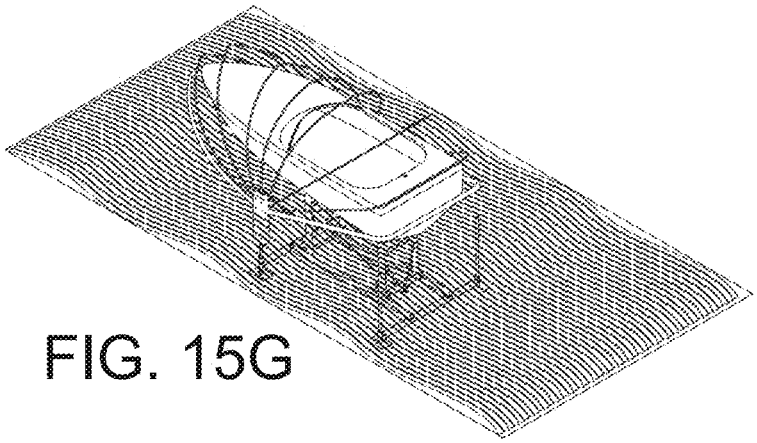
Figure 15H:
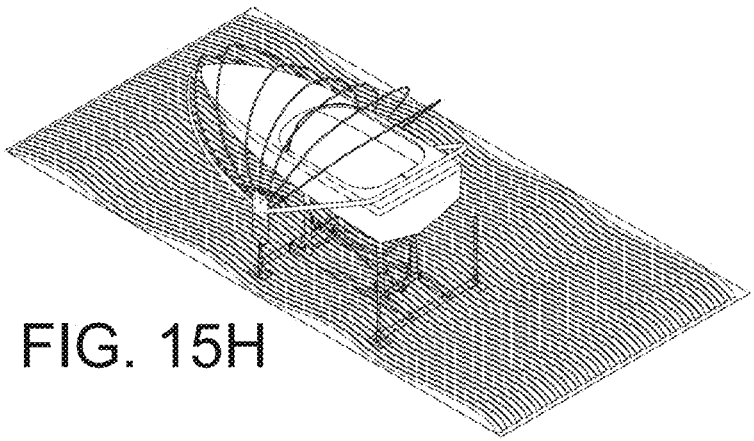
Figure 15I:
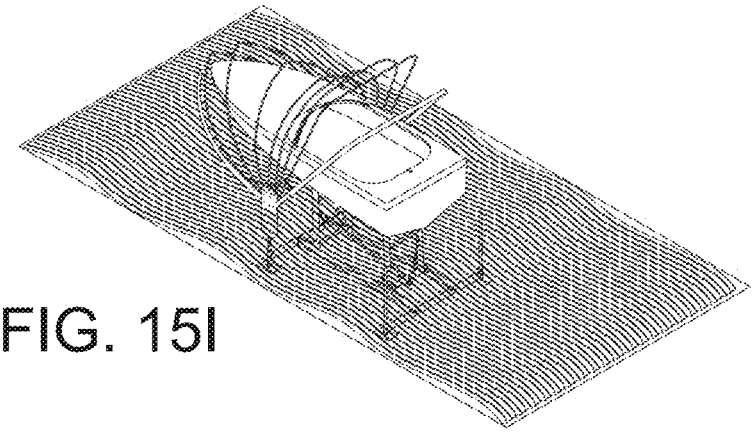
Figure 15J:
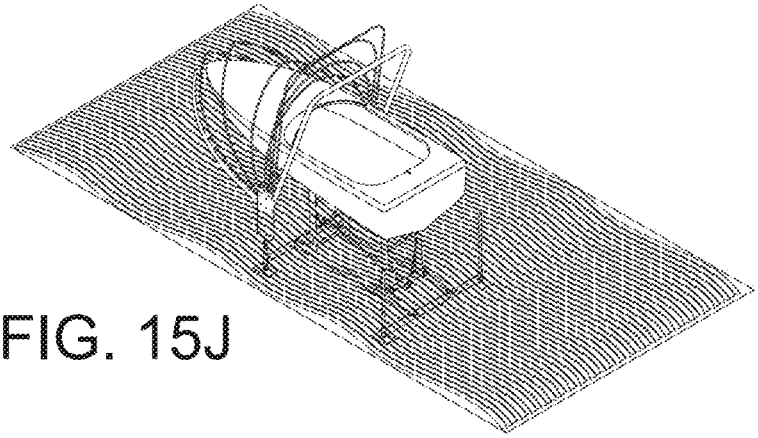
Figure 15K:
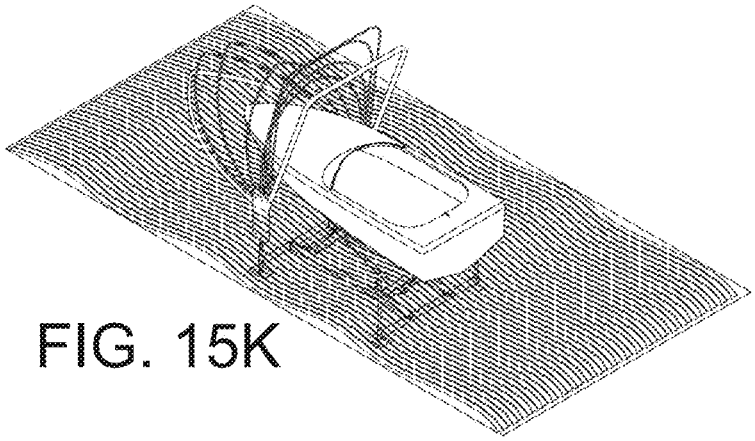
Figure 15L:
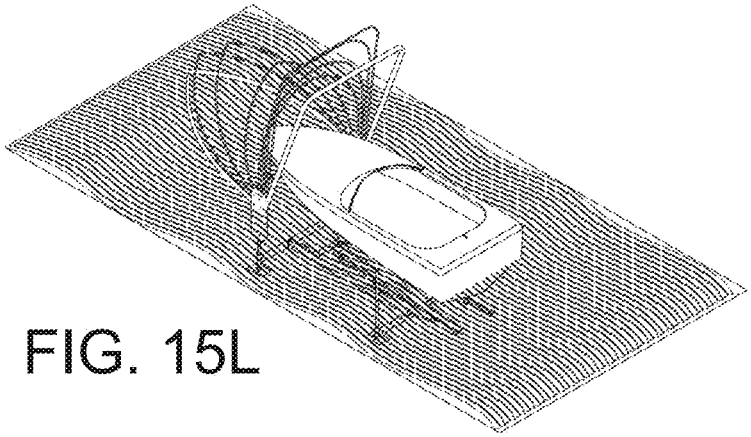
Figure 15M:
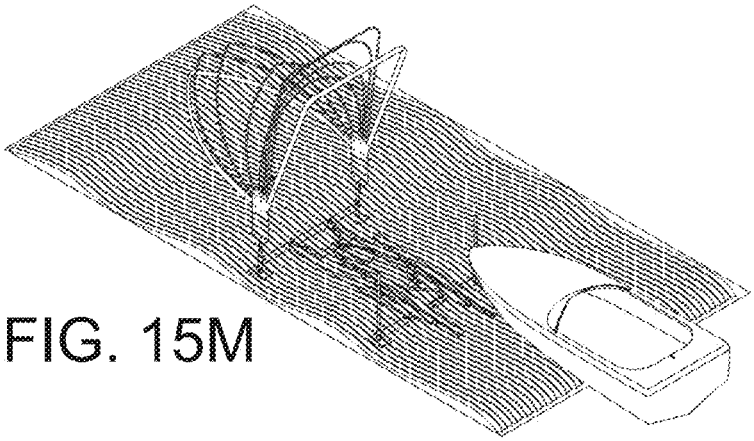
Figure 15N:
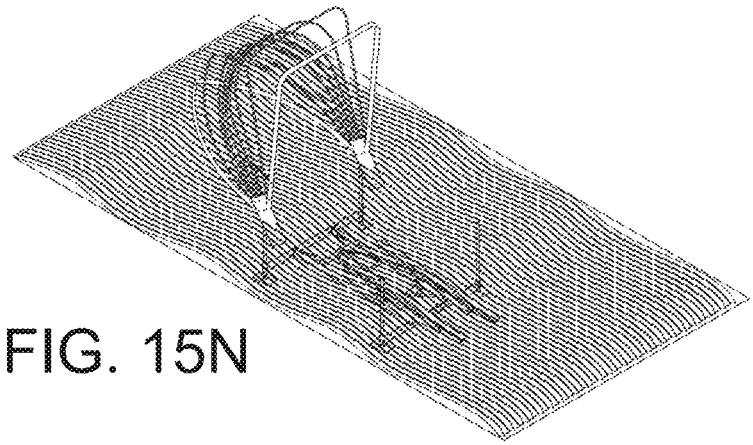
Figure 16B:
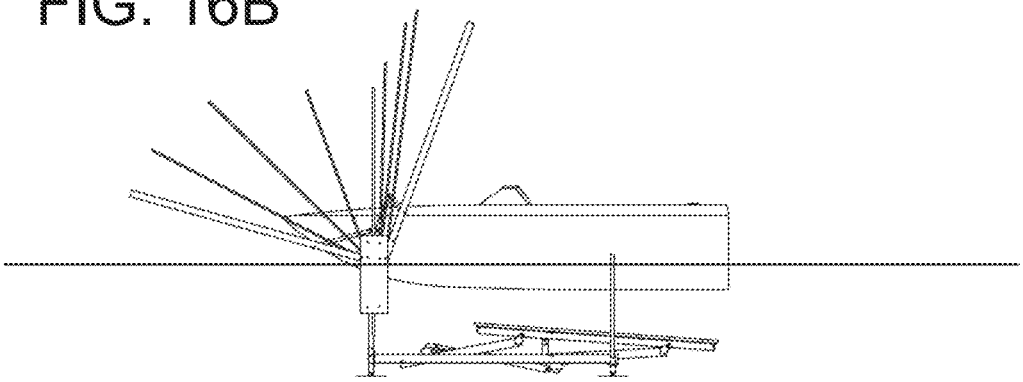
FIGS. 16A-16P are side elevation views of the seventh implementation of the support structure of FIGS. 14A-14P.
Figure 16C:
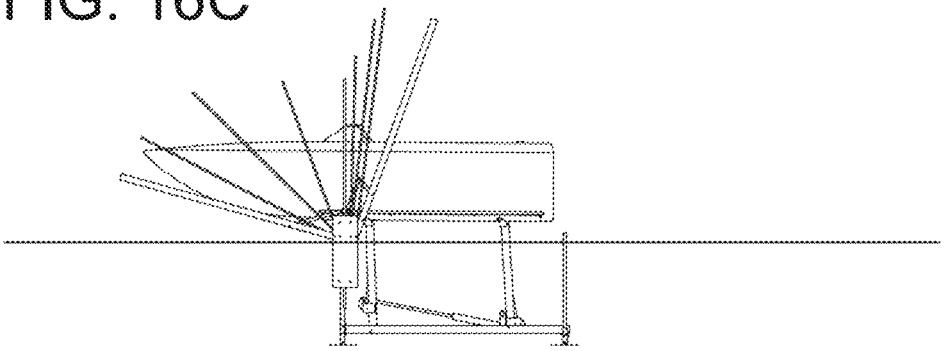
Figure 16D:
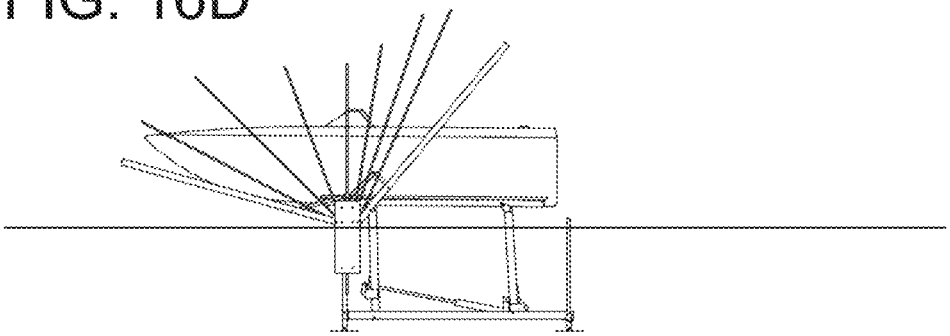
Figure 16E:
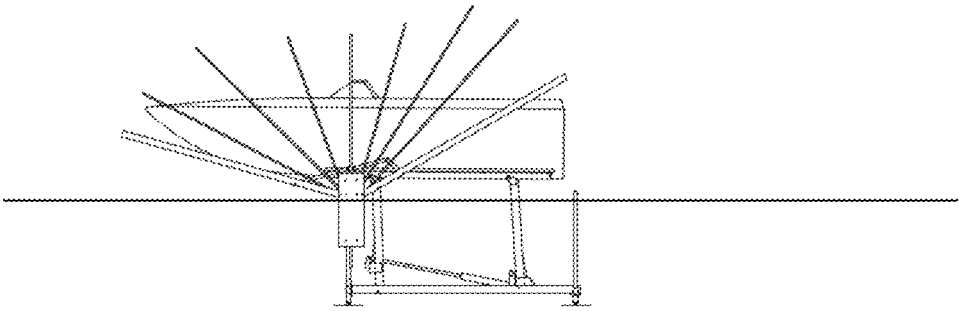
Figure 16F:
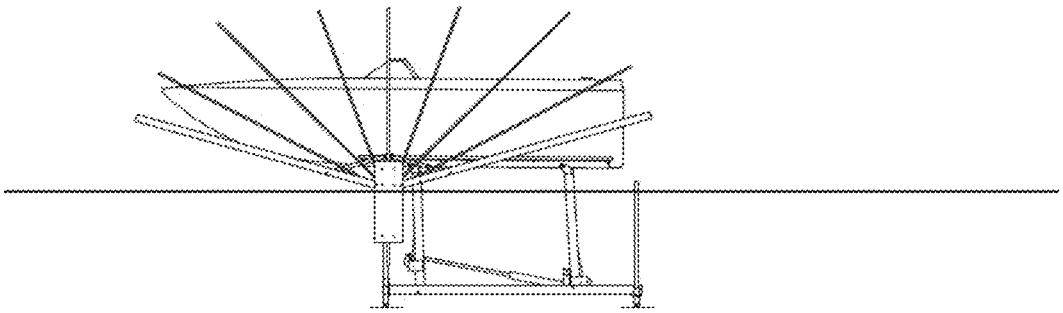
Figure 16G:
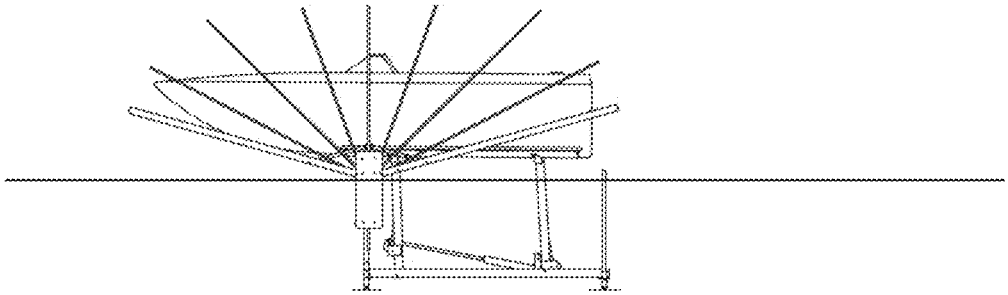
Figure 16H:
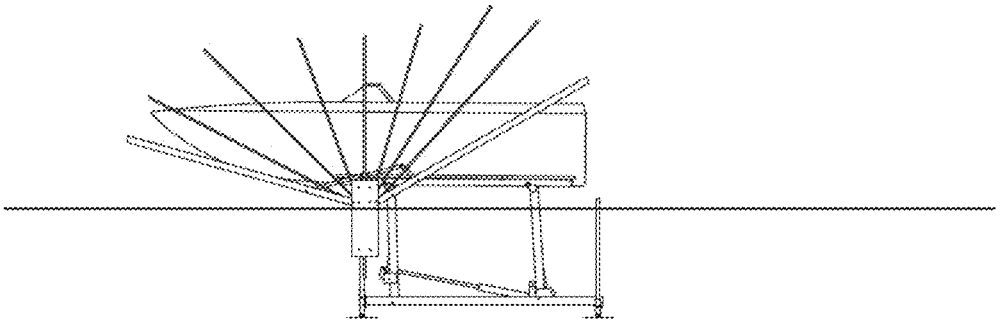
Figure 16I:
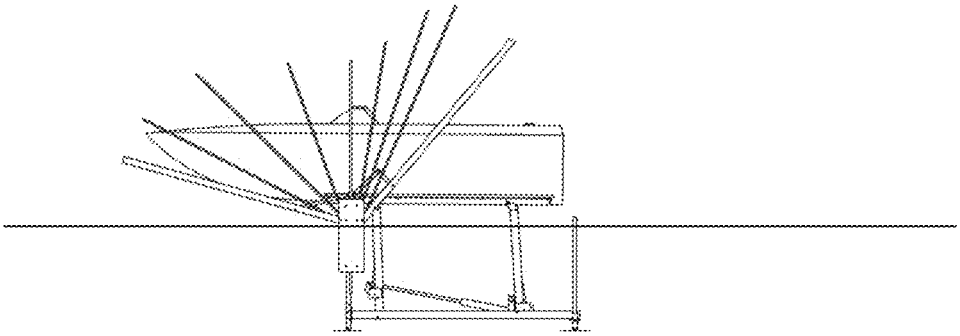
Figure 16J:
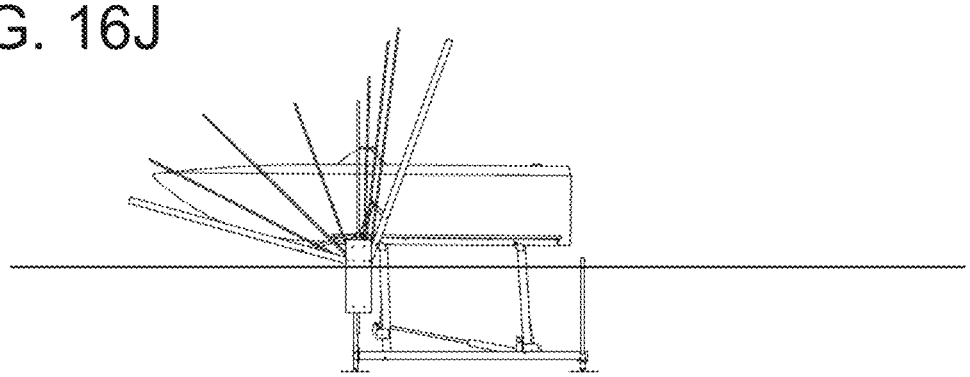
Figure 16K:
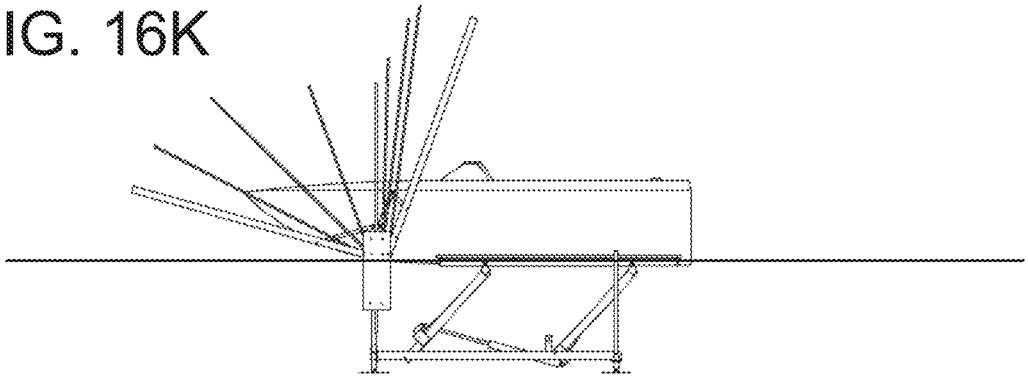
Figure 16L:
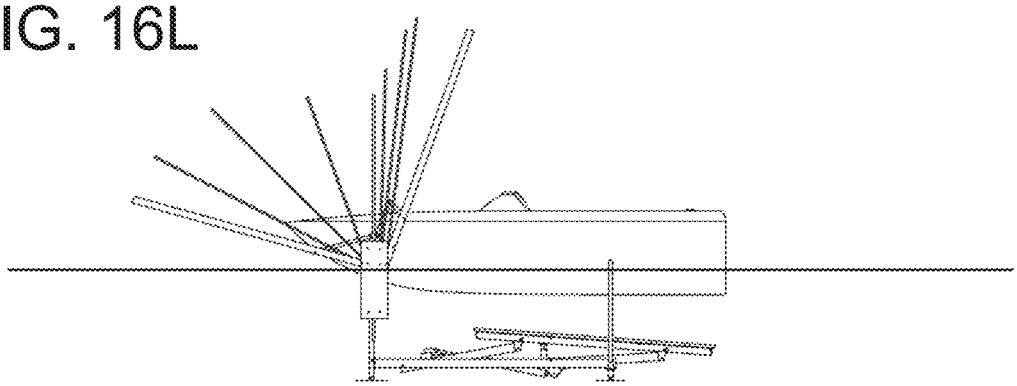
Figure 16M:
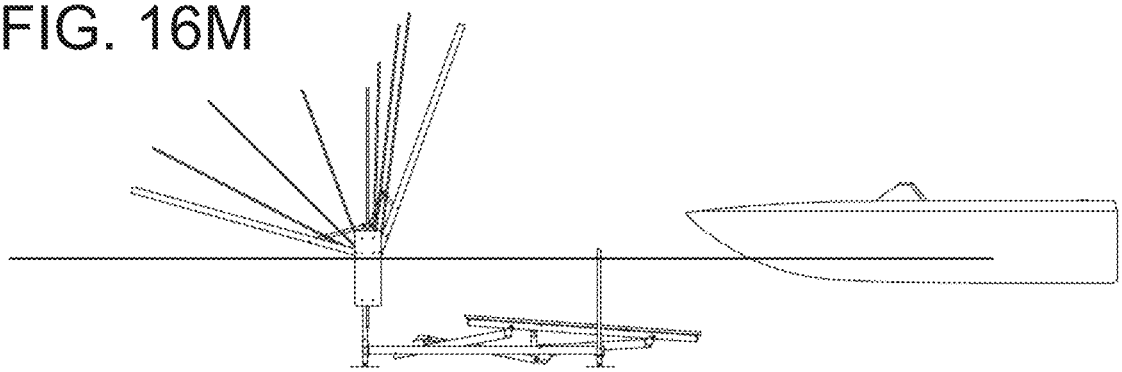
Figure 16N:
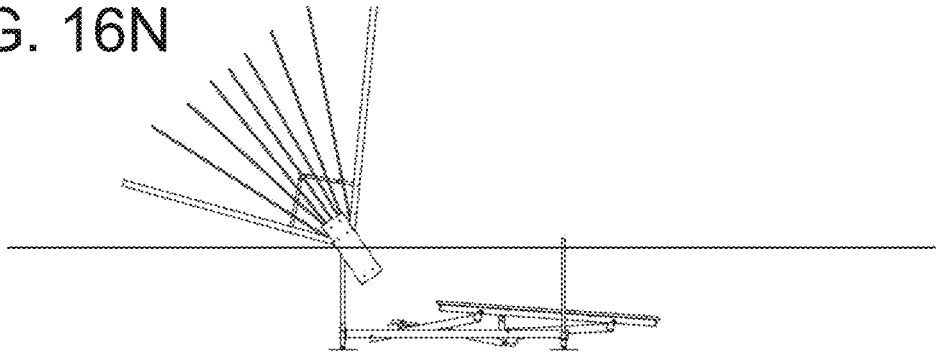
Figure 16O:
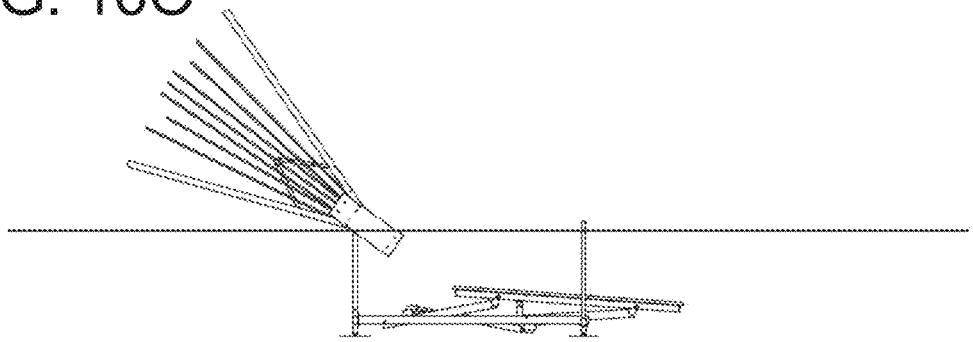
Figure 16P:
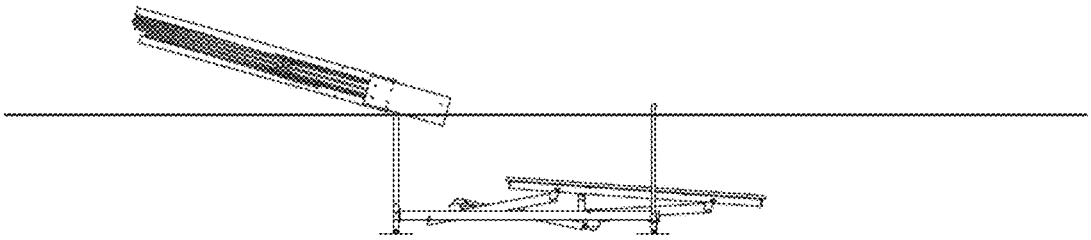
Figure 17A:
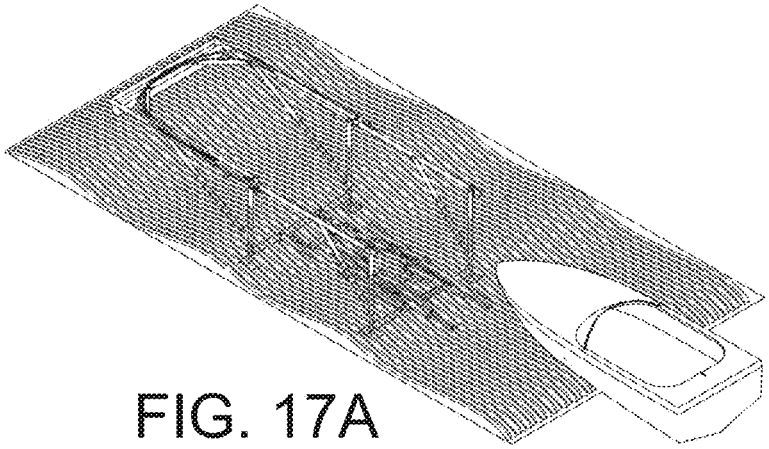
FIGS. 17A-17I are perspective views of an eighth implementation of a support structure for a retractable canopy.
Figure 17B:
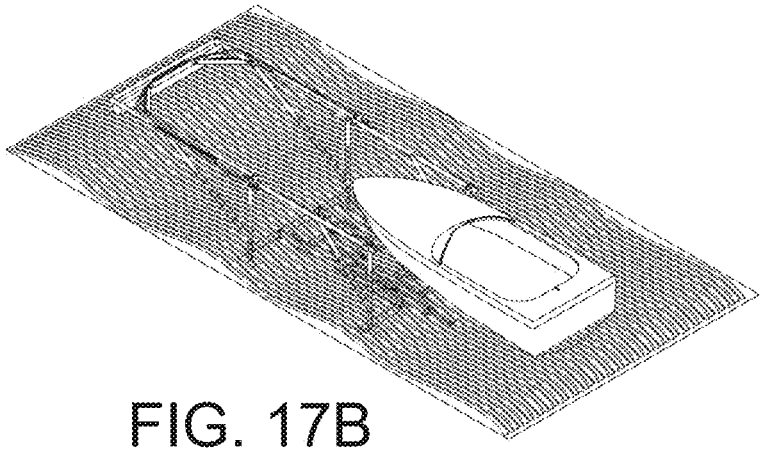
Figure 17C:
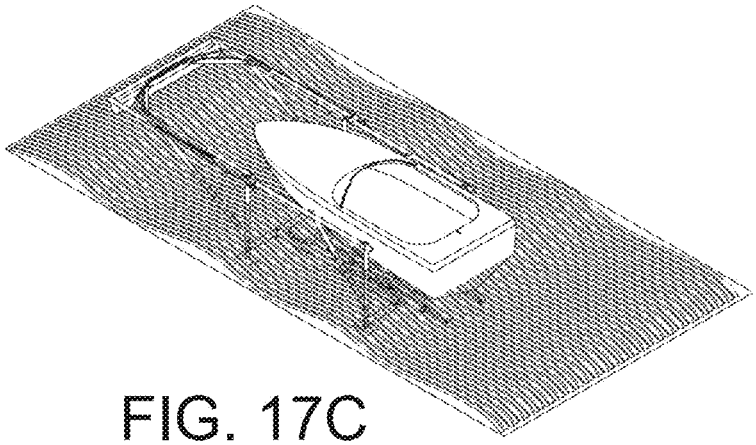
Figure 17D:
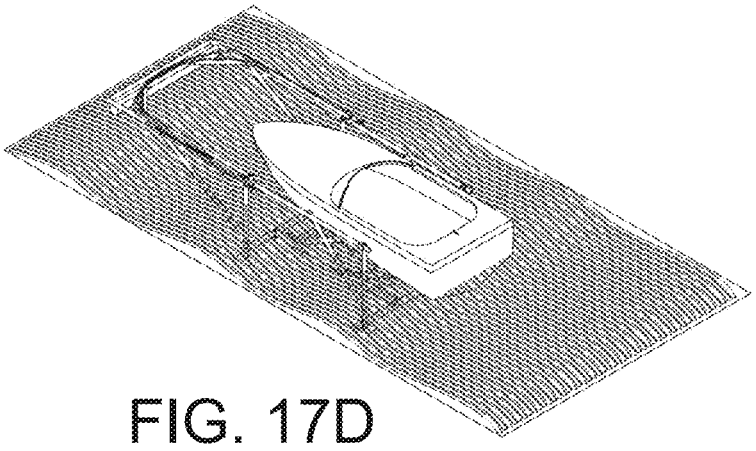
Figure 17E:
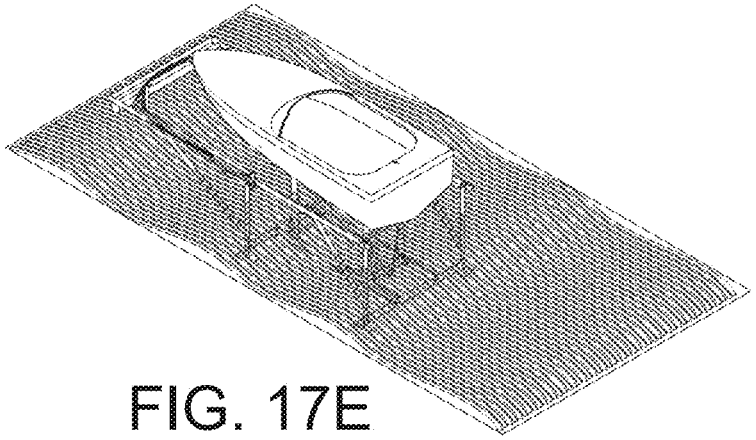
Figure 17F:
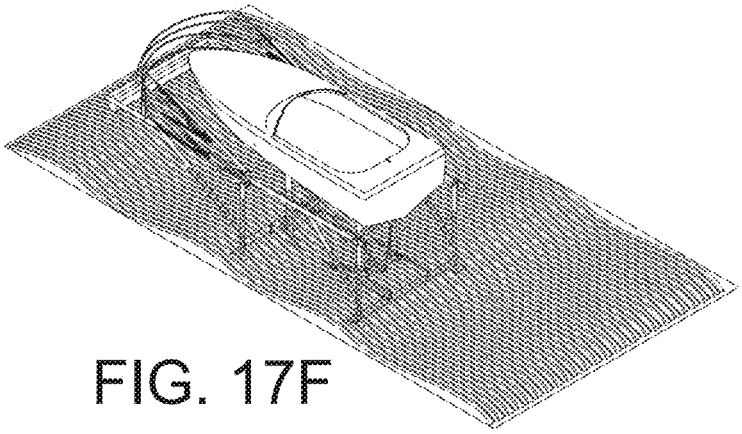
Figure 17G:
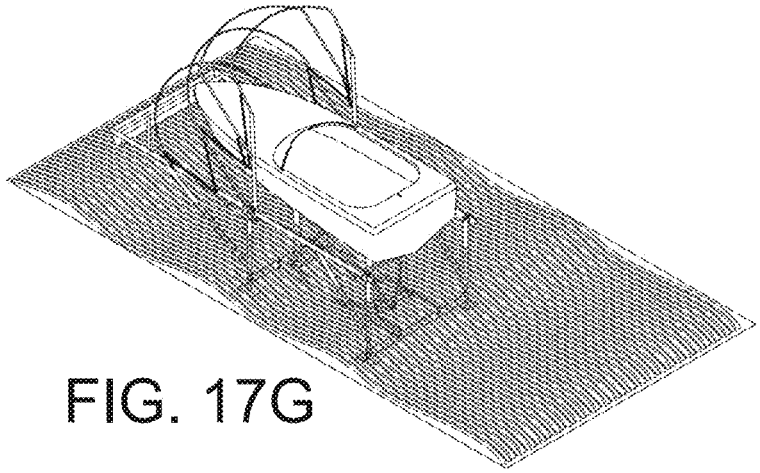
Figure 17H:
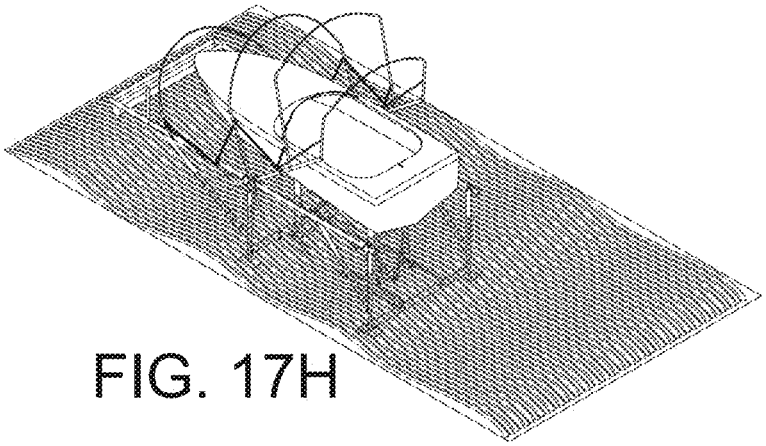
Figure 17I:
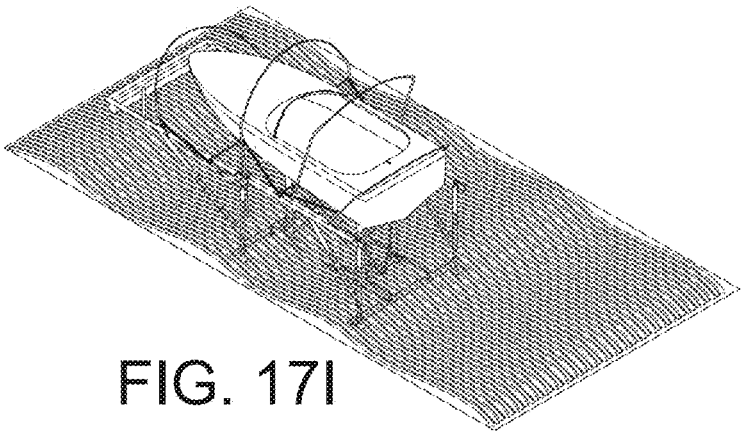
Figure 18A:
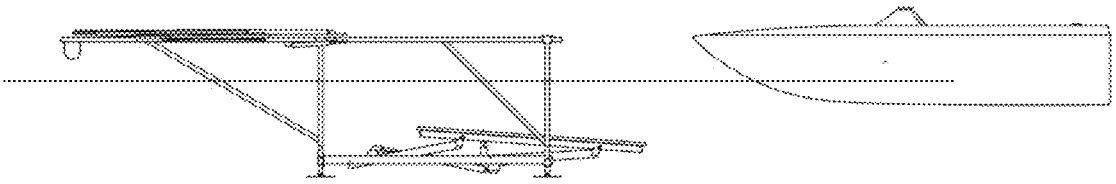
Figure 18B:
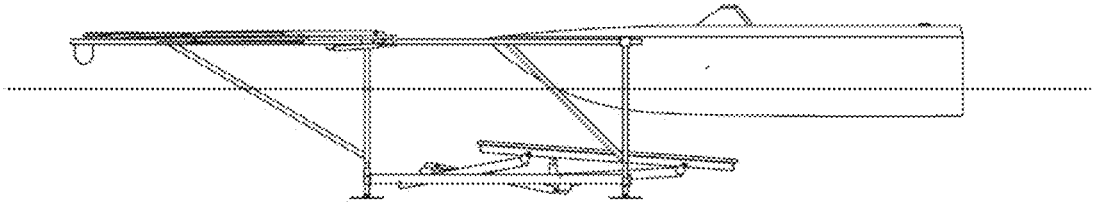
Figure 18C:
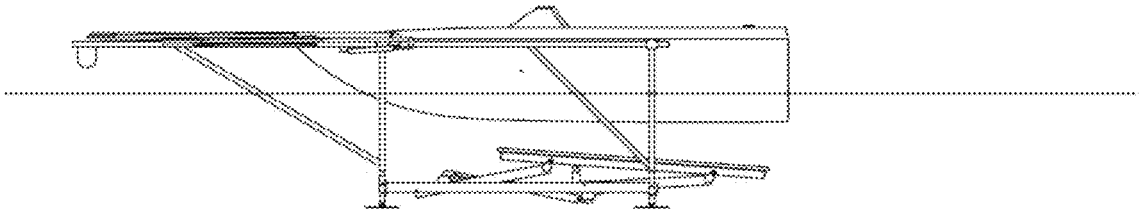
Figure 18D:
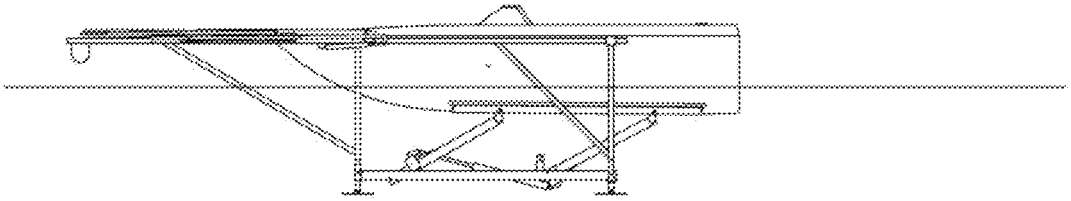
Figure 18E:
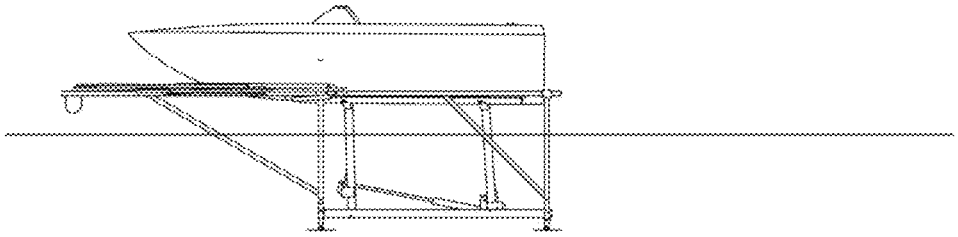
Figure 18F:
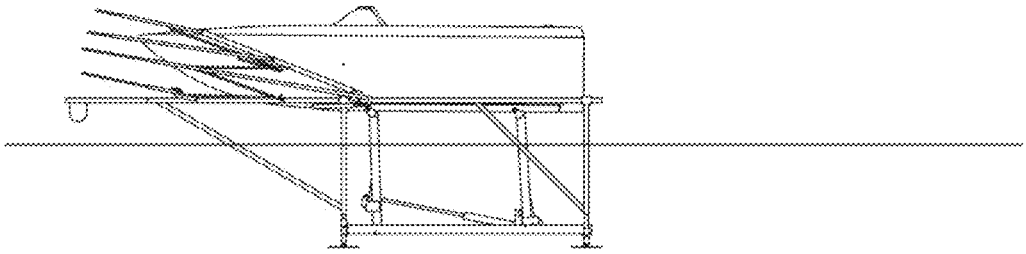
Figure 18G:
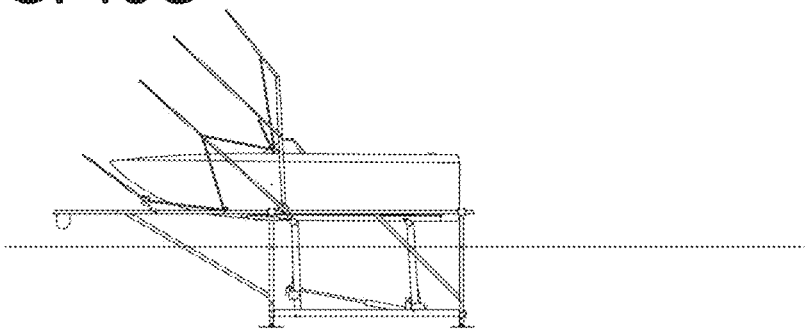
Figure 18H:
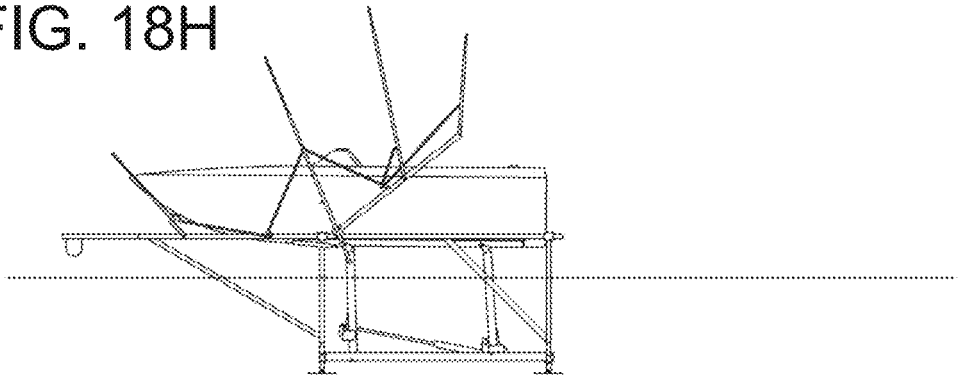
Figure 19C:
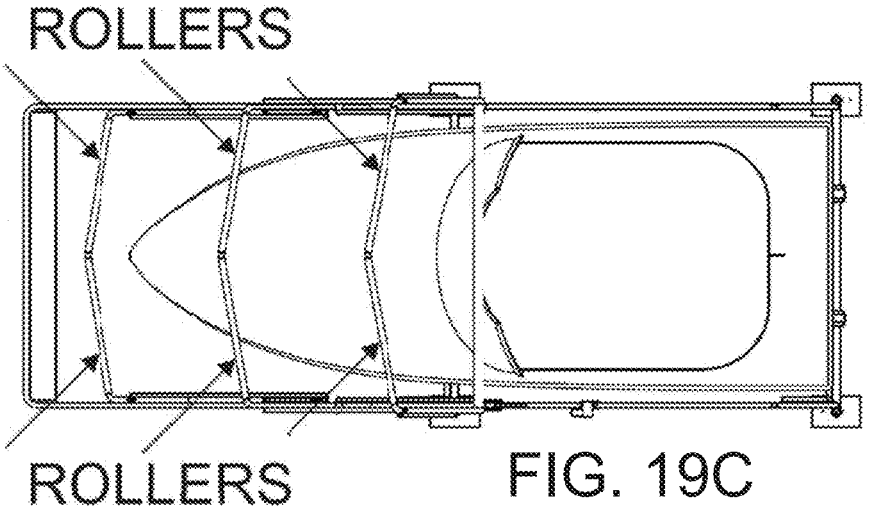
Figure 19D:
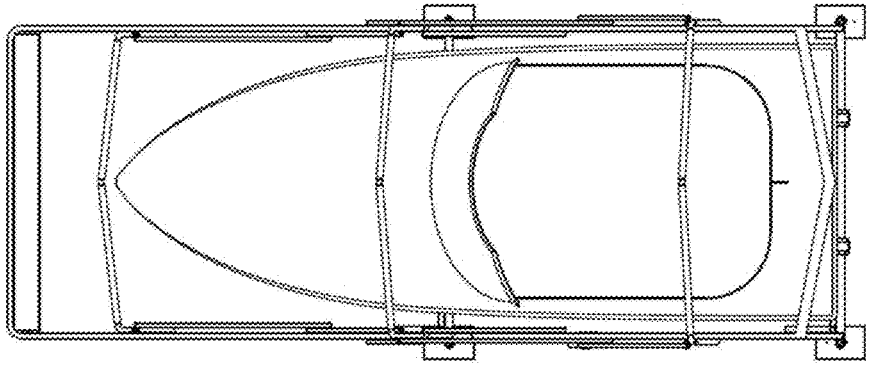
Figure 19E:
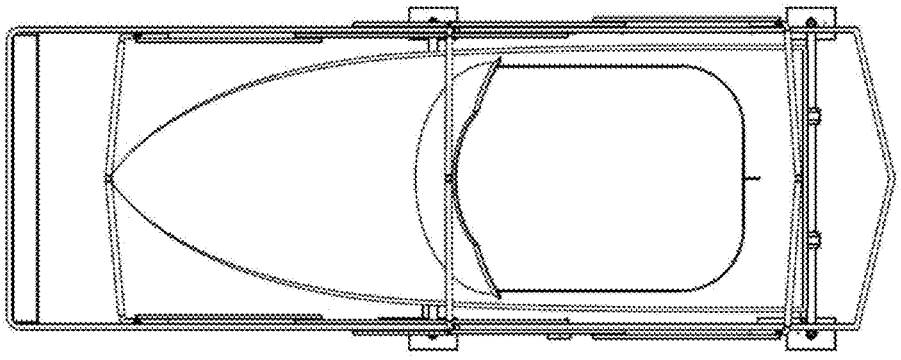
Figure 20D:
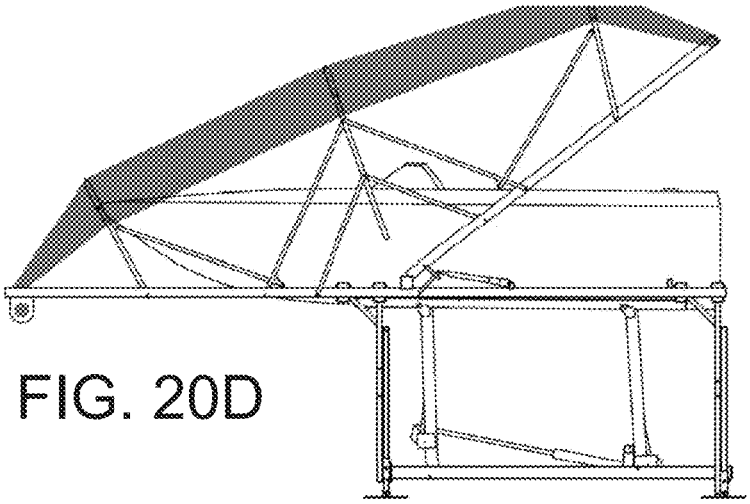
Figure 20E:
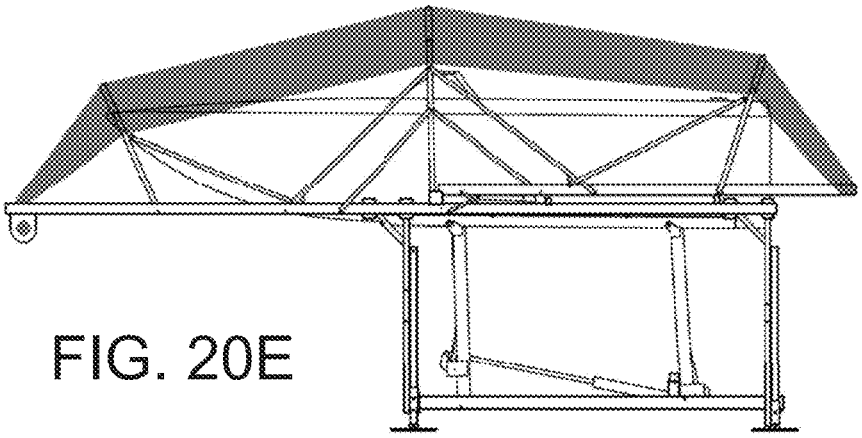
Figure 21A:
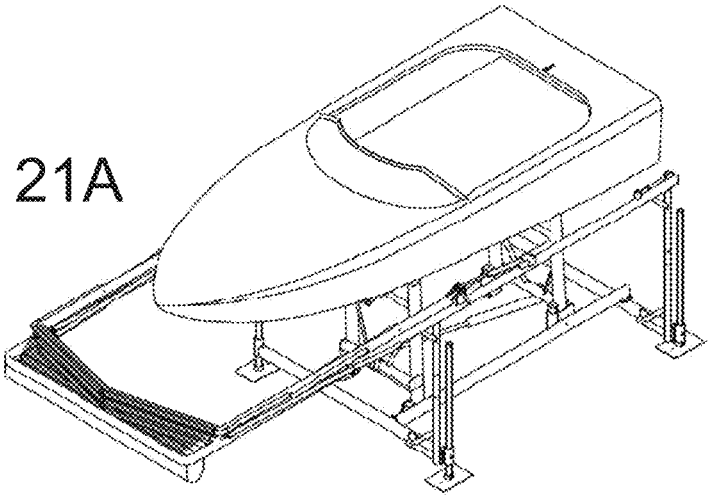
Figure 21E:
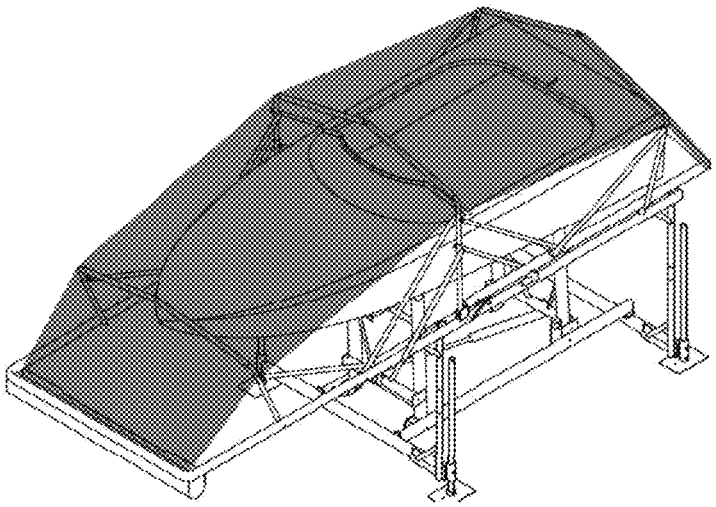
Figure 22A:
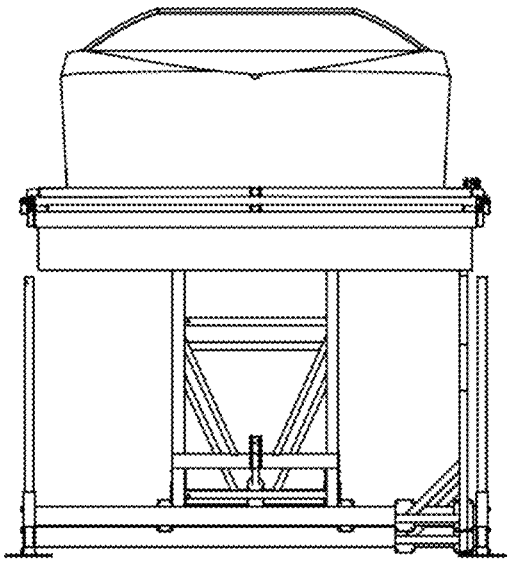
Figure 22B:
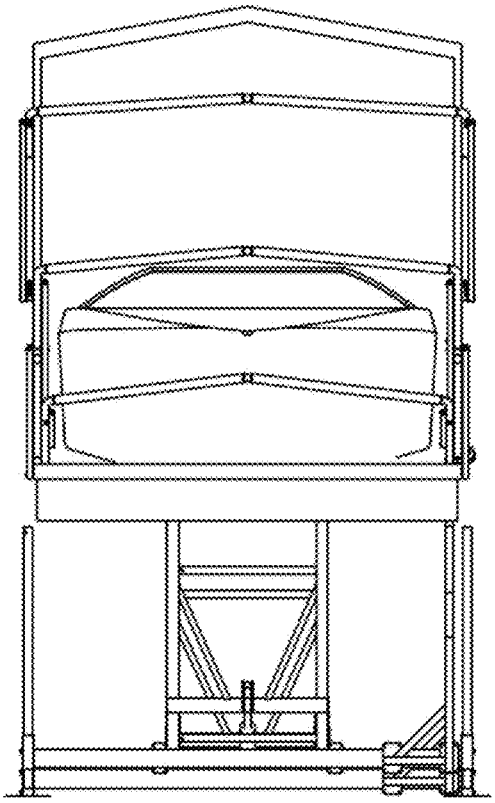

FIGS. 1A-1K and 2A-2K depict the operation of a first example support structure for a retractable canopy for boats. A canopy member (not shown), typically a flexible sheet of weather resistant of flexible material, is supported by the support structure over the boat when the support structure is in the fully open. When the support structure is fully retracted, the canopy member is folded.

FIGS. 3A-3K and 4A-4K depict the operation of a second example support structure for a retractable canopy for boats. A canopy member (not shown), typically a flexible sheet of weather resistant material, is supported by the support structure over the boat when the support structure is in the fully open. When the support structure is fully retracted, the canopy member is rolled up within a roller assembly.

FIGS. 5A-5K and 6A-6K depict the operation of a third example support structure for a retractable canopy for boats. A canopy member (not shown), typically a flexible sheet of weather resistant material, is supported by the support structure over the boat when the support structure is in the fully open. When the support structure is fully retracted, the canopy member is rolled up within a roller assembly.

FIGS. 7A-7K and 8A-8K depict the operation of a fourth example support structure for a retractable canopy for boats. A canopy member (not shown), typically a flexible sheet of weather resistant material, is supported by the support structure over the boat when the support structure is in the fully open. When the support structure is fully retracted, the canopy member is rolled up within a roller assembly.

FIGS. 9 and 10A-10H depict the operation of a fifth example support structure for a retractable canopy for boats. A canopy member (not shown), typically a flexible sheet of weather resistant of flexible material, is supported by the support structure over the boat when the support structure is in the fully open. When the support structure is fully retracted, the canopy member is folded.

FIGS. 11A-11K, 12A-12K, and 13A-13K depict the operation of a sixth example support structure for a retractable canopy for boats. A canopy member (not shown), typically a flexible sheet of weather resistant of flexible material, is supported by the support structure over the boat when the support structure is in the fully open. When the support structure is fully retracted, the canopy member is folded.

FIGS. 14A-14P, 15A-15P, and 16A-16P depict the operation of a seventh example support structure for a retractable canopy for boats. A canopy member (not shown), typically a flexible sheet of weather resistant of flexible material, is supported by the support structure over the boat when the support structure is in the fully open. When the support structure is fully retracted, the canopy member is folded.

FIGS. 17A-17I and 18A-18I depict the operation of an eight example support structure for a retractable canopy for boats. A canopy member (not shown), typically a flexible sheet of weather resistant of flexible material, is supported by the support structure over the boat when the support structure is in the fully open. When the support structure is fully retracted, the canopy member is folded. FIGS. 17A-17I and 18A-18I also illustrate that any one of the example retractable canopy systems for boats depicted above can be used with a boat lift system such as the example boat lift system depicted therein.

FIGS. 19A-19E, 20A-20E, 21A-21E, and 22A-22E depict the operation of a ninth example support structure for a retractable canopy for boats of the present disclosure as used in connection with an example boat lift system, with the canopy removed in FIGS. 19A-19E and 22A-22Efor clarity.

FIGS. 23A-23D, 24A-24D, and 25A-25D depict the operation of a tenth example support structure for a retractable canopy for boats of the present disclosure as used in connection with an example boat lift system. A canopy member, typically a flexible sheet of weather resistant flexible material, is supported by the support structure over the boat when the support structure is fully open. When the support structure is fully retracted, the canopy member is folded.

FIGS. 23A-23D are perspective views of an implementation of a retractable canopy 20 for a watercraft lift 22. The retractable canopy 20 includes a fixed boom 24 extending from the watercraft lift 22. A movable boom 26 is supported for rotational movement by the watercraft lift 22. An actuator 28 (shown in FIG. 23C) is operatively connected to the watercraft lift 22 and the movable boom 26 to rotate the movable boom 26 between a first position as in FIG. 1A 23A and a second position as in FIG. 23D relative to the watercraft lift 22. In the first position shown in FIG. 23A, the movable boom 26 is spaced from the fixed boom 24. In the second position, the movable boom 26 is adjacent to the fixed boom 24.

The retractable canopy 20 further includes at least one first linkage 30 extending between the fixed boom 24 and the movable boom 26 and at least one second linkage 32 extending between the fixed boom 24 and the movable boom 26. At least one first strut 34 is rotatably supported by the at least one first linkage 30 and slidably supported by the at least one second linkage 32, as further described herein. In one implementation, the retractable canopy 20 includes at least one second strut 36 rotatable relative to the fixed boom 24 and at least one third strut 38 supported by the movable boom 26. A cover 40 is secured at a first end 42 to the fixed boom 24 and at a second end 44 to the movable boom 26.

Figure 23A:
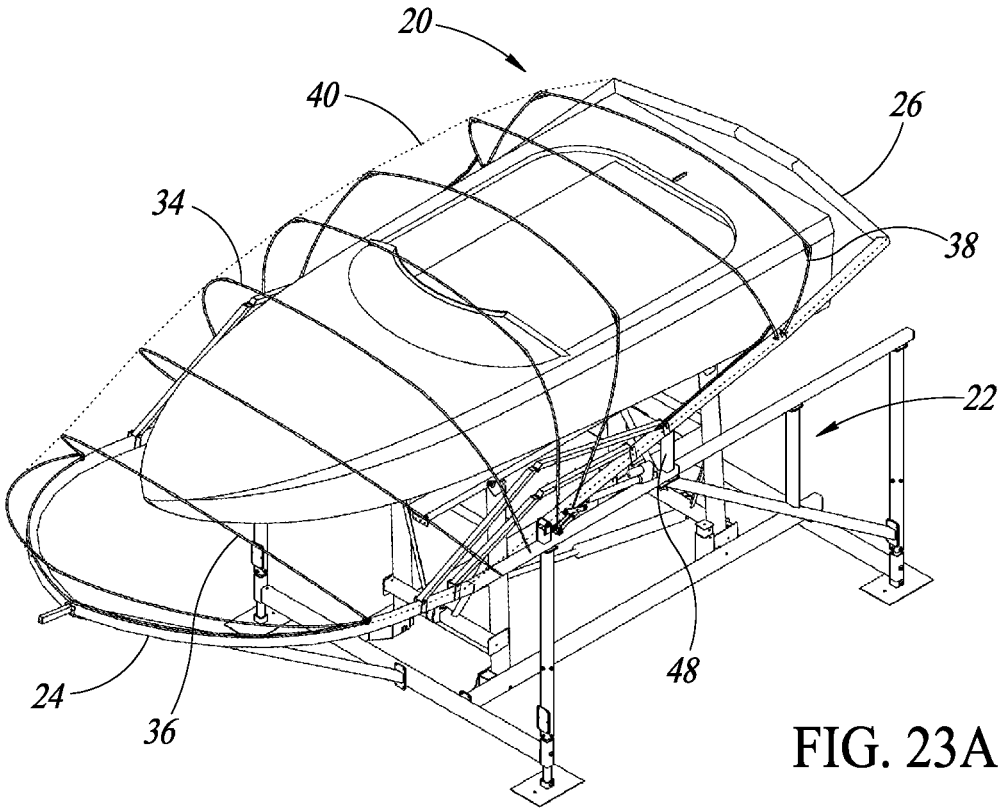
FIGS. 23A-23D are axonometric views of a tenth implementation of a support structure for a retractable canopy in accordance with the present disclosure illustrating the retractable canopy manipulated from an extended configuration to a retracted configuration.
Figure 23B:
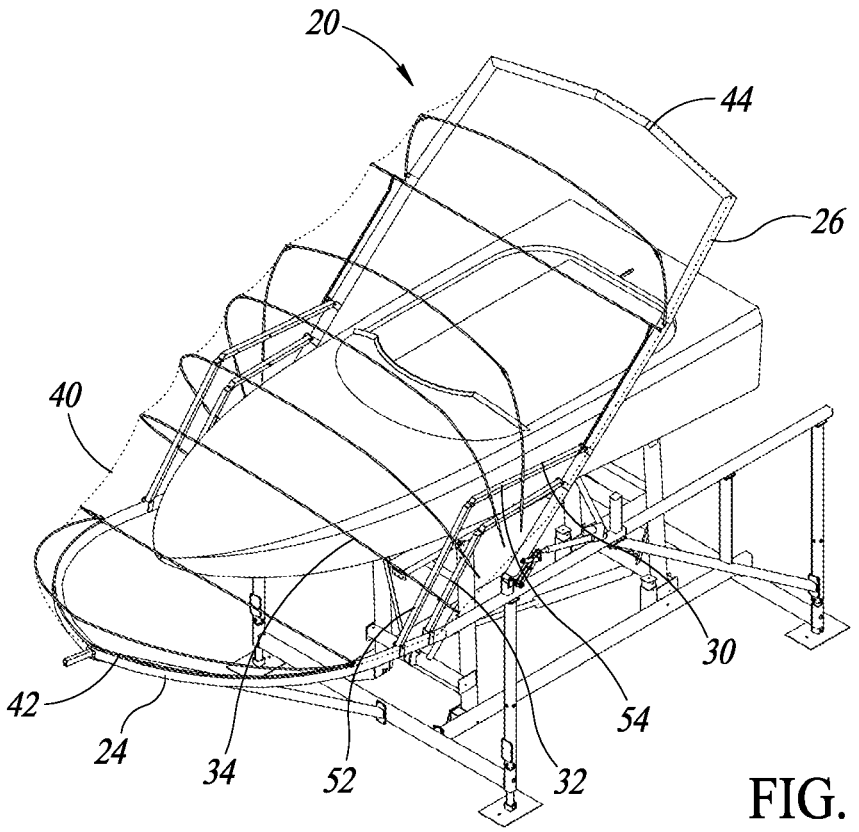
Figure 23C:
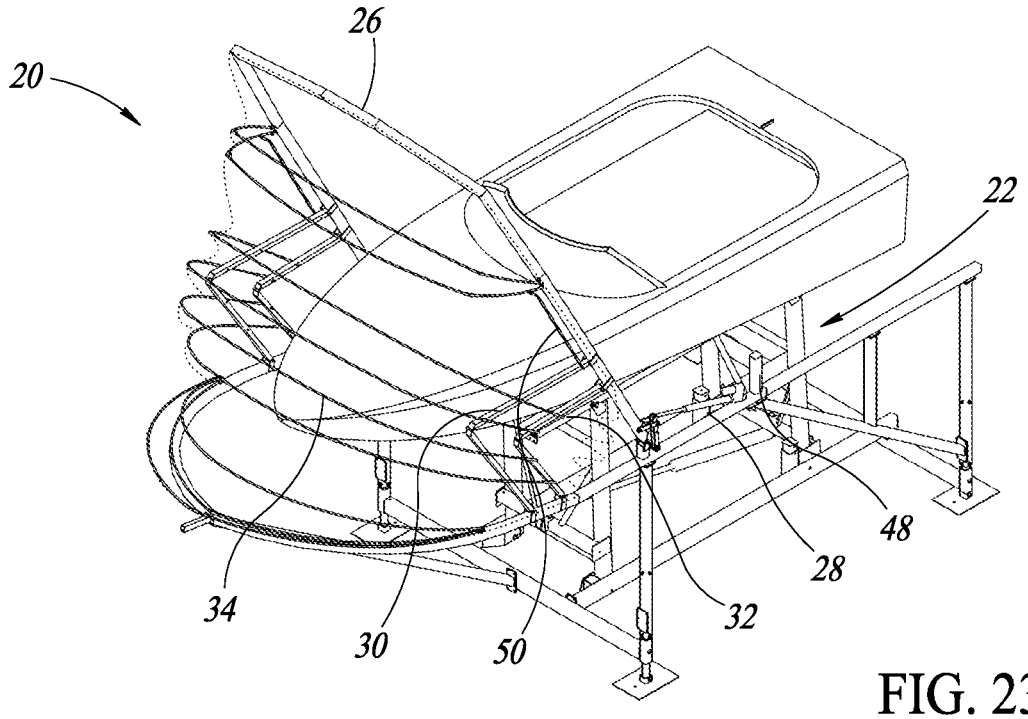
Figure 23D:
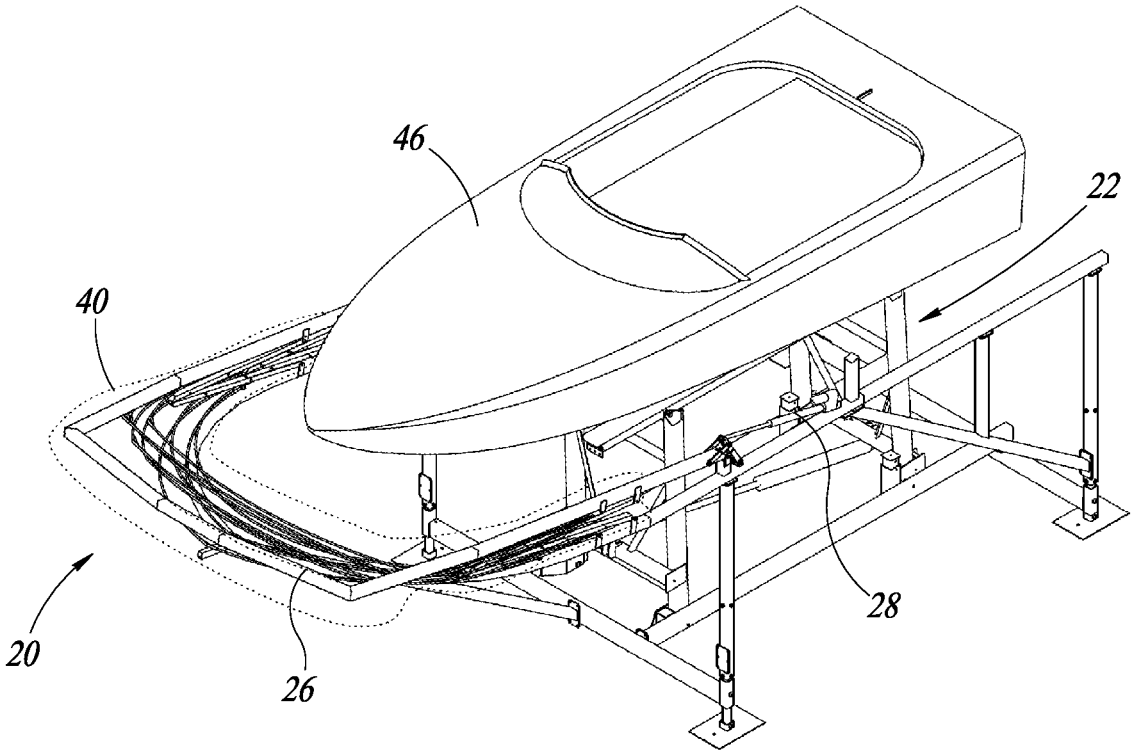
Figure 24A:
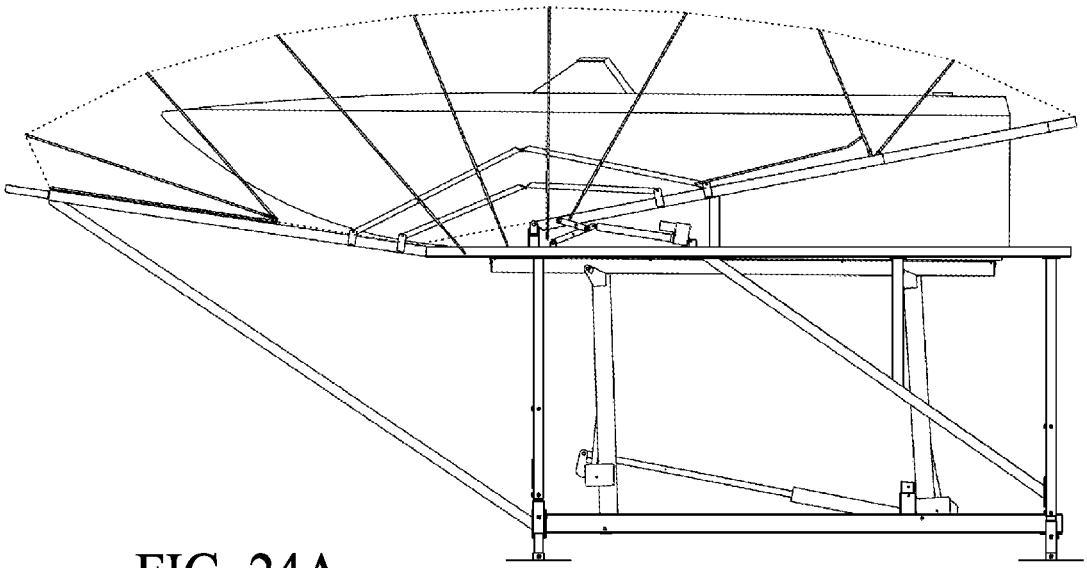
FIGS. 24A-24D are side elevation views of the tenth implementation of the support structure of FIGS. 23A-23D.
Figure 24B:
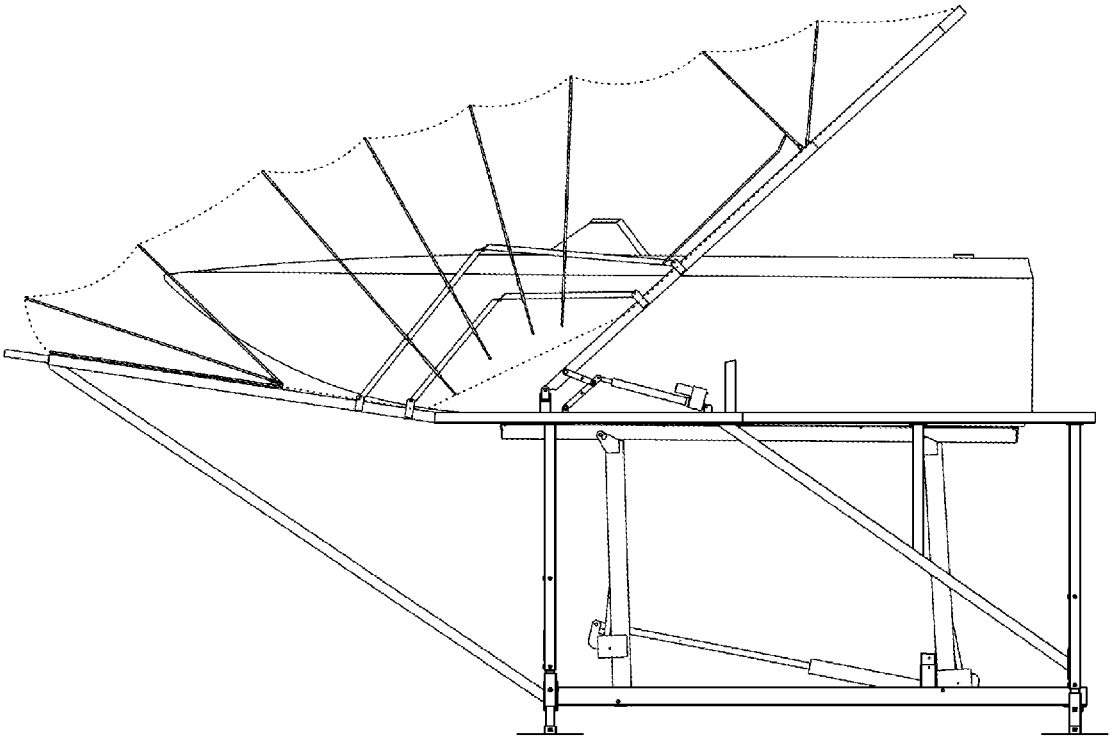
Figure 24C:
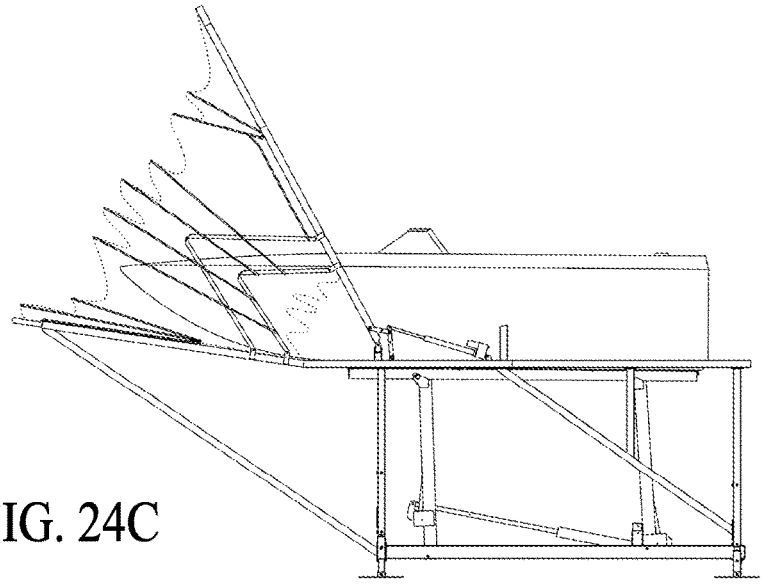
Figure 24D:
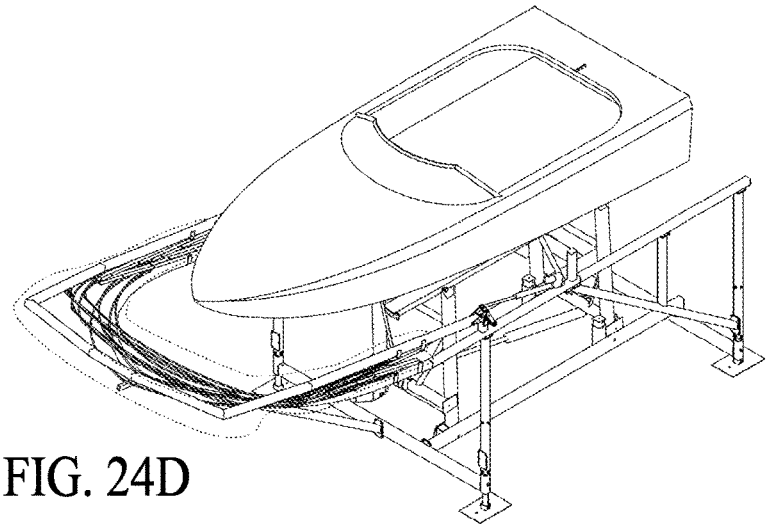
Figure 25A:
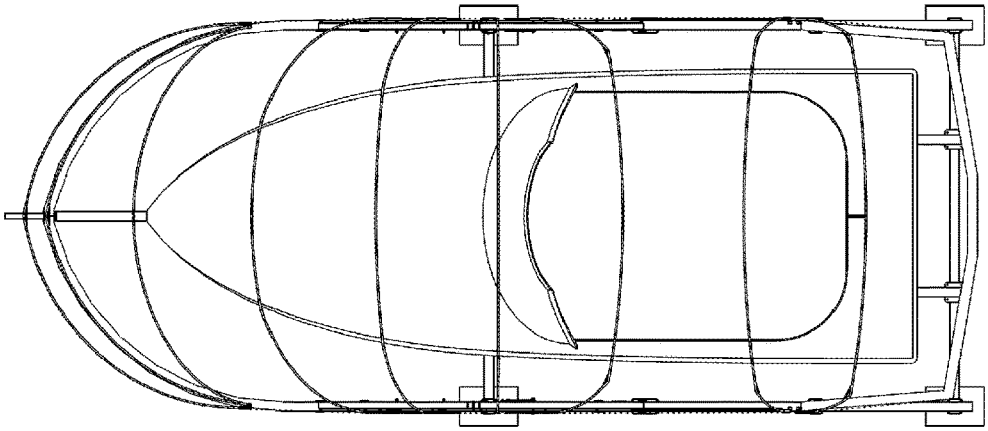
FIGS. 25A-25D are top plan views of the tenth implementation of the support structure of FIGS. 23A-23D.
Figure 25B:
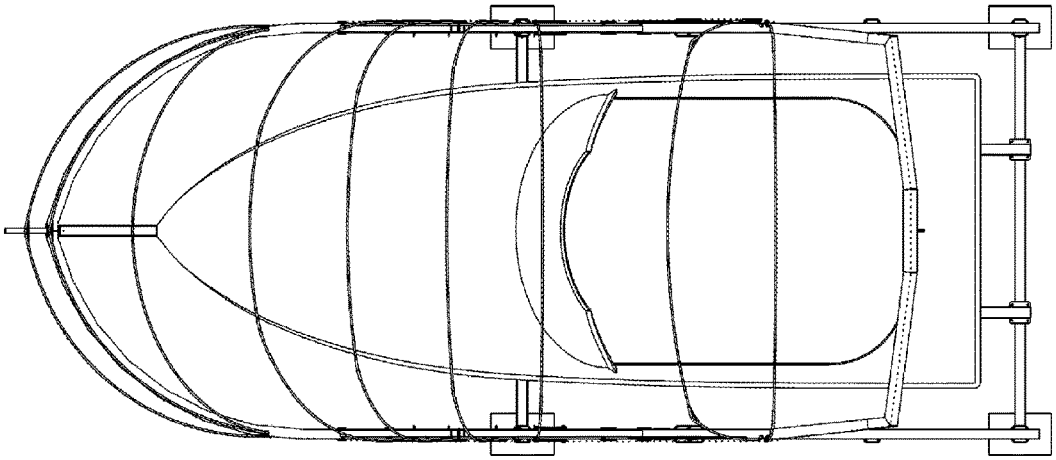
Figure 25C:
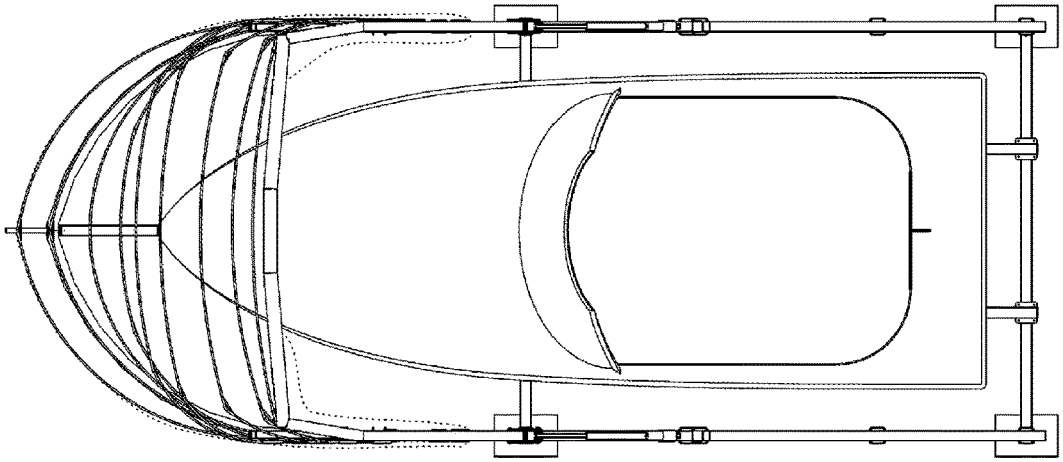
Figure 25D:
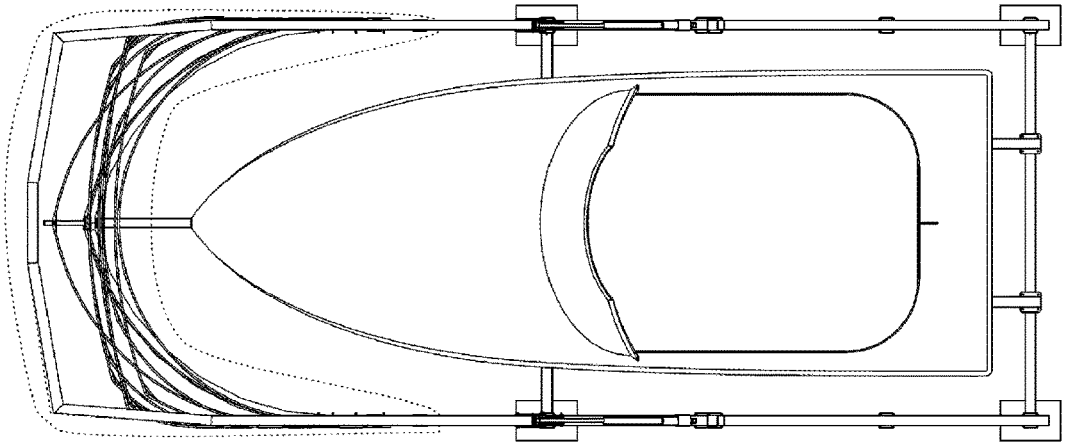
Figure 26A:
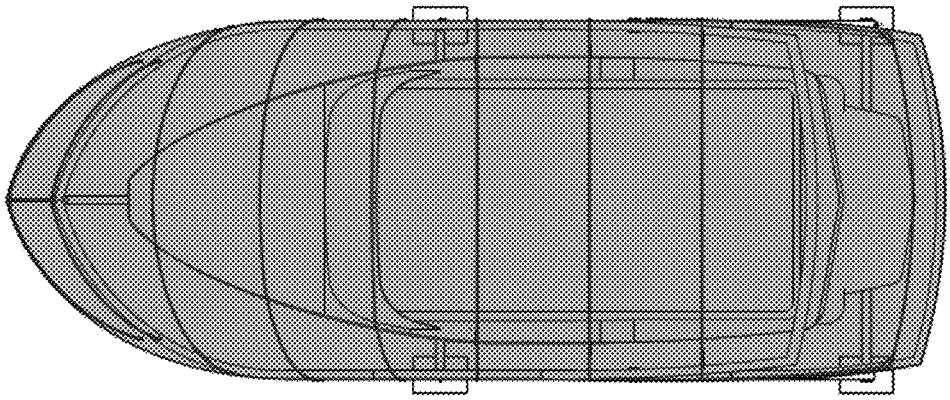
FIGS. 26A-26F are top plan views depicting an eleventh implementation of a support structure for a retractable canopy.
Figure 26B:
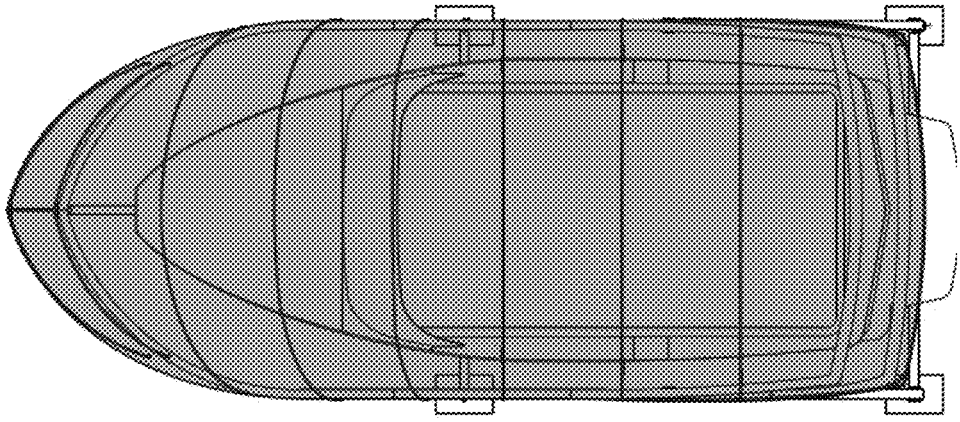
Figure 26C:
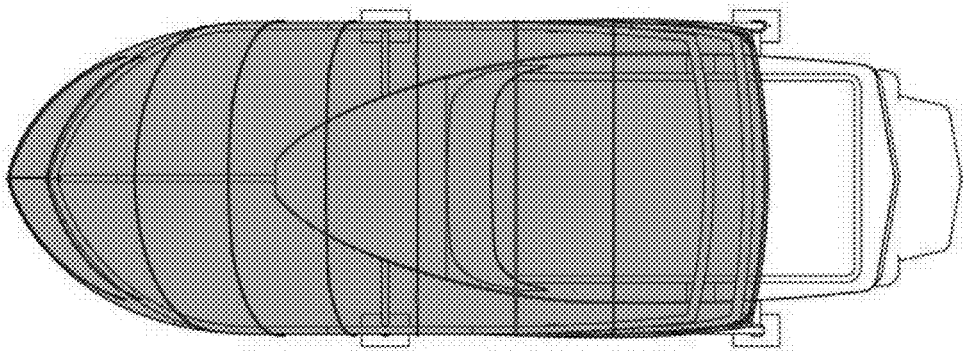
Figure 26D:
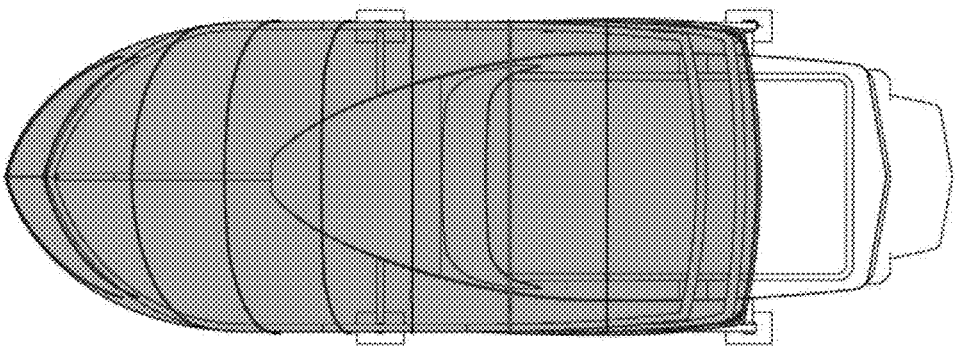
Figure 26E:
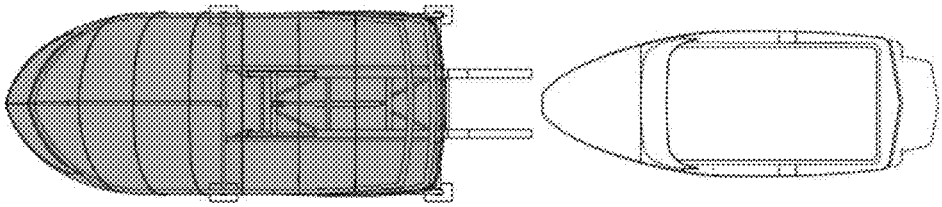
Figure 26F:
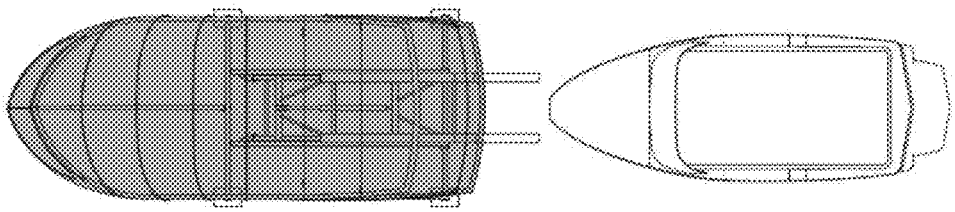
Figure 27A:
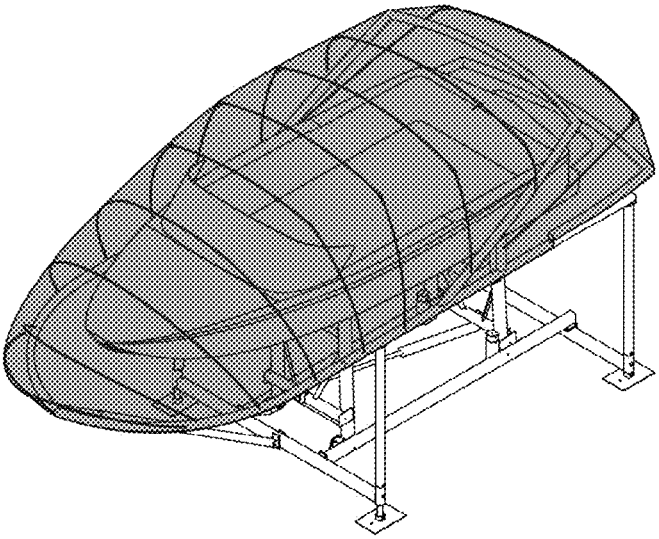
FIGS. 27A-27F are perspective views of the eleventh implementation of the support structure of FIGS. 26A-26F.
Figure 27B:
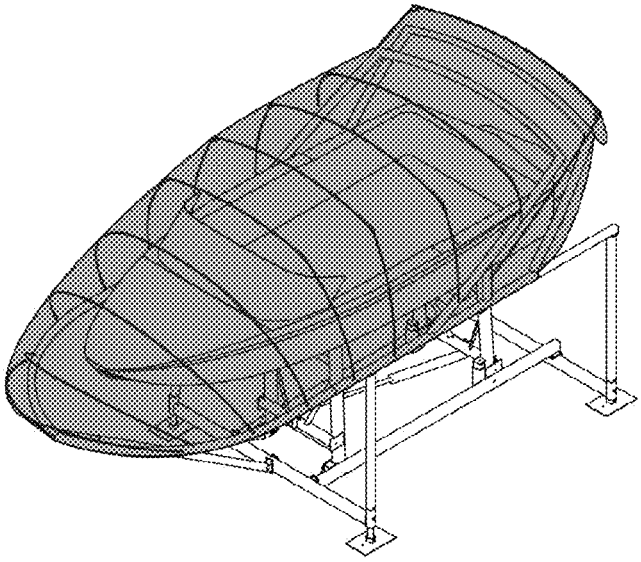
Figure 27C:
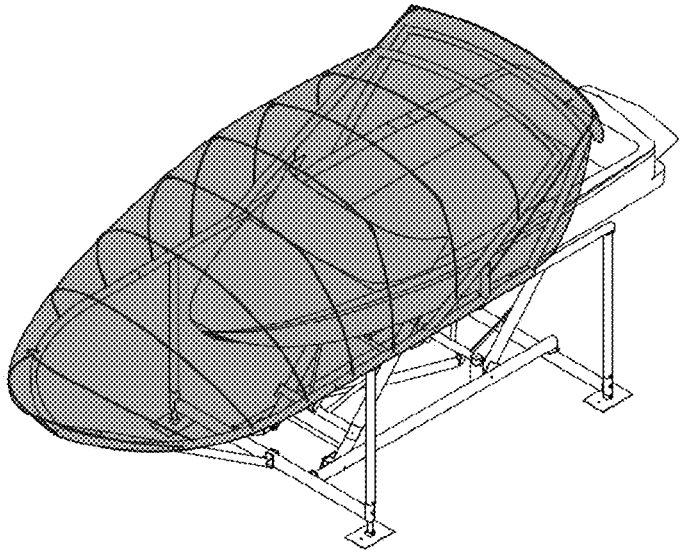
Figure 27D:
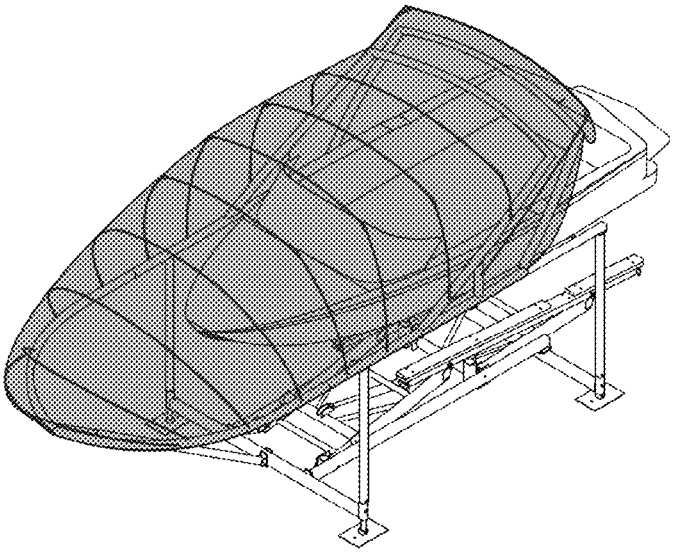
Figure 27E:
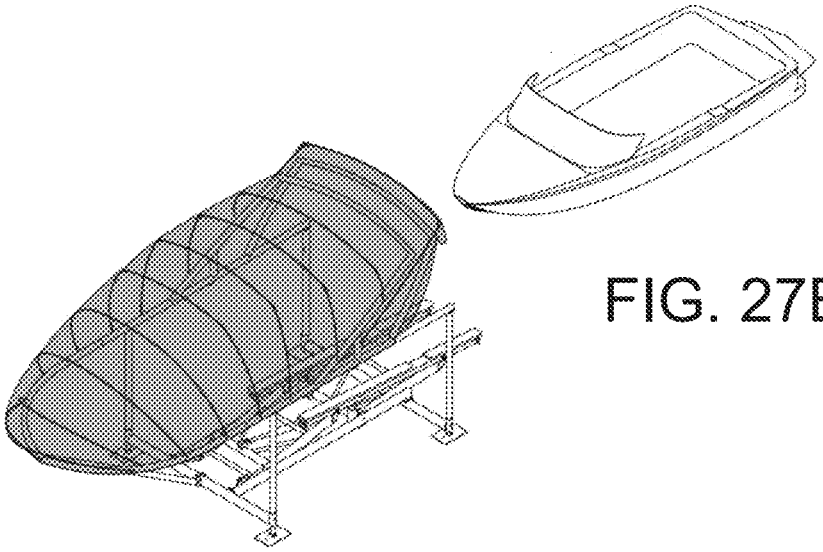
Figure 27F:
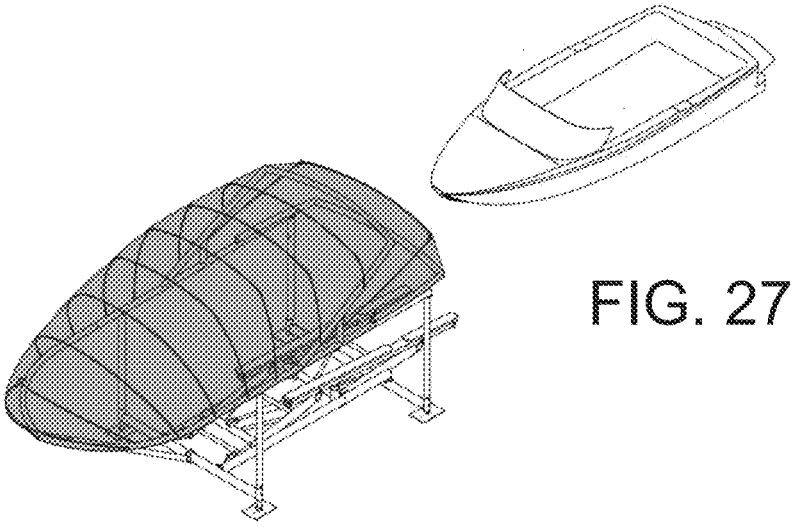
Figure 28A:
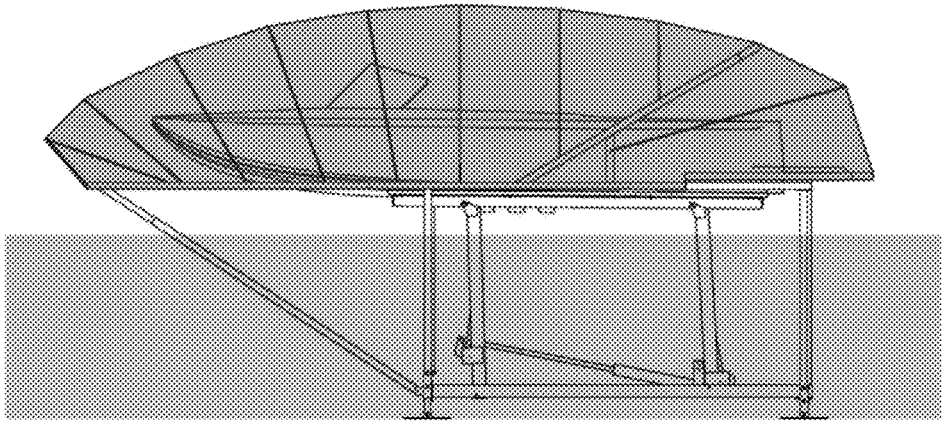
FIGS. 28A-28F are side elevation views of the eleventh implementation of the support structure of FIGS. 26A-26F.
Figure 28B:
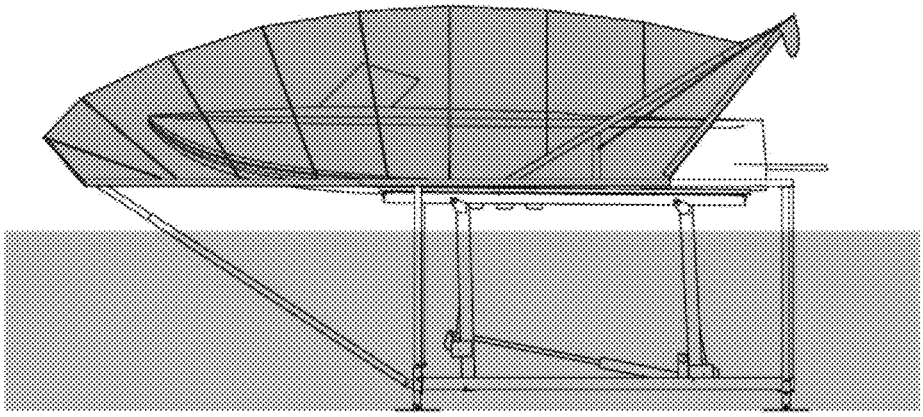
Figure 28C:
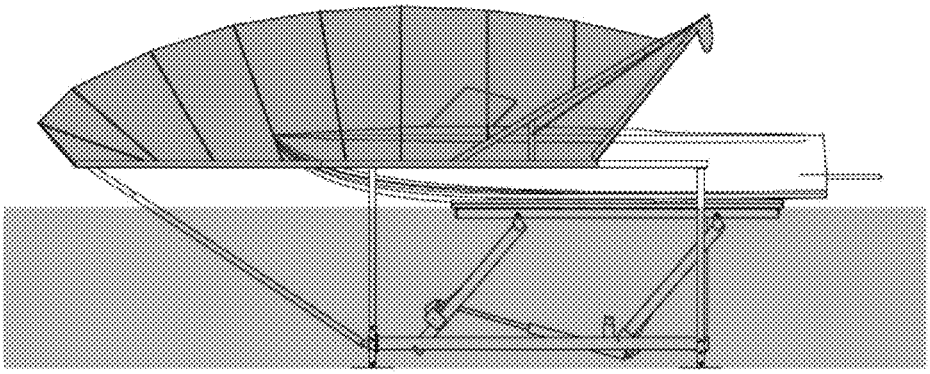
Figure 28D:
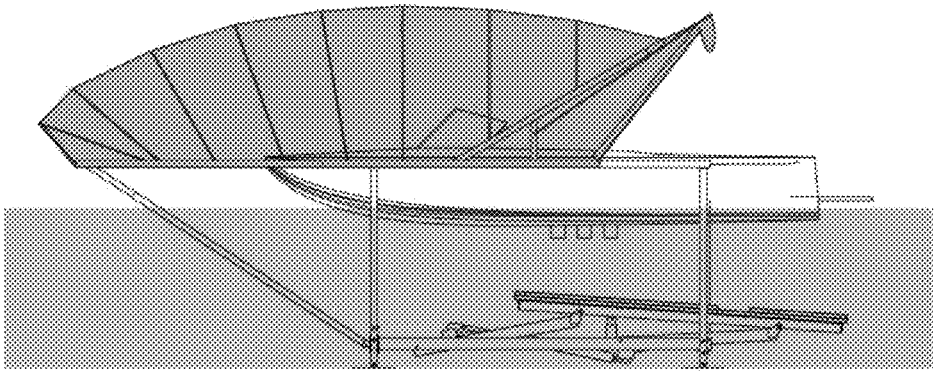
Figure 28E:
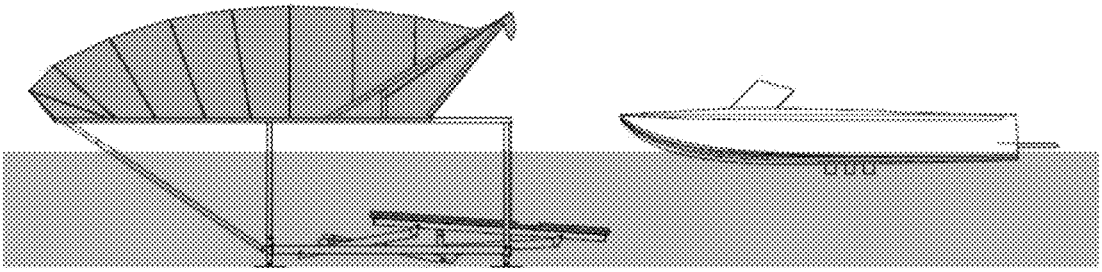
Figure 28F:
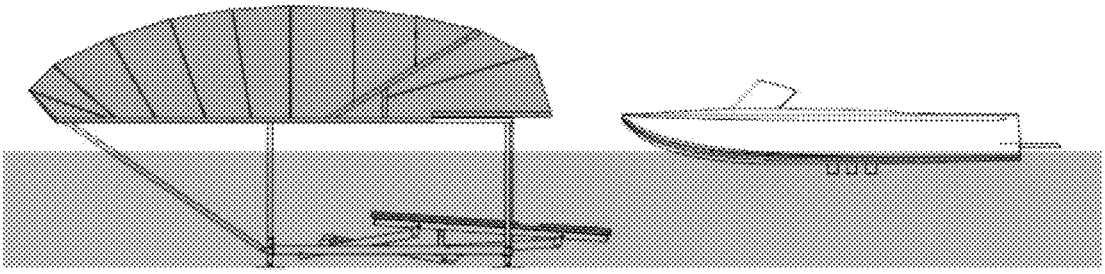

When the movable boom 26 is in the first position, the fixed boom 24, the movable boom 26, the at least one first strut 34, the at least one second strut 36, and the at least one third strut 38 support the cover 40 in an extended configuration above a watercraft area (e.g. area of boat 46) as shown in FIG. 23A. When the movable boom 26 is in the second position, the fixed boom 24, the movable boom 26, the at least one first strut 34, the at least one second strut 36, and the at least one third strut 38 support the cover 40 in a retracted configuration adjacent to the fixed strut 24, as shown in FIG. 23D.

In one implementation, the retractable canopy 20 further includes a support post 48 coupled to the watercraft lift 22, wherein when the movable boom 26 is in the first position, the movable boom 26 contacts the support post 48, as best shown in FIG. 23A. Further, the retractable canopy 20 includes a support rod 50 coupled between one of the at least one third struts 38 and one of at the least one first linkages 30. Preferably, the at least one first strut 34 is also rotatably supported by the at least one second linkage 32. In yet a further implementation, each of the at least one first linkage 30 and each of the at least one second linkage 30 include a first portion 52 coupled to the fixed boom 24 and structured to rotate relative to the fixed boom 24 and a second portion 54 coupled to the movable boom 26 and structured to rotate relative to the movable boom, the first portion 52 coupled to the second portion 54, wherein the first portion 52 and the second portion 54 are structured to rotate relative to each other Finally, FIGS. 26A-26F, 27A-27F, and 28A-28F depict the operation of an eleventh example support structure for a retractable canopy for boats of the present disclosure as used in connection with an example boat lift system.

In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A retractable canopy system; comprising:

a fixed boom;

a movable boom coupled to the fixed boom and structured to rotate relative to the fixed boom;

a linkage coupled to the fixed boom and the movable boom, the linkage extending between the fixed boom and the movable boom;

a first strut coupled to the linkage, the first strut structured to rotate and slide relative to the linkage;

a second strut coupled to the linkage, the second strut structured to rotate relative to the linkage; and a third strut coupled to the linkage, the third strut configured to rotate relative to the linkage.

2. The retractable canopy system of claim 1 further comprising an actuator coupled to the fixed boom and the movable boom and structured to rotate the movable boom between first and second positions relative to the fixed boom.

3. The retractable canopy system of claim 1 wherein the linkage includes a first portion coupled to the fixed boom and a second portion coupled to the movable boom, the first portion of the linkage coupled to the second portion with a hinge.

4. The retractable canopy system of claim 2 further comprising a cover coupled to at least the movable boom, wherein the fixed boom, the movable boom, and the first strut support the cover in an extended configuration above a watercraft area in response to the movable boom being in the first position and wherein the fixed boom, the movable boom, and the first strut support the cover in a retracted configuration adjacent to the fixed boom in response to the movable boom being in the second position.

5. The retractable canopy system of claim 1 wherein the linkage is structured to rotate relative to the fixed boom and the movable boom.

6. The retractable canopy system of claim 1 wherein the linkage is a first linkage, the system further comprising:

a second linkage coupled to the fixed boom and the movable boom and structured to rotate relative to the fixed boom and the movable boom.

7. The retractable canopy system of claim 6 wherein the first, second, and third struts are coupled to the second linkage and structured to rotate relative to the second linkage.

8. The retractable canopy system of claim 1 further comprising:

a cover having a first end and a second end, the first end of the cover coupled to the fixed boom and the second of the cover coupled to the movable boom; and a support post coupled to the fixed boom structured to limit rotational motion of the movable boom.

9. A retractable canopy; comprising:

a fixed boom;

a movable boom coupled to the fixed boom and structured to rotate relative to the fixed boom;

a first linkage coupled to the fixed boom and the movable boom, the first linkage extending between the fixed boom and the movable boom;

a second linkage coupled to the fixed boom and the movable boom;

a first strut coupled to the first linkage and the second linkage, the first strut structured to rotate relative to the first linkage and the second linkage, the first strut further structured to slide relative to the second linkage;

a second strut coupled to the first linkage, the second strut configured to rotate relative to the first linkage;

a third strut coupled to the first linkage, the third strut configured to rotate relative to the first linkage; and a cover having a first end and a second end, the first end coupled to the fixed boom and the second end coupled to the movable boom.

10. The retractable canopy of claim 9 further comprising:

an actuator coupled to the fixed boom and the movable boom and structured to rotate the movable boom.

11. The retractable canopy of claim 9 wherein the first and second linkages are each structured to rotate relative to the fixed boom and the movable boom.

12. The retractable canopy of claim 9 wherein the second strut is coupled to the first linkage and the second linkage, the second strut structured to rotate relative to the first linkage and the second linkage, the second strut further structured to slide relative to the second linkage.

13. The retractable canopy of claim 12 wherein the third strut is coupled to the first linkage and the second linkage, the third strut structured to rotate relative to the first linkage and the second linkage, the third strut further structured to slide relative to the second linkage.

14. The retractable canopy of claim 9 further comprising:

a support post coupled to the fixed boom and configured to limit rotational motion of the movable boom.

15. A retractable canopy; comprising:

a fixed boom;

a movable boom coupled to the fixed boom and structured to rotate relative to the fixed boom;

a first linkage coupled to the fixed boom and the movable boom, the first linkage extending between the fixed boom and the movable boom;

a first strut coupled to the first linkage, the first strut structured to rotate and to slide relative to the first linkage;

a second strut coupled to the first linkage, the second strut structured to rotate and to slide relative to the first linkage; and a third strut coupled to the first linkage, the third strut configured to rotate relative to the first linkage.

16. The retractable canopy of claim 15 further comprising:

an actuator coupled to the fixed boom and the movable boom and structured to rotate the movable boom relative to the fixed boom.

17. The retractable canopy of claim 15 further comprising:

a cover coupled to at least one of the fixed boom, the movable boom, the first strut and the second strut.

18. The retractable canopy of claim 15 further comprising:

a second linkage coupled to the fixed boom and the movable boom, the first strut and the second strut structured to rotate relative to the second linkage.

* * * * *